US012006120B2

(12) United States Patent
Van Spronsen et al.

(10) Patent No.: US 12,006,120 B2
(45) Date of Patent: Jun. 11, 2024

(54) CLOSURE ASSEMBLY COMPRISING A CAP WITH INTEGRATED TAMPER-EVIDENT RING AND STRAP

(71) Applicant: Scholle IPN IP BV, SX Tilburg (NL)

(72) Inventors: Frederik Adriaan Van Spronsen, PT Geldrop (NL); Jeroen Pieter Fiere, 's-Gravendeel (NL); Dhandutt Shah, Mumbai (IN); Nicolaas Adrianus Petrus Groenendaal, XH Tilburg (NL)

(73) Assignee: SIG SERVICES AG, Neuhausen am Rheinfall (CH)

( * ) Notice: Subject to any disclaimer, the term of this patent is extended or adjusted under 35 U.S.C. 154(b) by 293 days.

(21) Appl. No.: 17/607,856

(22) PCT Filed: Apr. 29, 2020

(86) PCT No.: PCT/EP2020/061896
§ 371 (c)(1),
(2) Date: Oct. 29, 2021

(87) PCT Pub. No.: WO2020/221801
PCT Pub. Date: Nov. 5, 2020

(65) Prior Publication Data

US 2022/0204235 A1 Jun. 30, 2022

(30) Foreign Application Priority Data

Apr. 30, 2019 (NL) ..... 2023034
Jul. 18, 2019 (NL) ..... 2023525
Dec. 19, 2019 (NL) ..... 2024518

(51) Int. Cl.
*B65D 75/58* (2006.01)
*B65D 55/16* (2006.01)

(52) U.S. Cl.
CPC ..... *B65D 75/5883* (2013.01); *B65D 55/16* (2013.01); *B65D 2251/02* (2013.01)

(58) Field of Classification Search
CPC ..... B65D 55/16; B65D 75/5883; B65D 2251/02; B65D 2401/15; B65D 55/08; B65D 55/0881
(Continued)

(56) References Cited

U.S. PATENT DOCUMENTS

2004/0238564 A1* 12/2004 Bourque ..... B65D 75/5883 222/92
2007/0262100 A1 11/2007 Murray
(Continued)

FOREIGN PATENT DOCUMENTS

EP 1961669 A2 8/2008
EP 2380820 A1 10/2011
(Continued)

*Primary Examiner* — John K Fristoe, Jr.
*Assistant Examiner* — Laura E. Parker
(74) *Attorney, Agent, or Firm* — Jovan N. Jovanovic; The Watson IP Group, PLC

(57) ABSTRACT

A closure assembly (1) comprising an article (10) with a tubular neck (11) and a cap (30) including an integrated tamper-evident ring member (50) and an integrated strap (70). The tamper-evident ring member is integrally formed to the lower edge (32*c*) of the skirt (32) of the cap and comprises an annular base portion (51) which is connected via one or more breakable bridges (53) to the skirt. The cap is a snap-on type cap and comprises a pair of wing-shaped handles (33) that each have, seen in side view thereon, an outer periphery (34) with a bottom side (34*a*), a top side (34*b*), and a tip (34*c*) remote from the skirt. The strap is integral at a first end (71) thereof to the annular base portion and at a second end (72) thereof to one of the wing-shaped handles and is adapted to remain connected to both the annular portion of the tamper-evident ring member and the
(Continued)

Figure 1:
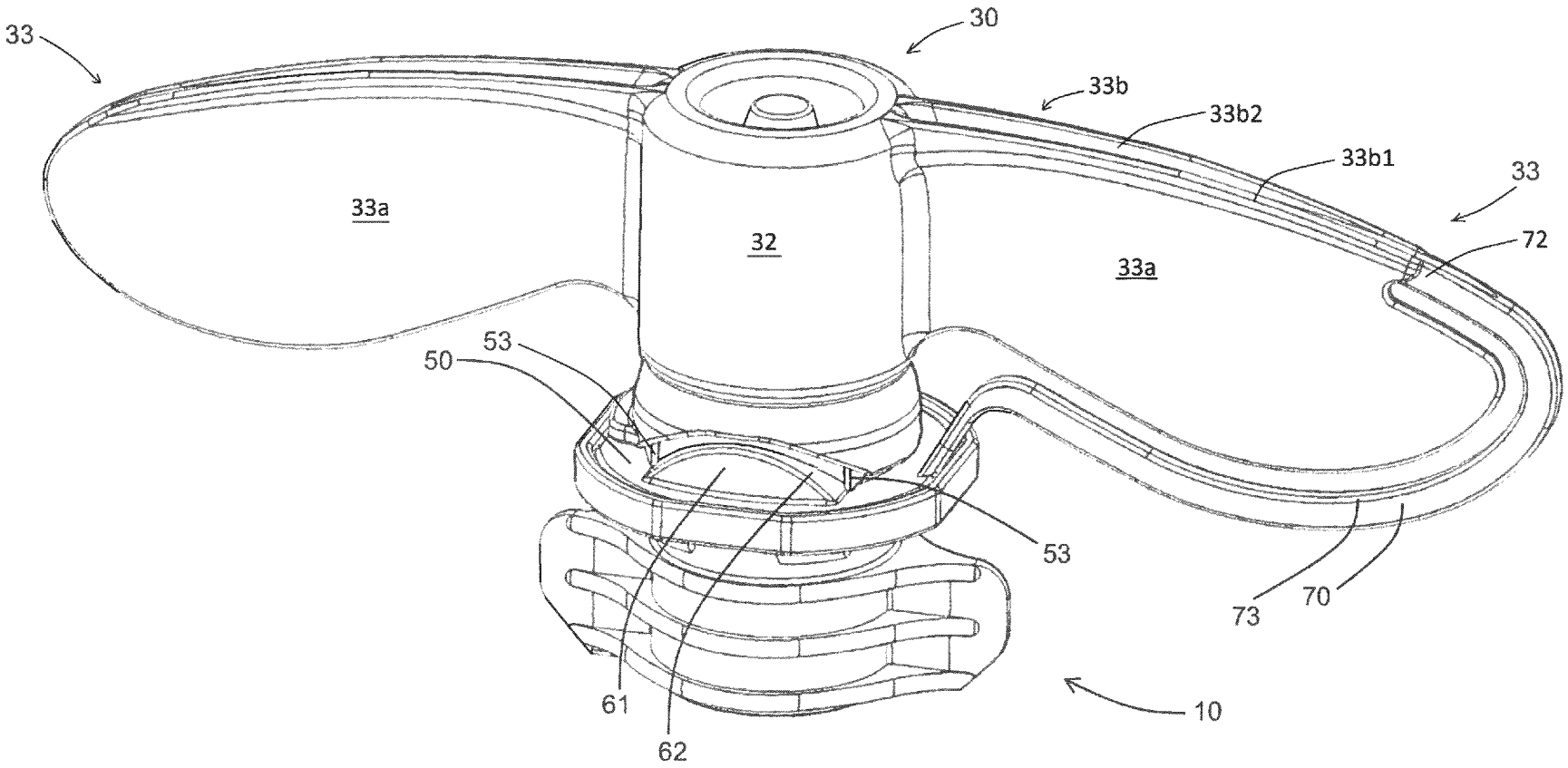

respective wing-shaped handle upon removal of the cap from the neck of the article by the user.

33 Claims, 33 Drawing Sheets

(58) Field of Classification Search
USPC ..... 215/252, 306; 222/543; 220/375
See application file for complete search history.

(56) References Cited

U.S. PATENT DOCUMENTS

| | | | | |
|---|---|---|---|---|
| 2008/0073348 | A1* | 3/2008 | Pritikin | B65D 47/147 222/1 |
| 2015/0251827 | A1 | 9/2015 | Campbell | |
| 2019/0177044 | A1* | 6/2019 | Beringer | B65D 47/0838 |

FOREIGN PATENT DOCUMENTS

| | | | | |
|---|---|---|---|---|
| GB | 2492586 | A | 1/2013 | |
| JP | 2006096416 | A | 4/2006 | |
| KR | 20180109233 | A | 10/2018 | |
| WO | 2012044166 | A1 | 4/2012 | |
| WO | 2014007612 | A1 | 1/2014 | |
| WO | 2014196859 | A1 | 12/2014 | |
| WO | 2017135824 | A1 | 8/2017 | |
| WO | WO-2017135824 | A1 * | 8/2017 | B65D 41/3428 |

* cited by examiner

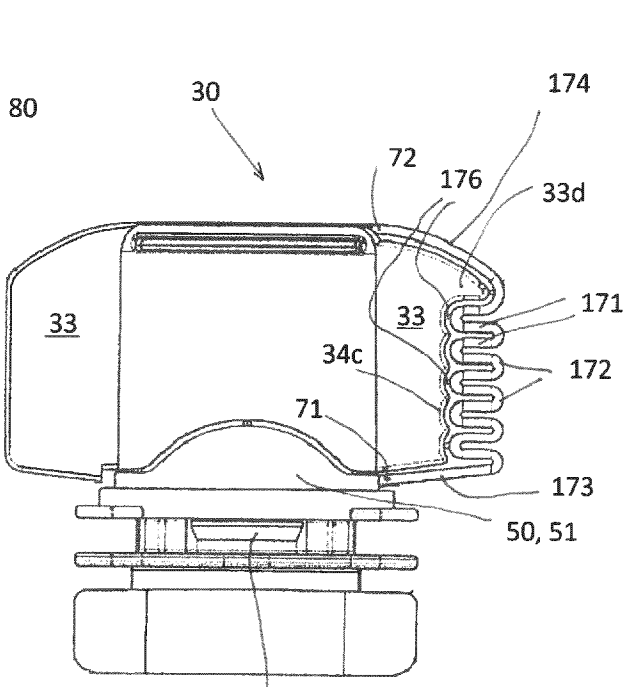
Fig. 31
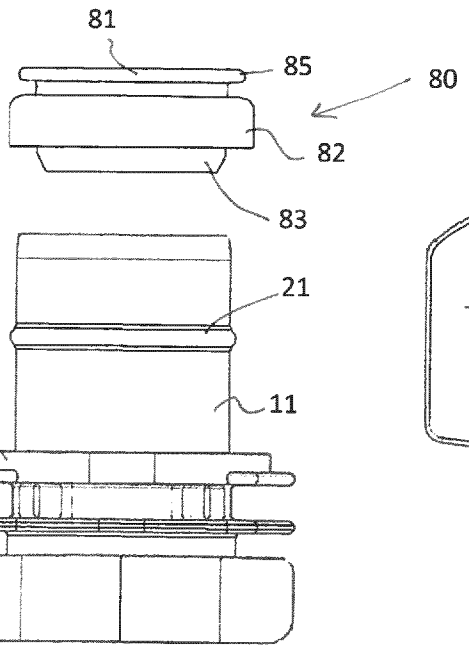
Fig. 30
Fig. 29
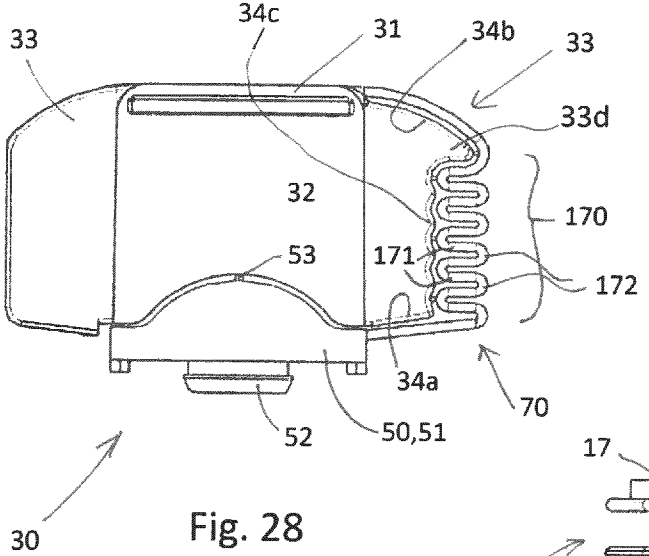
Fig. 28

CLOSURE ASSEMBLY COMPRISING A CAP WITH INTEGRATED TAMPER-EVIDENT RING AND STRAP

FIELD OF THE INVENTION

The present invention relates to a closure assembly, a container provided with the closure assembly, and to a method for producing filled containers provided with the closure assembly.

BACKGROUND OF THE INVENTION

Closure assemblies are known with a plastic cap that can be removed by a user through a lifting and/or rotational movement from a neck, e.g. the neck of a plastic container with integrally molded neck or the neck of a spout that has been fitted on a collapsible pouch container.

In manufacturing a closure assembly, a tamper-evident structure is often integrally molded as a part of the plastic cap. Examples of such closure assemblies are for example shown in WO2014/007612, WO2012/044166, EP2380820, GB 2492586, and WO2017/135824.

OBJECT OF THE INVENTION

The present invention aims to provide an improved closure assembly, or at least aims to provide an alternative for known closure assemblies.

In particular, several aspects of the invention aim to provide an easy to operate closure assembly that also seeks to avoid that the cap becomes separated from the article, e.g. reducing the chance that the cap ends up in the environment instead of being properly disposed of, e.g. in view of recycling.

SUMMARY OF THE INVENTION

According to a first aspect of the present invention one or more of the above-mentioned objects are achieved by a closure assembly comprising an article and a cap. The cap includes a integrated tamper-evident ring member and an integrated strap.

The inventive closure assembly allows for attractive manufacturing of the cap, as well as easy opening by the user and allows for a simple and attractive structural design of the strap. As preferred, the cap is of the snap-on type, which requires little relative motion of the cap relative to the article to disengage the snap connection, e.g. compared to a screw-type cap.

In embodiments, the strap, prior to first time removal of the cap by the user, is located in a vertical plane that is in common with a panel portion of the respective wing-shaped handle. This allows for efficient molding of the cap as well as for an attractive design.

In an embodiment, as preferred, the base portion is an annular base portion. In another embodiment, for example, the cap comprises two semi-circular base portions at the lower end of the skirt and arranged around the neck when the cap is secured on the article. In another embodiment, for example, the base portion is U-shaped or C-shaped in plan view.

The base portion of the cap is configured to remain connected to the article upon removal of the cap from the neck of the article by the user. For example, the base portion of the cap and the article are embodied to be connected through a permanent snap-joint that is established upon the cap being mounted on the article, e.g. in an axial securing motion. In another embodiment, the base portion is heat-sealed to the article.

In embodiments, the strap, prior to first time removal of the cap by the user, extends outward from the base portion of the tamper-evident ring member towards the tip of the respective wing-shaped handle, e.g. the second end of the strap being inward of the tip of the wing-shaped handle.

In embodiments, the strap extends outward from the base portion of the tamper-evident ring member towards the tip of the respective wing-shaped handle along the bottom side of the wing-shaped handle, further about the tip of the wing-shaped handle, and along a portion of the top side of the wing-shaped handle to the second end of the strap, e.g. the second end being located at a distance outward of the skirt.

In practical embodiments, each wing-shaped handle extends at least 25 millimetres outward from the axis of the tubular neck, e.g. for embodiments wherein the neck has an outer diameter of between 8 and 13 millimetres. For example, the tip outermost point lies between 25 and 40 millimetres outward from the axis of the tubular neck, e.g. the total width of the cap having two opposed wing-shaped handles being between 50 and 80 millimetres. In practical embodiments, the length of the strap is between 30 and 50 millimetres, e.g. sufficient to allow moving the cap over the top end or mouth end of the neck for removal and replacement of the cap.

In practical embodiments, each wing-shaped handle has a height between 10 and 20 millimetres, e.g. for embodiments wherein the neck has an outer diameter of between 8 and 13 millimetres.

In practical embodiments, second end of the strap connecting to the wing-shaped handle is located remote from the skirt at a location that is at least 10 millimetres outward from the skirt, e.g. for embodiments wherein the neck has an outer diameter of between 8 and 13 millimetres. This, e.g. allows for the user to place a finger, e.g. a thumb, onto the wings-shaped handle at a location adjacent the skirt, wherein said finger does not interfere with the flexing of the strap when rotating the cap for first time opening. This embodiment is, for example, of relevance for a quarter turn cap. This embodiment allows for a limited length of the strap. In practical embodiments, the length of the strap is between 30 and 50 millimetres, e.g. sufficient to allow moving the cap over the top end or mouth end of the neck for removal and replacement of the cap.

In embodiments, the integrated strap of the cap comprises a strap inner contour side, facing towards the respective wing-shaped handle prior to the first time removal of the cap, and a strap outer contour side, facing away from the wing-shaped handle.

In embodiments, the base portion, preferably the annular base portion, of the tamper-evident ring member comprises one or more integrally formed hook members, wherein the article comprises one or more hook member passages, each hook member passage being adapted to receive a hook member when the cap is mounted on the neck, for example wherein the article is provided with an annular flange portion on the neck of the article and wherein a hook portion of each hook member engages, e.g. snaps, underneath a bottom face of said annular flange portion on the neck of the article. This cap can be mounted, e.g. in an axial securing motion, on the article so that the one or more hook members engage the related passage. Preferably, said one or more hook members are configured to establish a permanent securing of the base portion to the article. Thereby, upon first time removal of the cap by a user, the base portion remains connected to the article.

In an embodiment, the base portion of the integrated tamper-evident ring member is embodied with an annular ring member flange portion and with multiple hook members that are integrally formed to the bottom of the ring member flange portion. These hook members are distributed in a circumferential direction of the ring member flange portion. Each hook member comprises a leg having an upper end integral with the ring member flange portion and protruding downward from the ring member flange portion. Each hook member comprises a hook portion at the lower free end of the leg.

In an embodiment, the hook members passages are located directly adjoining the neck.

In an embodiment, the legs of the hook members each have an inner leg face, this inner leg face adjoining the inner face of the flange portion of the ring member. This effectively locates the hook members closely adjacent the exterior of the neck, which is found effective when it comes to providing retention strength for the ring member using little plastic material compared to a location of the hook members further outward relative to the neck of the article.

In practical embodiments, the hook portion protrudes outwardly and away from the neck.

In an alternative design, the hook portion could protrude from the leg in a circumferential or tangential, direction relative to the neck.

In an embodiment, a hook member has two legs, or a single leg forked at its lower end, wherein each of said legs, or each forked end, has a corresponding hook portion. For example, an inverted V-shaped hook member is envisaged with two legs, or a forked leg. The legs or forked lower ends are then, preferably, located in an arrangement that is tangential or relative to the main axis, e.g. with the associated hook portions protruding in opposed tangential directions.

In an embodiment, the leg of at least one hook member, e.g. of all hook members, has an inner bevel face at the lower end thereof, e.g. at a junction of an inner leg face and a lower end face of the leg. Herein the neck is integrally formed with a corresponding bevel faced boss at a location below the corresponding hook member passage, such that upon axially mounting the cap with the integrated tamper-evident ring member on the neck by means of said axial securing motion along the main axis, the bevelled face of the boss contacts the inner bevel face of the leg and thereby assists in keeping the hook portion of the hook member engaged, e.g. snapped, underneath the bottom face of the annular flange portion on the neck of the article. This embodiment is most practical when the hook portion is directed outward, away from the neck.

In embodiments, the annular base portion of the tamper-evident ring member comprises an annular ring member flange portion that has a top face, a bottom face, an inner face, and an outer face, wherein multiple hook members are integrally formed to the bottom of the ring member flange portion, the hook members being distributed in a circumferential direction of the ring member flange portion, wherein each hook member comprises a leg having an upper end integral with the ring member flange portion and protruding downward from the ring member flange portion, wherein each hook member comprises a hook portion at the lower free end of the leg, wherein the article further comprises a circumferential flange structure which comprises an annular flange portion that is integrally formed to the neck and extends around the neck, which flange portion has a top face, a bottom face, and a periphery, wherein the annular flange portion on the neck of the article is provided with multiple hook member passages that each extend between the top face and the bottom face through said annular flange portion, each hook member passage being adapted to receive a hook member when the cap with the integrated tamper-evident ring member is mounted on the neck, wherein the hook portion of each hook member engages, e.g. snaps, underneath the bottom face of the annular flange portion on the neck of the article, and wherein the closure assembly is embodied such that upon first time opening of the closure assembly by removal of the cap by a user the one or more breakable bridges break and the ring member is retained by means of the hook members.

In an embodiment of the closure assembly addressed in the preceding paragraph, the flange structure further comprises a peripheral protective rim portion that is integral to and extends upwards from the flange portion at the periphery thereof, so that the top face of the flange portion and the protective rim define an annular recess around the neck, wherein the periphery of the annular flange portion of the ring member is shaped to fit within the protective rim portion as the annular flange portion is at least partially inserted in said annular recess upon mounting of the cap with the integrated tamper-evident ring member on the neck, wherein the peripheral protective rim portion is adapted to obstruct lateral access from outside to the interface between the top face of the flange portion of the article and the bottom face of the flange portion of the ring member, and wherein the closure assembly is embodied such that upon first time opening of the closure assembly by removal of the cap by a user the one or more breakable bridges break and the ring member is retained in the recess of the article by means of the hook members.

In an embodiment, the protective rim portion has a height such that, in the secured position of the cap provided with the integrated tamper-evident ring member, an outer annular zone of the top face of the flange portion thereof does not protrude above the protective rim portion. Preferably, this outer annular zone of the top face is located lower than the top of the rim portion. Hereby lateral access to the ring member is even further obstructed, thus reducing the practical possibility to exert a force thereon that would pull the ring member off the neck of the article.

In an embodiment, the outer periphery of the annular flange portion of the ring member and the inner periphery of the protective rim portion are shaped non-circular, e.g. thereby providing enhanced resistance against the ring member being rotated along with the cap upon first time opening of the closure.

In an embodiment, the outside of the protective rim provides at least one pair of opposed parallel side faces, preferably two pairs that are orthogonal to one another, e.g. the protective rim being four-sided preferably with rounded corner faces. This embodiment e.g. allows for the parallel side face pairs to be used in the course of guidance of the article, e.g. of a pouch provided with a spout embodied like this, in a production and/or filling line. Having two orthogonal pairs of such parallel side faces e.g. allows for guidance in two orthogonal directions, e.g. in a pouch manufacturing line along one direction, and in a filling line of pouches directly downstream thereof in another, orthogonal direction. It will be appreciated that the inside of the protective rim, preferably also the periphery of the flange portion of the ring member, may have the same design.

In an embodiment, the upper face of the flange portion on the neck of the article is substantially planar, preferably radial to the main axis, wherein the bottom face of the ring member flange portion is substantially planar, preferably radial to the main axis. Thereby the interface between these flange portions is in a plane that is preferably radial or perpendicular to the main axis, in other words in this context horizontal.

In an embodiment these faces of the flange portions are flat and smooth, in another embodiment these faces have mating reliefs, e.g. ribs and grooves, to provide an axial form locking engagement of these faces that, e.g., counters any torque on the ring member about the main axis (e.g. upon first time opening of the cap). This embodiment, with axially mating relief on these faces may, e.g. be combined with a circular periphery of the flange portions and of the protective rim.

In embodiments, the strap has a cross-section that is adapted to withstand a pulling force of at least 90 N at 20° C. without breaking.

In embodiments, the tip of the wing-shaped handles is a rounded tip seen in side view thereon.

In embodiments, the cap comprises two straps, each strap connecting the base portion to a respective one of the pair of wing-shaped handles.

In embodiments, the strap comprises at least one hinge section, preferably a hinge section wherein the cross-section of the strap is locally reduced allowing the strap to bend at the hinge, e.g. the hinge configured to allow for pivoting in and out of the plane of the wing-shaped handle.

In embodiments, the hinge section is located at the second end of the strap where the strap connects to the respective wing-shaped handle.

In embodiments, the cap comprises one or more breakable tamper-evident bridges located between the strap and the respective wing-shaped handle, said one or more breakable tamper-evident bridges breaking upon first time removal of the cap by a user.

In an embodiment, one or more of the wing-shaped handles each have, seen in side view thereon, an outer periphery comprising a bottom side, a top side, and a tip remote from the skirt. Herein, the bottom side and the top side are vertically spaced apart from one another. The tip extends over a height between a top end thereof adjoining the top side of the periphery and a lower end thereof adjoining the bottom side of the periphery. In an embodiment of this design, the top side extends further outward than the vertically extending section of the tip and the tip further comprises an outward section joining the top end of the vertically extending section to the outermost end of the top side, so as to form an overhanging portion of the wing-shaped handle.

In an embodiment, the strap, prior to first time removal of the cap by the user, comprises an undulating strap section having strap portions in an undulating pattern. Herein, successive strap portions are integral at an apex of the undulating strap section. The undulating strap section allows for an increased length of the strap compared to a design wherein the strap lacks an undulation portion and follows, at least a part of, the outer periphery or contour of the wing-shaped handle. For example, an undulating strap section is provided in combination with a relatively short handle seen in lateral direction. For example, the associated handle has a lateral extension of between 5 and 15 millimeters relative to the skirt of the cap.

In an embodiment, the strap portions of the undulating strap section are arranged substantially horizontal. For example between five and fifteen, e.g. ten strap portions make up the section with horizontal strap portions therein. By increasing the number of portions, e.g. to more than five, one can effectively reduce the length of each individual portion in the undulating strap section, e.g. to less than 10 millimeters, e.g. between 4 and 8 millimeters, and thereby avoid undue sagging or the like in the undulating strap section.

In an embodiment, the undulating strap section is adjoined to the wing-shaped handle via one or more breakable bridges, e.g. a breakable bridge extending from an apex thereof to the wing-shaped handle. This also counters any undue sagging or the like in the undulating section.

In embodiments, the horizontal extension of the undulating strap section is less than the horizontal distance between the skirt and the vertically extending section of the tip.

In an embodiment, the undulating strap section, e.g. with horizontal or vertical strap portions, is arranged below an overhanging portion of the win-shaped handle, wherein the undulating strap section is outwardly adjacent the vertical section of the tip of the handle. This provides some protection of this strap section against undue interference, e.g. when handling the cap during assembly of the closure assembly.

In an embodiment, a lowermost strap portion extends from the base portion outward, along the bottom side of the wing-shaped handle and then even further outward. The undulating strap section adjoins the lowermost strap portion at its outer end and extends in an undulating pattern along the vertically extending section of the tip, and the strap then continues about an overhanging portion of the handle, for example via an uppermost strap portion to the skirt. This arrangement allows for an optimum length of the strap with a fairly small dimensioned handle.

In an embodiment, the undulating portion of the strap is embodied so that the portions thereof extend vertically instead of horizontally. For example, each portion of the undulating strap section extends generally parallel to a vertical section of the wing tip and over a major portion of the height thereof, e.g. so as to maximize the length of each vertically oriented strap portion.

In an embodiment, one or more breakable bridges connect the undulating section to the handle and break upon opening the closure assembly for the first time.

In an embodiment, one or more breakable bridges extend between parallel strap portions of an undulating strap section, e.g. so as to avoid undue sagging and the like. Upon opening the closure assembly for the first time these bridges easily break.

In an embodiment, an undulating portion of the strap is located within an open-ended slot defined by the periphery or contour of a wing-shaped handle of the cap. Preferably, the open ended slot is open towards the bottom side of the handle, but the slot could also open towards the tip end or towards the top side of the wing-shaped handle. Yet, the bottom oriented opening is preferred for reason of stability and transfer of forces by the user onto the cap.

In an embodiment, the wing-shaped handle has an open ended slot therein, that is open towards the bottom side of the handle and that is located between an inner handle portion directly integral with the skirt of the cap and an outer handle portion connected to the inner handle portion via an overhead portion of the handle. As preferred, the strap has a portion that is located within this open ended slot, e.g. an undulating strap section. For example, the second end of the strap connects to the handle at the top end of the open slot.

In embodiments, the cap is a quarter turn lift cap.

In embodiments, preferably with a snap-on type cap, e.g. a quarter turn opening snap-on type cap, the closure assembly comprises:

at least one first cam portion defining a cam surface, which cam surface is angled with respect to the main axis, which first cam portion is integrally formed on one of the lower edge of the skirt on the one hand and a portion, e.g. a flange portion, of the tamper-evident ring member or of the article on the other hand, and at least one second cam portion defining a cam follower surface adapted to interact with the cam surface of the first cam portion and which second cam portion is integrally formed on the other one of the lower edge of the skirt on the one hand and said portion, e.g. said flange portion, of the tamper-evident ring member or the article on the other hand, wherein—upon first time opening of the closure assembly by rotation of the cap relative to the article about a main axis—the first and second cam portions interact in order to cause axial lifting of the cap relative to the neck, e.g. so that the co-operating snap connector formations disengage.

In a preferred embodiment, the at least one first cam portion is part of the tamper-evident ring and the at least one second cam portion part of the skirt, e.g. at the lower edge thereof. In another embodiment, e.g. as discussed and illustrated herein with reference to the tenth aspect of the invention, the at least one first cam portion is not part of the cap but is part of the article, e.g. located on the neck, and the at least one second cam portion part of the skirt, e.g. at the lower edge thereof.

In a practically preferred embodiment, the cap is a quarter-turn opening snap-on type cap, so that rotating the cap over about a quarter turn causes sufficient lift to disengage, or assist in the disengagement of, any snap retention of the cap and/or break the breakable bridges. Depending on the design of the first cam portion and the second cam portion the cap may be rotatable about the neck for opening the closure in both directions, so clockwise and counter clockwise, e.g. over a quarter turn, or the design may be such that the cap is rotatable in just one direction, e.g. only clockwise.

In an embodiment, a pair of first cam portions is integrally formed at a top face of said ring member flange portion, at diametrically opposed locations, and a pair of second cam portions is integrally formed at the lower end of the skirt, at diametrically opposed locations.

In an embodiment, the first cam portion has an arched first cam surface with a centre raised above the flange portion and with a first and second ends where the arched first cam surface adjoins the top face of the flange portion.

In an embodiment, a breakable bridge is present at each end of the upwardly arched first cam surface.

In an embodiment, the second cam portion comprises an outwardly extending tab integrally formed at the lower end of the skirt and adapted to cooperate with the first cam surface, preferably the cap having two diametrically opposed tabs.

In an embodiment, the pair of wing-shaped handles extend in an imaginary vertical plane through the main axis of the neck, and the cam portions of the pair of first cam portions are located on diametrically opposed locations relative to said imaginary vertical plane.

In another embodiment, the pair of wing-shaped handles extend in an imaginary vertical plane through the main axis of the neck, and the cam portions of the pair of first cam portions are located on diametrically opposed locations to the neck and extend each transverse to said imaginary vertical plane.

For example, the neck is provided, axially spaced from a circumferential flange structure, with a series of snap ridge segments that are circumferentially spaced from one another, e.g. in combination with a circumferentially continuous snap ridge inside the skirt of the cap. For example, the cap can be replaced on the neck after first time opening, with the snap features then properly retaining the cap on the neck.

For example, the neck has a smooth, e.g. main cylindrical, exterior, at least in the region between any snap-on ridge and the mouth, preferably also between any snap-on ridge on the circumferential flange structure. Such a smooth design is, for example, advantageous if the neck is designed to be placed between the lips of a consumer for drinking a product out of a container provided with the closure assembly.

In an embodiment the skirt of the cap on the one hand and a circumferential flange structure of the article, e.g. a flange structure extend around the neck, have co-operating snap connector formations to provide the snap-on functionality of the cap.

For example, a peripheral rim portion extending around the perimeter of a circumferential flange structure of the article on the one hand and the exterior side of the skirt of the cap having co-operating snap connector formations, e.g. the peripheral rim portion having a recess or window and the skirt being provided with a latching tab that is snapped into said recess or window in the closed position of the cap, so upon removal of the cap the tab becomes unsnapped and released from the window or recess.

In a practical embodiment, the circumferential flange structure of the article, e.g. a peripheral rim thereof, is provided with at least one upwardly protruding latch wall portion having a window or recess therein and the exterior side of the skirt being provided with a latching tab that is snapped into said window or recess in the closed position of the cap.

For example, the article, e.g. a flange structure of the article, is provided with two latch members, e.g. two latch wall portions, at diametrically opposed locations relative to the neck of the article, e.g. each arranged at the perimeter of a circumferential flange that extends around the neck, and the cap is provided with two mating latch members, e.g. two latch tabs, at diametrically opposed locations, which latch members on the article and on the cap are configured to provide a releasable snap connection between the cap and the article, e.g. wherein the latch tabs on the cap are each configured to be received or are received in a corresponding recess or window in a latch wall portion of the article allowing to snap the cap onto the article, e.g. in said axial securing motion of the cap, In an embodiment wherein the skirt of the cap on the one hand and a circumferential flange structure of the article, e.g. a flange structure extend around the neck, have co-operating snap connector formations to provide the snap-on functionality of the cap, it is preferred that any mechanical interconnection features between the neck and the interior of the skirt are absent, e.g. there is no provision of snap features here nor of a screw thread, bayonet connection, etc. Preferably, the neck is smooth and substantially cylindrical.

In a practically preferred embodiment, a pair of first cam portions, preferably a single pair only, is integrally formed at the top face of the ring member flange portion, at diametrically opposed locations, wherein a pair of second cam portions is integrally formed at the lower end of the skirt, at diametrically opposed locations. In a practical embodiment, the first cam portions extend in part above the height of the protective rim, so that their presence is well visible enhancing the understanding by a user of the closure assembly.

In an embodiment, the first cam portion has an arched first cam surface with a centre raised higher than the top face of the flange portion and with a first and second ends where the arched first cam surface adjoins the top face of the flange portion. Hereby the arched first cam surface provides two oppositely inclined slopes allowing for opening of the closure by rotation of the cap in either direction about the neck, so clockwise and counter clockwise, when the second cam portion has a correspondingly shaped, e.g. arched, cam follower surface. In an embodiment hereof, a breakable bridge is present at each of said first and second ends of the upwardly arched first cam surface. The arched first cam surface may have a flattened centre, and/or the arc need not have a constant radius.

In a practical embodiment, the second cam portion is at least in part formed by a complementary section, e.g. arched, curved, polygonal, of the lower end of the skirt of the cap, e.g. an upwardly arched section of the lower end that is located just above the arched first cam surface with a centre raised relative to the flange portion of the ring member, wherein the breakable bridges initially maintain said arrangement.

In another embodiment, the at least one first cam portion defines a cam surface that is functional only when rotating the cap in clockwise direction, e.g. with the first came portion also defining a stop face, e.g. vertical or nearly vertical, for the cap that cooperates with a stop face on the skirt of the cap when attempting to rotate the cap in counter clockwise direction.

In a practical embodiment, e.g. in combination with the feature of the preceding paragraph, the cap comprises an outwardly extending tab integrally formed at the lower end of the skirt and adapted to cooperate with the first cam surface, preferably the cap having two diametrically opposed tabs. Therefore, the cap may have a lower skirt edge with two upwardly arched sections at diametrically opposed locations, and in addition a pair of outwardly extending tabs, each tab located at the section of the lower skirt edge between the upwardly arched sections.

In a practically preferred embodiment, there are six hook members and corresponding hook member passages. For example, the neck of such assembly has an external diameter between 8 and 13 millimetres.

In an embodiment, the cap has an annular top wall having an inner perimeter and an outer perimeter, wherein the downward depending skirt is integral with the outer perimeter, and wherein a hollow pin portion depends from the inner perimeter, the hollow pin portion having a circumferential face extending along a length thereof and a closed pin bottom, e.g. the hollow pin portion being open at a top thereof, wherein the circumferential face of the hollow pin portion and the article have at least one pair of cooperating sealing surfaces such that hollow pin portion, in the closed position cap, closes the product passage.

In an embodiment, at least one handle, preferably each handle when present, has a panel portion and at least one reinforcing top protrusion that is integral with the panel portion along at least a part of the top side of the handle, e.g. only along the top side of the wing shaped handle. For example, the handle(s) is/are embodied in this respect according to WO2018/194454. This at least one top protrusion reinforces the handle, e.g. allowing for the panel portion to be relatively thin and thereby saving plastic material. Each top protrusion protrudes away from the face of the panel portion, that is for example vertical or near vertical, in a direction substantially in or opposed to the opening direction of the cap.

In an embodiment, the handle has two diverging top protrusions that extend inclined upward from the panel portion at the top side and which diverge from one another defining a Y-shaped vertical cross-section of the wing shaped handle together with the panel portion. In alternative embodiments, each handle could have one top protrusion, e.g. defining an inverted L-shaped cross-section together with the panel portion. Alternatively, in yet another embodiment, each handle could have two oppositely directed top protrusions defining with the panel portion a T-shaped cross-section of the handle.

In an embodiment, the second end of the strap adjoins the outer end of a reinforcing protrusion that is integral with the panel portion of the handle e.g. along at least a part of the top side of the handle.

In embodiments, the closure assembly further comprises an interference fit plug, e.g. allowing to obtain a closure assembly as described in WO2017/052364 and to allow for methods disclosed in said prior art document.

In an embodiment, the plug is configured to be releasably mounted over the top end of the neck in an interference fit and to hermetically seal the product passage. The plug, preferably, has a molded plug body of plastic material.

For example, the plug has a top portion and a downward depending outer annular wall below the top portion, which annular wall is adapted to be fitted over a top section of the exterior of the neck.

For example, the plug has a downward depending inner annular wall, possibly concentric with the outer annular wall when present. This inner annular wall is configured to be introduced into the neck and to seal on the interior side of the neck.

In an embodiment, the cap and the plug are provided with cooperating snap-fit formations, e.g. one or more slits or grooves in the skirt of the cap and mating formations, e.g. a retention rib, on the plug.

Preferably, in combination with the presence of a plug, the neck of the article has a snap connector formation to provide a snap-on functionality for the cap. This formation is arranged on the neck, for example below the zone where an outer annular wall of the plug sealingly engages the exterior of the neck, as is a preferred embodiment of the plug.

Preferably, the cap and the plug are embodied such that, with the plug placed over the top end of the neck, the cap can be lowered, e.g. vertically pressed, over the plug in an manner causing the cap to be snapped onto the neck and causing the plug to couple to the cap by snap-fit engagement. The cooperating snap fit formations coupling the plug to the cap are such that upon manually opening of the cap the plug remains coupled to the cap and is entrained with the cap so as to open the product passage, e.g. allowing dispensing of a flowable product from a filled pouch provided with the article.

This closure assembly having an additional interference fit plug may, for example, be used in the aseptic filling of pouches provided with the article, cap, and plug as described herein.

It will be appreciated that the closure assembly of the first aspect of the invention may comprise one or more features discussed herein with reference to any other aspect of the invention, e.g. as illustrated in the appended figures.

The first aspect of the present invention also relates to a method for manufacturing a pre-assembled closure assembly as described herein for later mounting thereof as a unit on a container, the method comprising:

making, e.g. moulding, e.g. injection moulding, the article of plastic material, making, e.g. moulding, e.g. injection moulding, the cap provided with an integrated temper-evident ring member and the integrated strap, securing the cap including the integrated tamper-evident ring member and integrated strap onto the neck of the article such that the cap seals the product passage.

The first aspect of the present invention also relates to a method for manufacturing and filling a container, comprising the steps of:

providing a container having the article thereon without the cap provided with the integrated tamper-evident ring member and the integrated strap, filling the container e.g. via the product passage in the article, securing the cap provided with the integrated tamper-evident ring member and integrated strap onto the neck of the article such that the cap seals the product passage.

The first aspect of the present invention also relates to a method for manufacturing and filling a container, said method comprising the steps of:

providing a container having an article mounting location, e.g. an opening, e.g. an opening in a top edge or seam of a pouch packing, adapted to mount the article with the cap and integrated tamper-evident ring member and integrated strap of the type discussed herein on the container, filling the container, e.g. via the opening, mounting an assembly of the article and cap including the integrated tamper-evident ring member and integrated strap as a unit on the container at the article mounting location.

A second aspect of the invention relates to a closure assembly comprising an article and a cap, said cap including an integrated tamper-evident ring member and an integrated strap, wherein:

the article forms a tubular neck around a product passage in said article, said neck forming a mouth at a top end of said product passage, the cap including the integrated tamper-evident ring member and the integrated strap is made, e.g. moulded, as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein in the closed position the cap is positioned on the neck and thereby seals the product passage, wherein in the open position the cap is removed from the neck, thereby leaving the product passage open, wherein the cap comprises a top wall structure and a downward depending skirt having an interior side, exterior side, and a lower edge remote from the top wall structure, wherein the tamper-evident ring member is integrally formed to the lower edge of the skirt of the cap, said tamper-evident ring member comprising a base portion, e.g. an annular base portion, which base portion is connected via one or more breakable bridges to the skirt, wherein the strap is integral at a first end thereof to the base portion of the tamper-evident ring member and at a second end thereof integral to another portion of the cap, e.g. to the skirt or to a wing-shaped handle of the cap when present, wherein the strap is adapted to remain connected to both the base portion of the tamper-evident ring member and said other portion of the cap upon removal of the cap from the neck of the article by the user, wherein the base portion of the tamper-evident ring member comprises one or more integrally formed hook members, and wherein the article comprises one or more hook member passages, each hook member passage being adapted to receive a hook member when the cap is secured on the neck, for example wherein the article is provided with a flange portion on the neck of the article and wherein a hook portion of each hook member engages, e.g. snaps, underneath a bottom face of said annular flange portion on the neck of the article.

The closure assembly of the second aspect of the invention provides for said at least one hook member to have a dual functionality, which on the one hand comprises the role in retaining the base portion of the tamper-evident ring member on the article as the cap is removed and on the other hand comprises the role as anchor for the first end of the strap.

In an embodiment, at least one hook member is arranged vertically below the first end of the strap. This has the effect that a pulling force exerted on the strap will be passed via a short force path to said hook member vertically below the first end of the strap, and thus to the article. Therefore, relative limited plastic material is required to absorb the pulling force on the strap.

In an embodiment, as preferred, the base portion is an annular base portion. In another embodiment, for example, the cap comprises two semi-circular base portions arranged around the neck when the cap is secured on the article.

In an embodiment, the base portion of the tamper-evident ring member comprises an annular ring member flange portion that has a top face, a bottom face, an inner face, and an outer face, wherein multiple hook members are integrally formed to the bottom of the ring member flange portion, the hook members being distributed in a circumferential direction of the ring member flange portion, wherein each hook member comprises a leg having an upper end integral with the ring member flange portion and protruding downward from the ring member flange portion, wherein each hook member comprises a hook portion at a lower free end of the leg, wherein the article further comprises a circumferential flange structure which comprises an annular flange portion that is integrally formed to the neck and extends around the neck, which flange portion has a top face, a bottom face, and a periphery, wherein the annular flange portion on the neck of the article is provided with multiple hook member passages that each extend between the top face and the bottom face through said annular flange portion, each hook member passage being adapted to receive a hook member when the cap with the integrated tamper-evident ring member is secured on the neck, wherein the hook portion of each hook member engages, e.g.

snaps, underneath the bottom face of the annular flange portion on the neck of the article, and wherein the closure assembly is embodied such that upon first time opening of the closure assembly by removal of the cap by a user the one or more breakable bridges break and the annular ring member flange portion is retained by means of the hook members.

In an embodiment, the strap, prior to first time removal of the cap by the user, is located in a vertical plane, and at least one of said hook members is located in said same vertical plane and below the first end of the strap. This arrangement provides for a strong connection, with a short force path, of the first end of the strap to the article via said hook member that lies in said common vertical plane.

In an embodiment, the cap comprises at least one wing-shaped handle extending outwardly from the skirt of the cap and being configured to be engaged by a user for removal of the cap, said handle having a panel portion, wherein the strap, prior to first time removal of the cap by the user, is located in a plane that is in common with said panel portion of the respective wing-shaped handle, e.g. a vertical plane. For example, the strap extends from a first end thereof that is integral with the base portion along a bottom side of the wing-shaped handle, e.g. towards or further around a tip end of the wing-shaped handle.

In embodiments, the panel portion has a thickness less than 2 millimetres, e.g. between 0.5 and 1 millimetres. For example, a reinforcing top protrusion is present along the top side of the panel portion, with the tip and bottom side of the panel portion each being devoid of a reinforcing protrusion.

In an embodiment, the integrally formed, e.g. moulded, strap is integral at a first end thereof to the annular base portion of the tamper-evident ring member and at a second end thereof integral to the skirt of the cap. The strap is adapted to remain connected to both the annular base portion of the tamper-evident ring member and the skirt of the cap upon removal of the cap from the neck of the article by the user.

In an embodiment, the cap comprises a pair of wing-shaped handles, e.g. just one pair of wing-shaped handles, said pair of wing-shaped handles extending outwardly from the skirt of the cap in mutually opposite directions and being configured to be engaged by a user for removal of the cap.

In an embodiment, the cap comprises one or more wing-shaped handles, each extending outwardly from the skirt of the cap and being configured to be engaged by a user for removal of the cap, each handle having a panel portion, and each handle having, seen in side view thereon, an outer periphery comprising a bottom side, a top side, and a tip remote from the skirt, where said bottom side and top side adjoin at the tip.

In an embodiment, the strap is integral at a first end thereof to the annular base portion of the tamper-evident ring member and at a second end thereof integral to one wing-shaped handle of the cap, wherein the strap is adapted to remain connected to both the annular base portion of the tamper-evident ring member and the respective wing-shaped handle upon removal of the cap from the neck of the article by the user.

In an embodiment, the strap, prior to first time removal of the cap by the user, extends outward from the annular base portion of the tamper-evident ring member towards a tip of the respective wing-shaped handle, e.g. the second end of the strap being inward of the tip of the wing-shaped handle.

In an embodiment, the strap extends outward from the annular portion of the tamper-evident ring member towards the tip of the respective wing-shaped handle along the bottom side of the wing-shaped handle, further about the tip of the wing-shaped handle, and along a portion of the top side of the wing-shaped handle to the second end of the strap, e.g. the second end being located at a distance outward of the skirt.

In an embodiment, the closure assembly comprises:

at least one upwardly directed first cam portion defining a cam surface, which first cam portion is integrally formed on the base portion of the tamper-evident ring member, and at least one downwardly directed second cam portion defining a cam follower surface adapted to interact with the cam surface of the first cam portion, which second cam portion is integrally formed on the lower edge of the skirt of the cap, wherein—upon first time opening of the closure assembly by rotation of the cap relative to the article about the main axis—the first and second cam portions interact in order to cause an axial lifting of the cap relative to the neck.

In an embodiment, the strap is integral at a first end thereof to the upwardly directed first cam portion of the tamper-evident ring member and at a second end thereof integral to another portion of the cap, e.g. to the skirt of the cap or to a wing-shaped handle of the cap, wherein the strap is adapted to remain connected to both the upwardly directed first cam portion of the tamper-evident ring member and said other portion of the cap upon removal of the cap from the neck of the article by the user.

It will be appreciated that the closure assembly of the second aspect of the invention may comprise one or more features discussed herein with reference to any other aspect of the invention, e.g. according to the first aspect of the invention, e.g. as illustrated in the appended figures, e.g. as disclosed in one or more of the subclaims.

A third aspect of the invention relates to a closure assembly comprising an article and a cap, said cap including an integrated tamper-evident ring member and an integrated strap, wherein:

the article forms a tubular neck around a product passage in said article, said neck forming a mouth at a top end of said product passage, the cap including the integrated tamper-evident ring member and the integrated strap is made, e.g. moulded, as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein in the closed position the cap is positioned on the neck and thereby seals the product passage, wherein in the open position the cap is removed from the neck, thereby leaving the product passage open, wherein the cap comprises a top wall structure and a downward depending skirt having an interior side, exterior side, and a lower edge remote from the top wall structure, wherein the tamper-evident ring member is integrally formed to the lower edge of the skirt of the cap, said tamper-evident ring member comprising a base portion, e.g. an annular base portion, which base portion is connected via one or more breakable bridges to the skirt, wherein the base portion is configured to remain connected to the article upon removal of the cap from the neck of the article by the user, wherein the cap, preferably, is a snap-on type cap providing in use of the closure assembly a snap-on functionality so that the cap can be replaced on the neck after first time opening, wherein the article and the cap are provided with cooperating snap connector formations to provide the snap-on functionality, wherein the closure assembly comprises:

at least one upwardly directed first cam portion defining a cam surface, which first cam portion is integrally formed on the base portion of the tamper-evident ring member, and at least one downwardly directed second cam portion defining a cam follower surface adapted to interact with the cam surface of the first cam portion, which second cam portion is integrally formed on the lower edge of the skirt, wherein—upon first time opening of the closure assembly by rotation of the cap relative to the article about the main axis—the first and second cam portions interact in order to cause axial lifting of the cap relative to the neck, e.g. so that the co-operating snap connector formations disengage, wherein the strap is integral at a first end thereof to the upwardly directed first cam portion of the tamper-evident ring member and at a second end thereof integral to another portion of the cap, wherein the strap is adapted to remain connected to both the upwardly directed first cam portion of the tamper-evident ring member and said other portion of the cap upon removal of the cap from the neck of the article by the user.

The closure assembly of the third aspect of the invention provides for the upwardly directed first cam portion to have a dual functionality, which on the one hand comprises the role in the cam mechanism that causes axial lifting of the cap upon opening of the cap and on the other hand comprises the role as anchoring portion for the first end of the strap. As the first cam portion needs to be relatively robust and sizable to perform the first mentioned role, the portion can also take on the second mentioned role and provide for a robust anchoring of the first end of the strap.

In an embodiment, the base portion of the tamper-evident ring member comprises one or more integrally formed hook members, wherein the article comprises one or more hook member passages, each hook member passage being adapted to receive a hook member when the cap is secured on the neck, for example wherein the article is provided with a flange portion on the neck of the article and wherein a hook portion of each hook member engages, e.g. snaps, underneath a bottom face of said annular flange portion on the neck of the article.

It will be appreciated that the closure assembly of the third aspect of the invention may comprise one or more features discussed herein with reference to any other aspect of the invention, e.g. according to the first and/or the second aspect of the invention, e.g. as illustrated in the appended figures, e.g. as disclosed in one or more of the subclaims.

A fourth aspect of the invention relates to a closure assembly comprising an article and a quarter turn lift cap, said cap including an integrated tamper-evident ring member and an integrated strap, wherein:

the article forms a tubular neck around a product passage in said article, said neck forming a mouth at a top end of said product passage, the quarter turn lift cap including the integrated tamper-evident ring member and the integrated strap is made, e.g. moulded, as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein in the closed position the cap is positioned on the neck and thereby seals the product passage, wherein in the open position the cap is removed from the neck, thereby leaving the product passage open, wherein the cap comprises a top wall structure and a downward depending skirt having an interior side, exterior side, and a lower edge remote from the top wall structure, wherein the tamper-evident ring member is integrally formed to the lower edge of the skirt of the cap, said tamper-evident ring member comprising a base portion, e.g. an annular base portion, which is connected via one or more breakable bridges to the skirt, wherein the cap, preferably, is a snap-on type cap providing in use of the closure assembly a snap-on functionality, wherein the article and the cap are provided with cooperating snap connector formations to provide the snap-on functionality, wherein the closure assembly comprises:

at least one first cam portion, e.g. an upwardly directed first cam portion, defining a cam surface, which cam surface is angled with respect to a main axis, which first cam portion is integrally formed on the tamper-evident ring member, and at least one second cam portion, e.g. a downwardly directed second cam portion, defining a cam follower surface adapted to interact with the cam surface of the first cam portion and which second cam portion is integrally formed on the lower edge of the skirt, wherein—upon first time opening of the closure assembly by rotation of the cap relative to the article over at most a quarter turn about the main axis—the first and second cam portions interact in order to cause axial lifting of the cap relative to the neck, e.g. so that the co-operating snap connector formations disengage, wherein the strap is integral at a first end thereof to the tamper-evident ring member and at a second end thereof integral to another portion of the cap, wherein the strap is adapted to remain connected to both the tamper-evident ring member and said other portion of the cap upon said first time removal of the cap from the neck of the article by the user.

The closure assembly of the fourth aspect of the invention provides for convenient use as the cap can easily be removed by rotation over at most a quarter turn, with the cam mechanism causing the lift of the cap. This arrangement allows for a limited length of the strap, e.g. allowing for its combination with a wing-shaped handle as discussed herein.

In an embodiment, the first end of the strap is integral to an upwardly directed first cam portion, e.g. said first cam portion being raised above a flange portion of the annular base portion of the tamper-evident ring member.

In an embodiment, the skirt of the cap on the one hand and a circumferential flange structure of the article, e.g. a flange structure extend around the neck, have co-operating snap connector formations to provide the snap-on functionality of the cap.

For example, a peripheral rim portion extending around the perimeter of a circumferential flange structure of the article on the one hand and the exterior side of the skirt of the cap having co-operating snap connector formations, e.g. the peripheral rim portion having a recess or window and the skirt being provided with a latching tab that is snapped into said recess or window in the closed position of the cap, so upon removal of the cap the tab becomes unsnapped and released from the window or recess.

In a practical embodiment a flange structure of the article, e.g. a peripheral rim thereof, is provided with at least one upwardly protruding latch wall portion having a window or recess therein and the exterior side of the skirt being provided with a latching tab that is snapped into said window or recess in the closed position of the cap.

It will be appreciated that the closure assembly of the fourth aspect of the invention may comprise one or more features discussed herein with reference to any other aspect of the invention, e.g. according to the first and/or the second and/or the third aspect of the invention, e.g. as illustrated in the appended figures, e.g. as disclosed in one or more of the subclaims.

A fifth aspect of the invention relates to a closure assembly comprising an article and a cap, said cap including an integrated tamper-evident ring member and, preferably, an integrated strap, wherein:

the article forms a tubular neck around a product passage in said article, said neck forming a mouth at a top end of said product passage, the cap including the integrated tamper-evident ring member and the integrated strap is made, e.g. moulded, as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein in the closed position the cap is positioned on the neck and thereby seals the product passage, wherein in the open position the cap is removed from the neck, thereby leaving the product passage open, wherein the cap comprises a top wall structure and a downward depending skirt having an interior side, exterior side, and a lower edge remote from the top wall structure, wherein the tamper-evident ring member is integrally formed to the lower edge of the skirt of the cap, said tamper-evident ring member comprising a base portion, preferably an annular base portion, which base portion is connected via one or more breakable bridges to the skirt, wherein the base portion and the article are configured to establish or have established a permanent snap-joint, e.g. obtainable or obtained by an axial securing motion of the cap relative to the neck of the article, so that the tamper-evident ring member remains connected to the article upon removal of the cap from the neck of the article by the user, wherein the article, e.g. a flange structure of the article, is provided with two latch members, e.g. two latch wall portions, at diametrically opposed locations relative to the neck of the article, e.g. each arranged at the perimeter of a circumferential flange that extends around the neck, and wherein the cap is provided with two mating latch members, e.g. two latch tabs, at diametrically opposed locations, which latch members on the article and on the cap are configured to provide a releasable snap connection between the cap and the article, e.g. wherein the latch tabs on the cap are each configured to be received or are received in a corresponding recess or window in a latch wall portion of the article allowing to snap the cap onto the article, e.g. in said axial securing motion of the cap, wherein, preferably, a strap is integral at a first end thereof to the base portion of the tamper-evident ring member and at a second end thereof integral to another portion of the cap, e.g. to a wing-shaped handle of the cap, wherein the strap is adapted to remain connected to both the base portion of the tamper-evident ring member and the respective other portion of the cap upon removal of the cap from the neck of the article by the user.

In the assembly of the fifth aspect of the invention, the snap facility is located generally to the outside of the skirt of the cap and therefore there is no need for any such snap-facility between the neck of the cap and the skirt. This allows for, in embodiments, a smooth, e.g. cylindrical, embodiment of the neck, e.g. advantageous if it is envisaged that a user will drink directly from the assembly and put the neck between the lips. Also such an externally arranged snap facility may be embodied to provide a more prominent snap, e.g. visible and/or audible and/or tactile, of the cap onto the article compared to a snap between the neck and the interior side of the skirt. The strap, when present, keeps the cap linked to the article.

In an embodiment, the closure assembly further comprises:

at least one first cam portion defining a cam surface, which first cam portion is integrally formed on the base portion, e.g. a flange portion thereof, of the tamper-evident ring member, and at least one second cam portion defining a cam follower surface adapted to interact with the cam surface of the first cam portion, which second cam portion is integrally formed on the lower edge of the skirt, wherein—upon first time opening of the closure assembly by rotation of the cap relative to the article about a main axis of the neck—the first and second cam portions interact in order to cause axial lifting of the cap relative to the neck.

In an embodiment, the two outwardly extending tabs are arranged and configured to cooperate with the first cam portions upon opening the cap.

In an embodiment, the first cam portion is configured as an upwardly protruding first cam portion, and the strap is integral at the first end thereof to the upwardly directed first cam portion of the tamper-evident ring member.

In an embodiment, the cap has two downwardly protruding second cam portions, at diametrically opposed locations, wherein each mating latch member is provide externally on a respective downwardly protruding second cam portion. Herein the base portion has two cooperating upwardly directed first cam portions, e.g. a strap being integral at the first end thereof to one of said first cam portions.

In an embodiment, the cap is a quarter turn lift cap as described herein.

In an embodiment, the cap has at least one wing-shaped handle as described herein.

In an embodiment, the base portion is provided with hook members as described herein.

In an embodiment, the article has a circumferential wall which is positioned around a bottom region of the neck and spaced from the neck, thereby forming an inner space which is open from above and adapted to receive the annular base portion of the tamper-evident ring member of the cap therein. For example, the circumferential wall is erected on a circumferential flange that extends around the neck. Herein, the circumferential wall forms the two latch members, e.g. two latch wall portions, at diametrically opposed locations relative to the neck of the article. For example, the circumferential wall has two opposed latch windows, each configured to receive a latching tab of the cap therein. Further optional details hereof are discussed herein, for example, with reference to the eight and/or ninth aspect of the invention.

In an embodiment, the annular base portion is provided with at least one snap portion and the circumferential wall is provided with a complementary snap formation, e.g. with a window through the circumferential wall from a wall outer face to a wall inner face, such that the snap portion snaps onto or into the complementary snap formation, e.g. into the window, when the cap is placed on the neck and the annular base portion is at least partially inserted into the inner space, which snap connection is such that the base portion remains connected to the article upon removal of the cap from the neck by the user. Further optional details hereof are discussed herein, for example, with reference to the eight and/or ninth aspect of the invention.

It will be appreciated that the closure assembly of the fifth aspect of the invention may comprise one or more features discussed herein with reference to any other aspect of the invention, e.g. according to the first and/or the second and/or the third and/or fourth aspect of the invention, e.g. as illustrated in the appended figures, e.g. as disclosed in one or more of the subclaims.

A sixth aspect of the present invention relates to a closure assembly comprising an article and a cap, said cap including an integrated tamper-evident ring member and an integrated strap, wherein:

the article forms a tubular neck around a product passage in said article, said neck forming a mouth at a top end of said product passage, the cap including the integrated tamper-evident ring member and the integrated strap is made, e.g. moulded, as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein in the closed position the cap is positioned on the neck and thereby seals the product passage, wherein in the open position the cap is removed from the neck, thereby leaving the product passage open, wherein the cap comprises a top wall structure and a downward depending skirt having an interior side, exterior side, and a lower edge remote from the top wall structure, wherein the tamper-evident ring member is integrally formed to the lower edge of the skirt of the cap, said tamper-evident ring member comprising a base portion, preferably an annular base portion, which base portion is connected via one or more breakable bridges to the skirt, wherein the base portion is configured to remain connected to the article upon removal of the cap from the neck of the article by the user, wherein the cap comprises at least one handle having a panel portion, e.g. one pair of handles, said handle extending outwardly from the skirt of the cap and being configured to be engaged by a user for removal of the cap, wherein each handle has, seen in side view thereon, an outer periphery comprising a bottom side, a top side, and a tip remote from the skirt, where said bottom side and top side adjoin at the tip, wherein the strap is integral at a first end thereof to the base portion of the tamper-evident ring member and at a second end thereof integral to the handle, wherein the strap is adapted to remain connected to both the base portion of the tamper-evident ring member and the respective handle upon removal of the cap from the neck of the article by the user, and wherein, the strap, prior to first time removal of the cap by the user, is located in a plane, e.g. in a vertical plane, that is in common with the panel portion of the respective handle.

In an embodiment, the strap, prior to first time removal of the cap by the user, extends outward from the base portion of the tamper-evident ring member towards the tip of the respective handle, e.g. the second end of the strap being inward of the tip of the handle.

In an embodiment, the strap extends outward from the base portion of the tamper-evident ring member towards the tip of the respective handle along the bottom side of the handle, further about the tip of the handle, and along a portion of the top side of the handle to the second end of the strap, e.g. the second end being located at a distance outward of the skirt. In an embodiment hereof, the strap extends along a bottom side of a panel portion of the handle, about the tip of the panel portion of the handle, and then along an outer section of the top side of the panel portion, wherein the second end of the strap is located spaced a distance from the skirt of the cap. Optionally, herein, the handle is further has at least one reinforcing top protrusion that is integral with the panel portion over the length between the skirt and the second end of the strap, so that the second end of the strap adjoins the outer end of the reinforcing top protrusion. This at least one top protrusion reinforces the handle, e.g. allowing for the panel portion to be relatively thin and thereby saving plastic material. Each top protrusion protrudes away from the face of the panel portion, that is for example vertical or near vertical, in a direction substantially in or opposed to the opening direction of the cap.

For example, the handle has two diverging top protrusions that extend inclined upward from the panel portion at the top side and which diverge from one another defining a Y-shaped vertical cross-section of the wing shaped handle together with the panel portion. In alternative embodiments, each handle could have one top protrusion, e.g. defining an inverted L-shaped cross-section together with the panel portion. Or, in yet another embodiment, each handle could have two opposed directed top protrusions defining with the panel portion a T-shaped cross-section of the handle.

It will be appreciated that the closure assembly of the sixth aspect of the invention may comprise one or more features discussed herein with reference to any other aspect of the invention, e.g. according to the first and/or the second and/or the third and/or fourth and/or fifth aspect of the invention, e.g. as illustrated in the appended figures, e.g. as disclosed in one or more of the subclaims.

A seventh aspect of the invention relates to a closure assembly comprising an article and a cap, said cap including an integrated tamper-evident ring member and an integrated strap, wherein:

the article forms a tubular neck around a product passage in said article, said neck forming a mouth at a top end of said product passage, the cap including the integrated tamper-evident ring member and the integrated strap is made, e.g. moulded, as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein in the closed position the cap is positioned on the neck and thereby seals the product passage, wherein in the open position the cap is removed from the neck, thereby leaving the product passage open, wherein the cap comprises a top wall structure and a downward depending skirt having an interior side, exterior side, and a lower edge remote from the top wall structure, wherein the tamper-evident ring member is integrally formed to the lower edge of the skirt of the cap, said tamper-evident ring member comprising a base portion, preferably an annular base portion, which base portion is connected via one or more breakable bridges to the skirt, wherein the base portion is configured to remain connected to the article upon removal of the cap from the neck of the article by the user, wherein the cap comprises at least one handle having a panel portion, e.g. one pair of handles, said handle extending outwardly from the skirt of the cap and being configured to be engaged by a user for removal of the cap, wherein each handle has, seen in side view thereon, an outer periphery comprising a bottom side, a top side, and a tip remote from the skirt, wherein the strap is integral at a first end thereof to the base portion of the tamper-evident ring member and at a second end thereof integral to the handle or another portion of the cap, wherein the strap is adapted to remain connected to both the base portion of the tamper-evident ring member and the respective handle or other portion of the cap upon removal of the cap from the neck of the article by the user, wherein the strap comprises an undulating strap section having strap portions in an undulating pattern. Herein, successive strap portions are integral at an apex of the undulating strap section, preferably successive strap portions being parallel to one another. The undulating strap section allows for an increased length of the strap compared to a design wherein the strap lacks an undulation portion and follows, at least a part of, the outer periphery of the handle. For example, an undulating strap section is provided in combination with a relatively short handle seen in lateral direction. For example, the associated handle has a lateral extension of between 5 and 15 millimeters relative to the skirt of the cap.

In an embodiment the strap portions of the undulating strap section are arranged substantially horizontal. For example between five and fifteen, e.g. ten strap portions make up the section with horizontal strap portions therein.

In an embodiment, the undulating strap section is adjoined to the handle via one or more breakable bridges, e.g. a breakable bridge extending from an apex thereof to the wing-shaped handle. This counters any undue sagging or the like in the undulating section.

In an embodiment, the handle has, seen in side view thereon, an outer periphery comprising a bottom side, a top side, and a tip remote from the skirt. Herein, the bottom side and the top side are vertically spaced apart from one another. The tip extends over a height between a top end thereof adjoining the top side of the periphery and a lower end thereof adjoining the bottom side of the periphery. In an embodiment, the undulating section is arranged outward of and along the tip, e.g. a vertical section thereof. In an embodiment of this design, the top side extends further outward than the vertically extending section of the tip and the tip further comprises an outward section joining the top end of the vertically extending section to the outermost end of the top side, so as to form an overhanging portion of the wing-shaped handle.

In an embodiment, the undulating strap section, e.g. with horizontal or vertical strap portions, is arranged below an overhanging portion of the handle, wherein the undulating strap section is outwardly adjacent a vertical section of the tip of the handle. This provides some protection of this strap section against undue interference, e.g. when handling the cap during assembly of the closure assembly.

In an embodiment, a lowermost strap portion extends from the base portion outward, along the bottom side of the wing-shaped handle and then even further outward. The undulating strap section adjoins the lowermost strap portion at its outer end and extends in an undulating pattern along the vertically extending section of the tip, and the strap then continues about an overhanging portion of the handle, for example via an uppermost strap portion to the skirt. This arrangement allows for an optimum length of the strap with a fairly small dimensioned handle.

In an embodiment, the undulating portion of the strap is embodied so that the portions thereof extend vertically instead of horizontally. For example, each portion of the undulating strap section extends generally parallel to a vertical section of the wing tip and over a major portion of the height thereof, e.g. so as to maximize the length of each vertically oriented strap portion.

In an embodiment, one or more breakable bridges connect the undulating section to the handle and break upon opening the closure assembly for the first time.

In an embodiment, one or more breakable bridges extend between parallel strap portions of an undulating strap section, e.g. so as to avoid undue sagging and the like. Upon opening the closure assembly for the first time these bridges easily break.

In an embodiment, an undulating portion of the strap is located within an open ended slot defined by the periphery or contour of a wing-shaped handle of the cap. Preferably, the open ended slot is open towards the bottom side of the handle, but the slot could also open towards the tip end or towards the top side of the handle. Yet, the bottom oriented opening is preferred for reason of stability and transfer of forces by the user onto the cap.

In an embodiment, the handle has an open ended slot therein, that is open towards the bottom side of the handle and that is located between an inner handle portion directly integral with the skirt of the cap and an outer handle portion connected to the inner handle portion via an overhead portion of the handle. As preferred, the strap has a portion that is located within this open ended slot, e.g. an undulating strap section. For example, the second end of the strap connects to the handle at the top end of the open slot.

It will be appreciated that the closure assembly of the seventh aspect of the invention may comprise one or more features discussed herein with reference to any other aspect of the invention, e.g. according to the first and/or the second and/or the third and/or fourth and/or fifth and/or sixth aspect of the invention, e.g. as illustrated in the appended figures, e.g. as disclosed in one or more of the subclaims.

An eight aspect of the invention relates to a closure assembly comprising an article and a cap, said cap including an integrated tamper-evident ring member and an integrated strap, wherein:

the article forms a tubular neck around a product passage in said article, said neck forming a mouth at a top end of said product passage, the cap including the integrated tamper-evident ring member and the integrated strap is made, e.g. moulded, as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein in the closed position the cap is positioned on the neck and thereby seals the product passage, wherein in the open position the cap is removed from the neck, thereby leaving the product passage open, wherein the cap comprises a top wall structure and a downward depending skirt having an interior side, exterior side, and a lower edge remote from the top wall structure, wherein the tamper-evident ring member is integrally formed to the lower edge of the skirt of the cap, said tamper-evident ring member comprising an annular base portion, which base portion is connected via one or more breakable bridges to the skirt, wherein the base portion is configured to remain connected to the article upon removal of the cap from the neck of the article by the user, wherein the article has a circumferential wall which is positioned around a bottom region of the neck and spaced from the neck, thereby forming an inner space which is open from above and adapted to receive the annular base portion of the tamper-evident ring member of the cap therein, wherein, for example, the circumferential wall is erected on a circumferential flange that extends around the neck, wherein the annular base portion is provided with at least one snap portion and wherein the circumferential wall is provided with a complementary snap formation, e.g. with a window through the circumferential wall from a wall outer face to a wall inner face, such that the snap portion snaps onto or into the complementary snap formation, e.g. into the window, when the cap is placed on the neck and the annular base portion is at least partially inserted into the inner space, which snap connection is such that the base portion remains connected to the article upon removal of the cap from the neck by the user, wherein a top region of the annular base portion protrudes upwardly above the circumferential wall, and wherein the strap adjoins at a first end thereof this upwardly protruding top region, and wherein the strap adjoins at a second end thereof the another portion of the cap, wherein the strap is adapted to remain connected upon removal of the cap from the neck of the article by the user.

In an embodiment, the annular base portion is provided with at least one snap portion and the circumferential wall is provided with a window through the circumferential wall from a wall outer face to a wall inner face, such that the snap portion snaps into the window. In an alternative embodiment, the circumferential wall is provided with a circumferential groove or one or more recesses on the inner face thereof into which the one or more snap portions engage, so that the window(s) need not be present.

In an embodiment, the cap is a snap-on type cap providing in use of the closure assembly a snap-on functionality so that the cap can be replaced on the neck after first time opening, wherein the article and the cap are provided with cooperating snap connector formations to provide the snap-on functionality.

In an embodiment, the base portion has at least one first cam portion that is integrally formed at a top face of annular base portion, wherein a top region of the first cam portion protrudes upwardly above the circumferential wall, and wherein the lower end of the skirt of the cap is provided with at least one second cam portion, which defines a cam follower surface adapted to interact with a cam surface of the first cam portion, so that upon first time opening of the closure assembly by rotation of the cap about a main axis of the neck, the first and second cam portions interact in order to cause axial lifting of the cap relative to the neck, e.g. disengaging the snap connector formations of the removed cap and the article.

In an embodiment, the cap comprises at least one handle, e.g. a pair of wing-shaped handles, e.g. just one pair of wing-shaped handles, said at least one handle extending outwardly from the skirt of the cap and being configured for engagement by the user for removal of the cap.

In an embodiment, the annular base portion has a pair of first cam portions that are arranged in a vertical plane through the at least one handle, e.g. a panel portion thereof, wherein the first end of the strap is integral with a protruding region of one of the first cam portions at a location above the circumferential wall.

In an embodiment, a bottom side of a wing-shaped handle adjoins the skirt at a position that is located at a distance above the lower end of the skirt, wherein the strap is arranged in a vertical plane that is common with the wing-shaped handle, wherein the strap has a vertical portion that extends from the first end of the strap vertically upwards to said location and along the exterior of the lower portion of the skirt, and wherein said vertical strap portion adjoins a bend in the strap so that a successive strap portion extends outwards along the bottom side of the handle towards a tip of the handle.

It will be appreciated that the closure assembly of the eight aspect of the invention may comprise one or more features discussed herein with reference to any other aspect of the invention, e.g. according to the first and/or the second and/or the third and/or fourth and/or fifth and/or sixth and/or seventh aspect of the invention, e.g. as illustrated in the appended figures, e.g. as disclosed in one or more of the subclaims.

A ninth aspect of the invention relates to a closure assembly comprising an article and a cap, said cap including an integrated tamper-evident ring member, wherein:

the article forms a tubular neck around a product passage in said article, said neck forming a mouth at a top end of said product passage, the cap including the integrated tamper-evident ring member and the integrated strap is made, e.g. moulded, as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein in the closed position the cap is positioned on the neck and thereby seals the product passage, wherein in the open position the cap is removed from the neck, thereby leaving the product passage open, wherein the cap comprises a top wall structure and a downward depending skirt having an interior side, exterior side, and a lower edge remote from the top wall structure, wherein the tamper-evident ring member is integrally formed to the lower edge of the skirt of the cap, said tamper-evident ring member comprising an annular base portion, which base portion is connected via one or more breakable bridges to the skirt, wherein the base portion is configured to remain connected to the article upon removal of the cap from the neck of the article by the user, wherein the article has a circumferential wall which is positioned around a bottom region of the neck and spaced from the neck, thereby forming an inner space which is open from above and adapted to receive the annular base portion of the tamper-evident ring member of the cap therein, wherein, for example, the circumferential wall is erected on a circumferential flange that extends around the neck, wherein the annular base portion is provided with at least one snap portion, and wherein the circumferential wall is provided with a complementary snap formation, e.g. with a window through the circumferential wall from a wall outer face to a wall inner face, such that the snap portion snaps onto or into the complementary snap formation, e.g. into the window, when the cap is placed on the neck and the annular base portion is at least partially inserted into the inner space, which snap connection is such that the base portion remains connected to the article upon removal of the cap from the neck by the user, wherein the circumferential wall and the skirt of the cap are provided with cooperating latching formations which are configured to form a snap connection when the cap is placed on the neck and to become unsnapped upon removal of the cap.

It is envisaged that the latching formations remain functional after first time removal of the cap from the article, e.g. allowing a user to place the cap back onto the article.

In an embodiment, the circumferential wall has at least one latching window and the skirt is provided with at least one latching tab that is snapped into said window in the closed position of the cap, so upon removal of the cap the latching tab becomes unsnapped and released from the window or recess. In an embodiment, the circumferential wall has a pair of diametrically opposed latching windows and the skirt has a pair of diametrically opposed latching tabs.

In an embodiment, the annular base portion is provided with at least one snap portion, e.g. multiple distributed around the annular base portion, e.g. four, and the circumferential wall is provided with a window through the circumferential wall from a wall outer face to a wall inner face for each snap portion of the annular base portion.

In an embodiment, the circumferential wall is provided with two diametrically opposed latching windows and the skirt has a pair of diametrically opposed latching tabs, wherein the annular base portion is provided with at least one snap portion, e.g. multiple distributed around the annular base portion, e.g. four, and the circumferential wall is provided with a window through the circumferential wall from a wall outer face to a wall inner face for each snap portion of the annular base portion in addition to the latching windows.

In an embodiment, the annular base portion has at least one first cam portion that is integrally formed at a top face of annular base portion, wherein the lower end of the skirt of the cap is provided with at least one second cam portion, which defines a cam follower surface adapted to interact with a cam surface of the first cam portion, so that upon first time opening of the closure assembly by rotation of the cap about a main axis of the neck, the first and second cam portions interact in order to cause axial lifting of the cap relative to the neck.

In an embodiment, the latching portion of the cap is arranged on the second cam portion, said second cam portion protruding downwardly from the skirt.

In an embodiment, a top region of the annular base portion, e.g. a first cam portion thereof, protrudes upwardly above the circumferential wall, and a strap adjoins at a first end thereof this upwardly protruding top region, wherein the strap adjoins at a second end thereof the another portion of the cap, and wherein the strap is adapted to remain connected upon removal of the cap from the neck of the article by the user.

In an embodiment, the cap comprises at least one handle, e.g. a pair of wing-shaped handles, e.g. just one pair of wing-shaped handles, said at least one handle extending outwardly from the skirt of the cap and being configured for engagement by the user for removal of the cap.

In an embodiment, the annular base portion has a pair of first cam portions that are arranged in a vertical plane through the at least one handle, e.g. a panel portion thereof, wherein the first end of the strap is integral with a protruding region of one of the first cam portions at a location above the circumferential wall.

It will be appreciated that the closure assembly of the ninth aspect of the invention may comprise one or more features discussed herein with reference to any other aspect of the invention, e.g. according to the first and/or the second and/or the third and/or fourth and/or fifth and/or sixth and/or seventh and/or eight aspect of the invention, e.g. as illustrated in the appended figures, e.g. as disclosed in one or more of the subclaims.

A tenth aspect of the invention relates to a closure assembly comprising an article and a lift cap, said cap including an integrated tamper-evident ring member and an integrated strap, wherein:

the article forms a tubular neck around a product passage in said article, said neck forming a mouth at a top end of said product passage, the lift cap including the integrated tamper-evident ring member and the integrated strap is made, e.g. moulded, as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein in the closed position the cap is positioned on the neck and thereby seals the product passage, wherein in the open position the cap is removed from the neck, thereby leaving the product passage open, wherein the cap comprises a top wall structure and a downward depending skirt having an interior side, exterior side, and a lower edge remote from the top wall structure, wherein the tamper-evident ring member is integrally formed to the lower edge of the skirt of the cap, said tamper-evident ring member comprising a base portion, e.g. an annular base portion, which is connected via one or more breakable bridges to the skirt, wherein the base portion is configured to remain connected to the article upon removal of the cap from the neck of the article by the user, wherein the cap, preferably, is a snap-on type cap providing in use of the closure assembly a snap-on functionality, wherein the article and the cap are provided with cooperating snap connector formations to provide the snap-on functionality, wherein the closure assembly comprises:

at least one first cam portion, e.g. an upwardly directed first cam portion, defining a cam surface, which cam surface is angled with respect to a main axis, which first cam portion is integrally formed on the article, and at least one second cam portion, e.g. a downwardly directed second cam portion, defining a cam follower surface adapted to interact with the cam surface of the first cam portion and which second cam portion is integrally formed on the skirt, e.g. on the lower edge of the skirt, wherein—upon first time opening of the closure assembly by rotation of the cap relative to the article about the main axis, e.g. by at most a quarter turn,—the first and second cam portions interact in order to cause axial lifting of the cap relative to the neck, e.g. so that the co-operating snap connector formations disengage, wherein the strap is integral at a first end thereof to the tamper-evident ring member and at a second end thereof integral to another portion of the cap, wherein the strap is adapted to remain connected to both the tamper-evident ring member and said other portion of the cap upon said first time removal of the cap from the neck of the article by the user.

The closure assembly of the tenth aspect of the invention provides for convenient use as the cap can easily be removed by rotation, with the cam mechanism causing the lift of the cap. This arrangement allows for a limited length of the strap, e.g. allowing for its combination with a wing-shaped handle as discussed herein.

The at least one first cam portion is integral to the article, e.g. to the neck and/or to an annular flange portion that is integrally formed on the neck and extends around the neck. For example, the article has two first cam portions, arranged diametrically opposite from one another relative to the neck.

According to the tenth aspect of the invention, the at least one first cam portion is integral part of the article, so not part of the cap. As will be appreciate this detail can also be readily combined with features of embodiments of closure assemblies according to at least the first, second, fourth, fifth, sixth, seventh aspect of the invention.

In an embodiment, the at least one second cam portion is arranged on the lower edge of the skirt. In another embodiment, the at least one second cam portion is arranged at the interior side of the skirt of the cap, e.g. first cam portion being partly or entirely located within the skirt when the cap is in closed position, e.g. obscuring the cam mechanism from view to a user. In an embodiment, the first and second cam portions in a zone of the neck and the interior of the skirt, respectively, that lies below the associated snap formation (when present). This, for example, allows for a smooth embodiment of the neck between the snap formation and the mouth, e.g. in view of drinking wherein the user places the top portion of the neck between the lips of the user.

In an embodiment, the at least one first cam portion is integral to an annular flange portion that is integrally formed to the neck and extends around the neck. For example, the annular flange portion is provided with multiple hook member passages that each extend between the top face and the bottom face through the annular flange portion. Herein the base portion is provided with multiple hook members integrally formed to the bottom of the base portion, wherein each hook member passage is adapted to receive a hook member when the cap with the integrated tamper-evident ring member is secured on the neck, wherein a hook portion of each hook member engages, e.g. snaps, underneath the bottom face of the annular flange portion on the neck of the article. Herein the closure assembly is embodied such that upon first time opening of the closure assembly by removal of the cap by a user the one or more breakable bridges break and the base portion is retained by means of the hook members.

For example, the flange portion is provided with a peripheral protective rim portion that is integral to and extends upwards from the annular flange portion at the periphery thereof, so that the top face of the annular flange portion and the protective rim define an annular recess around the neck, wherein the periphery of the base portion is shaped to fit within the protective rim portion as it is at least partially inserted in said annular recess upon mounting of the cap with the integrated tamper-evident ring member on the neck.

In an embodiment, the cap comprises one or more wing-shaped handles, e.g. just one pair of wing-shaped handles, said one or more wing-shaped handles extending outwardly from the skirt of the cap, e.g. in mutually opposite directions and being configured to be engaged by a user for removal of the cap, wherein the wing-shaped handles each have, seen in side view thereon, an outer periphery comprising a bottom side, a top side, and a tip remote from the skirt, where said bottom side and top side adjoin at the tip. In an embodiment hereof, the strap is integral at a first end thereof to the base portion of the tamper-evident ring member and at a second end thereof integral to a wing-shaped handle. In an embodiment, the strap, prior to first time removal of the cap by the user, is located in a plane, e.g. in a vertical plane, that is in common with a panel portion of the respective wing-shaped handle.

It will be appreciated that the closure assembly of the tenth aspect of the invention may comprise one or more features discussed herein with reference to any other aspect of the invention, e.g. according to the first and/or the second and/or the third and/or fourth and/or fifth and/or sixth and/or seventh and/or eight aspect and/or ninth aspect of the invention, e.g. as illustrated in the appended figures, e.g. as disclosed in one or more of the subclaims.

An eleventh aspect of the invention relates to a closure assembly comprising an article and a cap, said cap including an integrated tamper-evident ring member and an integrated strap, wherein:

the article forms a tubular neck around a product passage in said article, said neck having a vertical main axis and forming a mouth at a top end of said product passage, the cap including the integrated tamper-evident ring member and the integrated strap is made, e.g. moulded, as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein in the closed position the cap is positioned on the neck and thereby seals the product passage, wherein in the open position the cap is removed from the neck, thereby leaving the product passage open, wherein the cap comprises a top wall structure and a downward depending skirt having an interior side, exterior side, and a lower edge remote from the top wall structure, wherein the tamper-evident ring member is integrally formed to the lower edge of the skirt of the cap, said tamper-evident ring member comprising a base portion, preferably an annular base portion, which base portion is connected via one or more breakable bridges to the skirt, wherein the base portion is configured to remain connected to the article upon removal of the cap from the neck of the article by the user, wherein the cap comprises at least one handle configured to be engaged by a user for removal of the cap, e.g. one pair of diametrically opposed handles, wherein the handle has a panel portion extending outwardly from the skirt of the cap, which panel portion has opposing main panel faces, said main faces each being bounded, seen in side view onto the cap, by a bottom side, a top side, and a tip of the panel portion, wherein the handle further has at least one reinforcing top protrusion that is integral with at least a portion of the top side of the panel portion and which top protrusion protrudes away from main face of the panel portion so as to reinforce the panel, wherein the strap is integral at a first end thereof to the base portion of the tamper-evident ring member and extends from said first end along the bottom side of the panel portion about the tip of the panel portion to a second end of the strap, wherein the second end of the strap adjoins the outer end of the reinforcing top protrusion.

The eleventh aspect allows for a thin walled panel portion that is effectively reinforced by the top protrusion to provide sufficient strength, e.g. for opening of the closure assembly. The second end of the strap adjoins an outer end of this top protrusion. For example, when opening the cap, any load of strap onto the handle is then readily absorbed, at least in part, by the top protrusion allowing for a thin panel portion and thus reduction of the amount of plastic for the cap.

For example, the top protrusion links up with the top wall structure of the cap. For example, the top protrusion is, seen in side view, arc shaped, e.g. an arc dropping down from the top wall structure of the cap towards the outer end of the protrusion.

For example, the top protrusion extends outward relative to the main axis over at least half the outward extension of the handle relative to the main axis, e.g. between 60 and 85% of the outward extension of the handle.

In practical embodiments, the second end of the strap connecting to the outer end of the reinforcing top protrusion is located remote from the skirt of the cap at a location that is at least 10 millimetres outward from the skirt, e.g. for embodiments wherein the neck has an outer diameter of between 8 and 13 millimetres. This, e.g. allows for the user to place a finger, e.g. a thumb, onto the handle at a location adjacent the skirt, wherein said finger does not interfere with the flexing of the strap when rotating the cap for first time opening and where the top protrusion creates enhanced robustness of the handle. This embodiment is, for example, of relevance for a quarter turn cap, e.g. a quarter turn snap-on type cap. This embodiment allows for a limited length of the strap.

In practical embodiments, the length of the strap is between 30 and 50 millimetres, e.g. sufficient to allow moving the cap over the top end or mouth end of the neck for removal and replacement of the cap.

The panel portion is for, example, vertical or near vertical, e.g. lightly tilted relative to the main axis.

The panel portion is, preferably, a planar panel portion, so lacking any undulations, warping, etc.

The panel portion may have one or more holes in it, e.g. for aesthetic reasons and/or weight saving.

The panel portion, preferably, has a thickness of at most 2 millimetres, measured between the opposing main faces. For example, the thickness of a panel portion is between 0.5 and 1 millimetres. For example, the thickness is the greatest at the top side of the panel portion and gradual reduces towards the bottom side. For example, the thickness is about 1 millimetre at the top side and about 0.5 millimetre at the bottom side.

In an embodiment, the reinforcing top protrusion is the only reinforcement of the panel portion, so a reinforcement along the bottom side or tip is absent.

For example, the handle(s) is/are embodied in this respect according to WO2018/194454.

In an embodiment, the handle has two diverging top protrusions that extend inclined upward from the panel portion at the top side and which diverge from one another defining a Y-shaped vertical cross-section of the wing shaped handle together with the panel portion.

In alternative embodiments, each handle could have one top protrusion, e.g. defining an inverted L-shaped cross-section together with the panel portion. Alternatively, in yet another embodiment, each handle could have two oppositely directed top protrusions defining with the panel portion a T-shaped cross-section of the handle.

In embodiments, the cap is a snap-on cap.

In embodiments, the cap is a quarter turn lift cap.

In embodiments, preferably with a snap-on type cap, e.g. a quarter turn opening snap-on type cap, the closure assembly comprises:

at least one first cam portion defining a cam surface, which cam surface is angled with respect to the main axis, which first cam portion is integrally formed on one of the lower edge of the skirt on the one hand and a portion, e.g. a flange portion, of the tamper-evident ring member or of the article on the other hand, and at least one second cam portion defining a cam follower surface adapted to interact with the cam surface of the first cam portion and which second cam portion is integrally formed on the other one of the lower edge of the skirt on the one hand and said portion, e.g. said flange portion, of the tamper-evident ring member or the article on the other hand, wherein—upon first time opening of the closure assembly by rotation of the cap relative to the article about a main axis—the first and second cam portions interact in order to cause axial lifting of the cap relative to the neck, e.g. so that the co-operating snap connector formations disengage. In embodiments hereof, each handle has one top protrusion facing away from the respective panel portion in a direction that is against the direction of rotation for opening the cap. For example, each top protrusion defines an inverted L-shaped cross-section together with the panel portion. For example, the cap has two diametrically opposed handles for rotating the cap to the opened position, wherein the cam mechanism causes a lift of the cap, e.g. to release a snap connection between the cap and the article.

In a preferred embodiment, the at least one first cam portion is part of the tamper-evident ring and the at least one second cam portion part of the skirt, e.g. at the lower edge thereof. In another embodiment, e.g. as discussed and illustrated herein with reference to the tenth aspect of the invention, the at least one first cam portion is not part of the cap but is part of the article, e.g. located on the neck, and the at least one second cam portion part of the skirt, e.g. at the lower edge thereof.

In a practically preferred embodiment, the cap is a quarter-turn opening snap-on type cap, so that rotating the cap over about a quarter turn causes sufficient lift to disengage, or assist in the disengagement of, any snap retention of the cap and/or break the breakable bridges. Depending on the design of the first cam portion and the second cam portion the cap may be rotatable about the neck for opening the closure in both directions, so clockwise and counter clockwise, e.g. over a quarter turn, or the design may be such that the cap is rotatable in just one direction, e.g. only clockwise. In an embodiment, In practical embodiments, each wing-shaped handle extends at least 25 millimetres outward from the axis of the tubular neck, e.g. for embodiments wherein the neck has an outer diameter of between 8 and 13 millimetres. For example, the tip outermost point lies between 25 and 40 millimetres outward from the axis of the tubular neck, e.g. the total width of the cap having two opposed wing-shaped handles being between 50 and 80 millimetres. In practical embodiments, the length of the strap is between 30 and 50 millimetres, e.g. sufficient to allow moving the cap over the top end or mouth end of the neck for removal and replacement of the cap.

In practical embodiments, each handle has a height between 10 and 20 millimetres, e.g. for embodiments wherein the neck has an outer diameter of between 8 and 13 millimetres.

It will be appreciated that the closure assembly of the eleventh aspect of the invention may comprise one or more features discussed herein with reference to any other aspect of the invention, e.g. according to the first and/or the second and/or the third and/or fourth and/or fifth and/or sixth and/or seventh and/or eight aspect and/or ninth aspect and/or tenth aspect of the invention, e.g. as illustrated in the appended figures, e.g. as disclosed in one or more of the subclaims.

In an embodiment of each of the aspects of the invention, the article is a fitment configured to be secured or secured to a container body. For example, the article is a spout, e.g. having a lower connector portion, e.g. a seal boat portion, adapted to be secured or secured between opposed film walls of a collapsible pouch container or having a lower circumferential flange or plate portion to be secured or secured onto a panel of a container, e.g. a panel of a carton or a wall of a collapsible pouch. For example, the container is configured to be filled, or is filled, with a liquid food product, e.g. a beverage, a fruit product, yogurt product, or other product for human consumption.

In an embodiment of each of the aspects of the invention, the article is a spout which comprises a lower connector portion secured or to be secured, e.g. by heat sealing, between opposed film walls of a collapsible pouch container, e.g. wherein the lower connector portion is a seal boat.

Each of the aspects of the invention also relates to a container provided with a closure assembly as described herein, e.g. a collapsible pouch container, e.g. filled with a product, e.g. a food product.

Each of the aspects of the invention also relates to a method for manufacturing a pre-assembled closure assembly as described herein for later mounting thereof as a unit on a container, the method comprising:

making, e.g. moulding, e.g. injection moulding, the article of plastic material, making, e.g. moulding, e.g. injection moulding, the cap, securing the cap including onto the neck of the article, preferably by means of an axial securing motion along a main axis of the neck, such that the cap seals the product passage.

Each of the aspects of the invention also relates to a method for manufacturing and filling a container, comprising the steps of:

providing a container having the article thereon without the cap, filling the container e.g. via the product passage in the article, securing the cap onto the neck of the article, preferably by means of an axial securing motion along a main axis of the neck, such that the cap seals the product passage.

Each of the aspects of the invention also relates to a method for manufacturing and filling a container, said method comprising the steps of:

providing a container having an article mounting location, e.g. an opening, e.g. an opening in a top edge or seam of a pouch packaging, adapted to mount the article with the cap on the container, filling the container, e.g. via the opening, mounting an assembly of the article and cap as a unit on the container at the article mounting location, e.g. using a heat-sealing technique.

The present invention also relates to a closure assembly comprising an article and a cap, said cap including an integrated tamper-evident ring member and an integrated strap, wherein:

the article forms a tubular neck around a product passage in said article, the cap is made, e.g. moulded, as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein the cap comprises a top wall structure and a downward depending skirt with a lower edge remote from the top wall structure, wherein the tamper-evident ring member is integrally formed to the lower edge of the skirt of the cap, said tamper-evident ring member comprising a base portion, which base portion is connected via one or more breakable bridges to the skirt, wherein the base portion is configured to remain connected to the article upon removal of the cap from the neck of the article by the user.

The above closure assembly may have one or more features as discussed herein with reference to one or more of the mentioned aspects, e.g. as illustrated in one or more of the appended figures.

The invention also relates to a cap as disclosed herein.

The invention also relates to an article, e.g. a spout, as disclosed herein.

Figure 2:
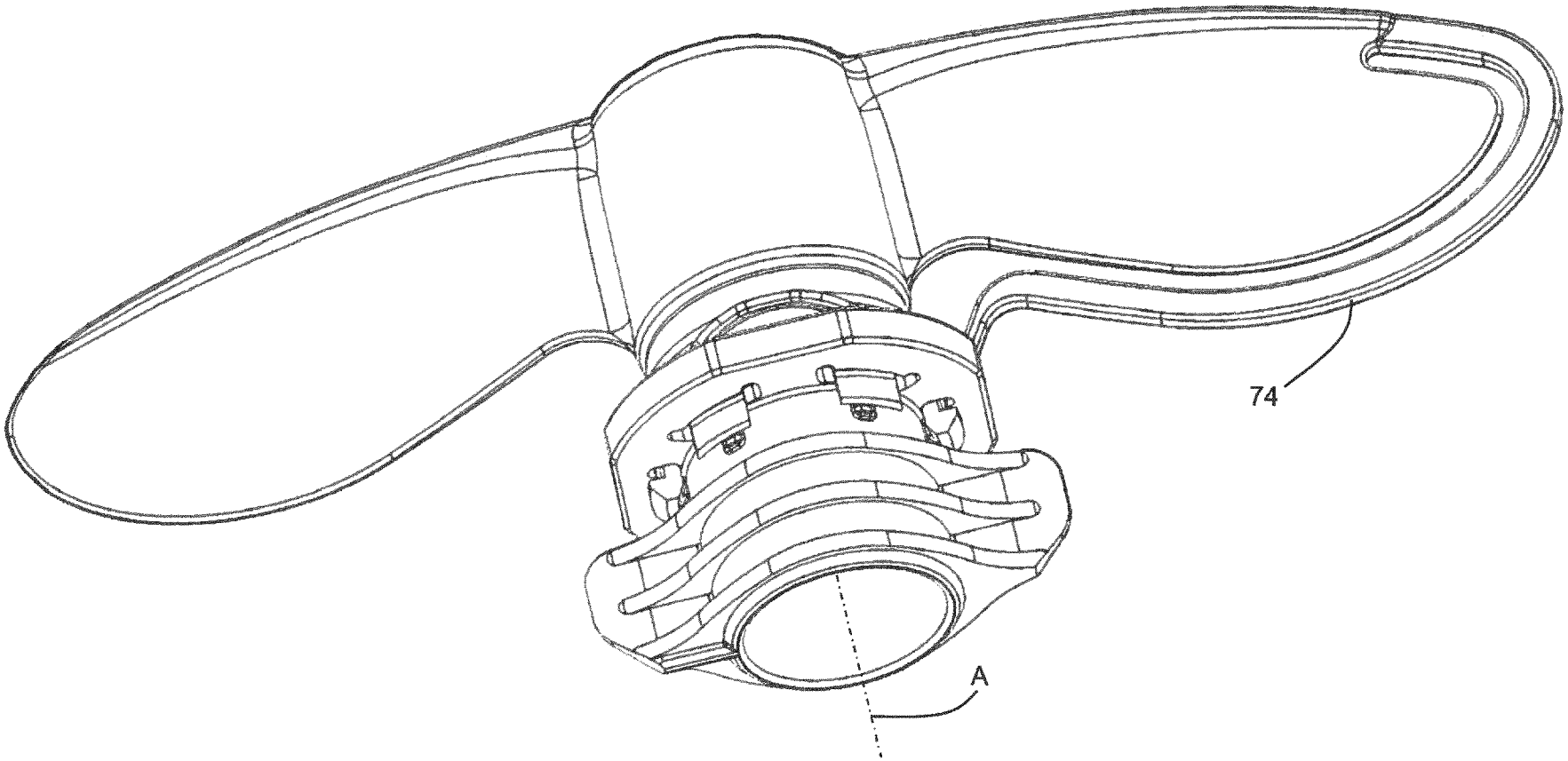
Figure 3:
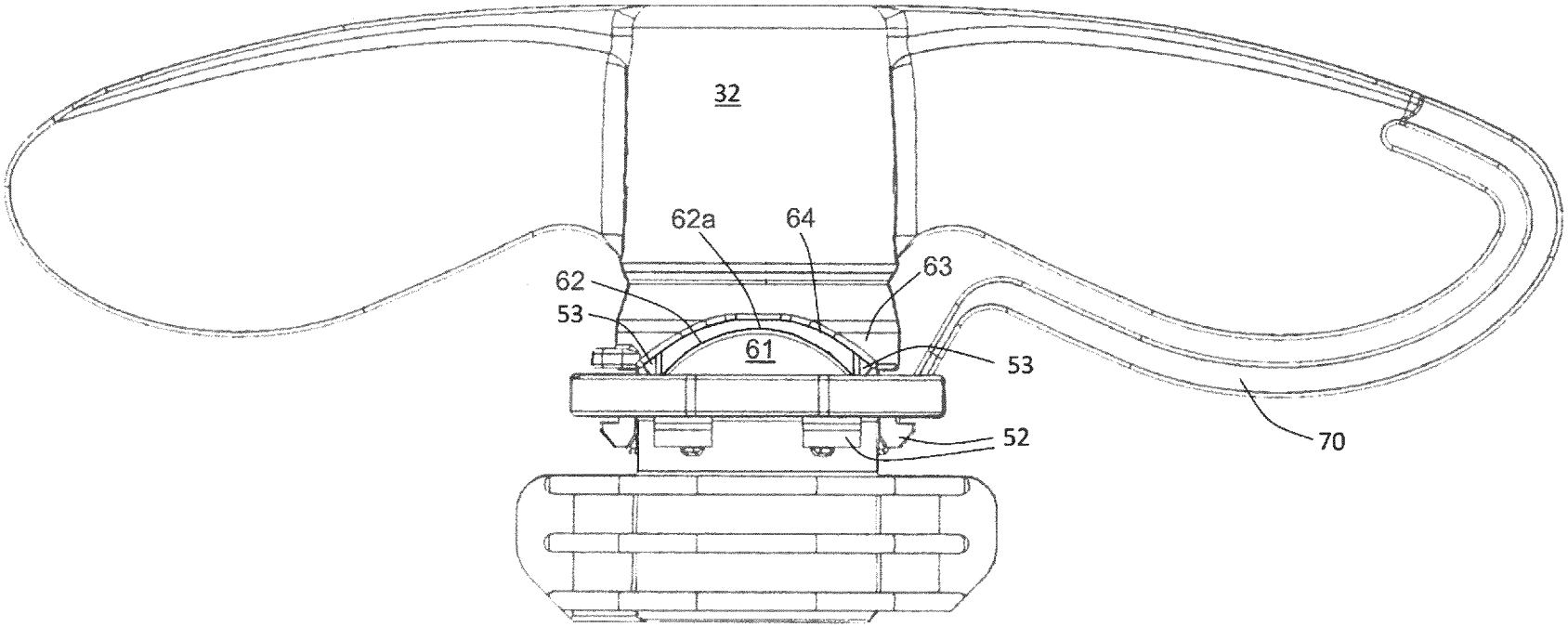
Figure 4:
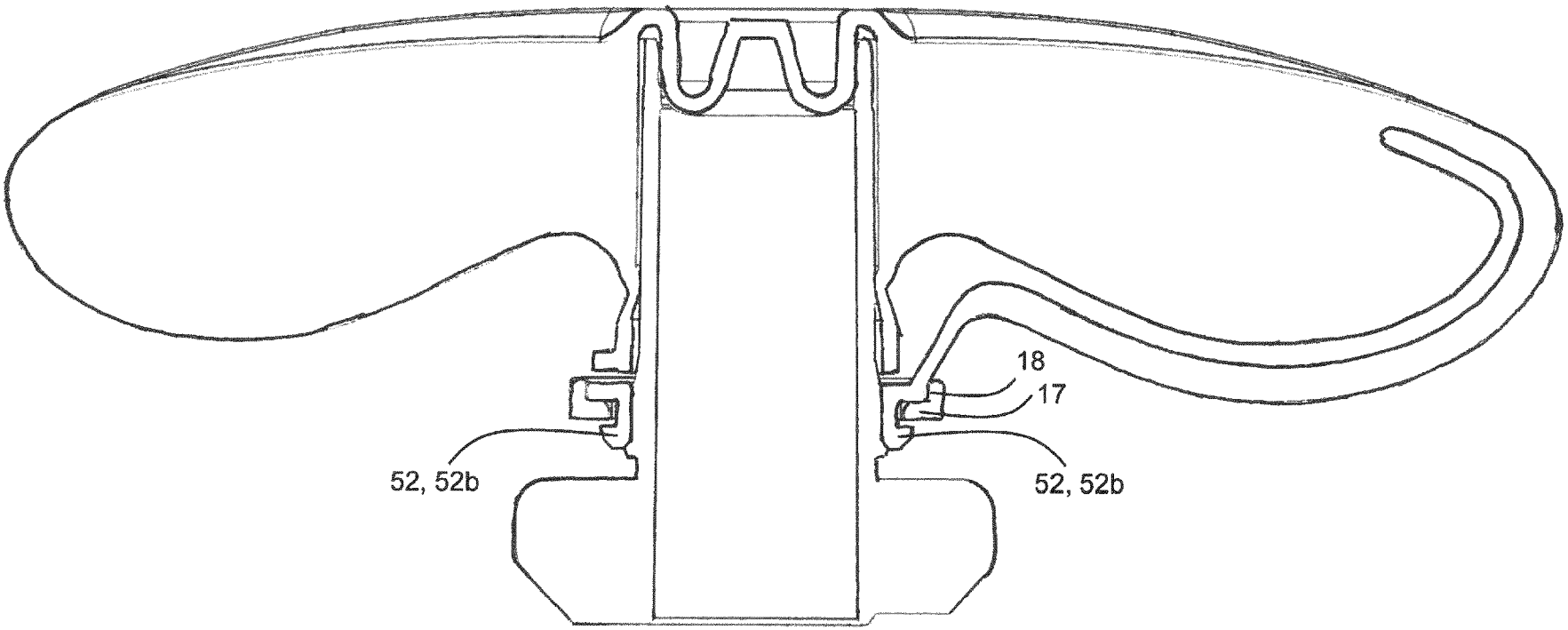
Figure 5:
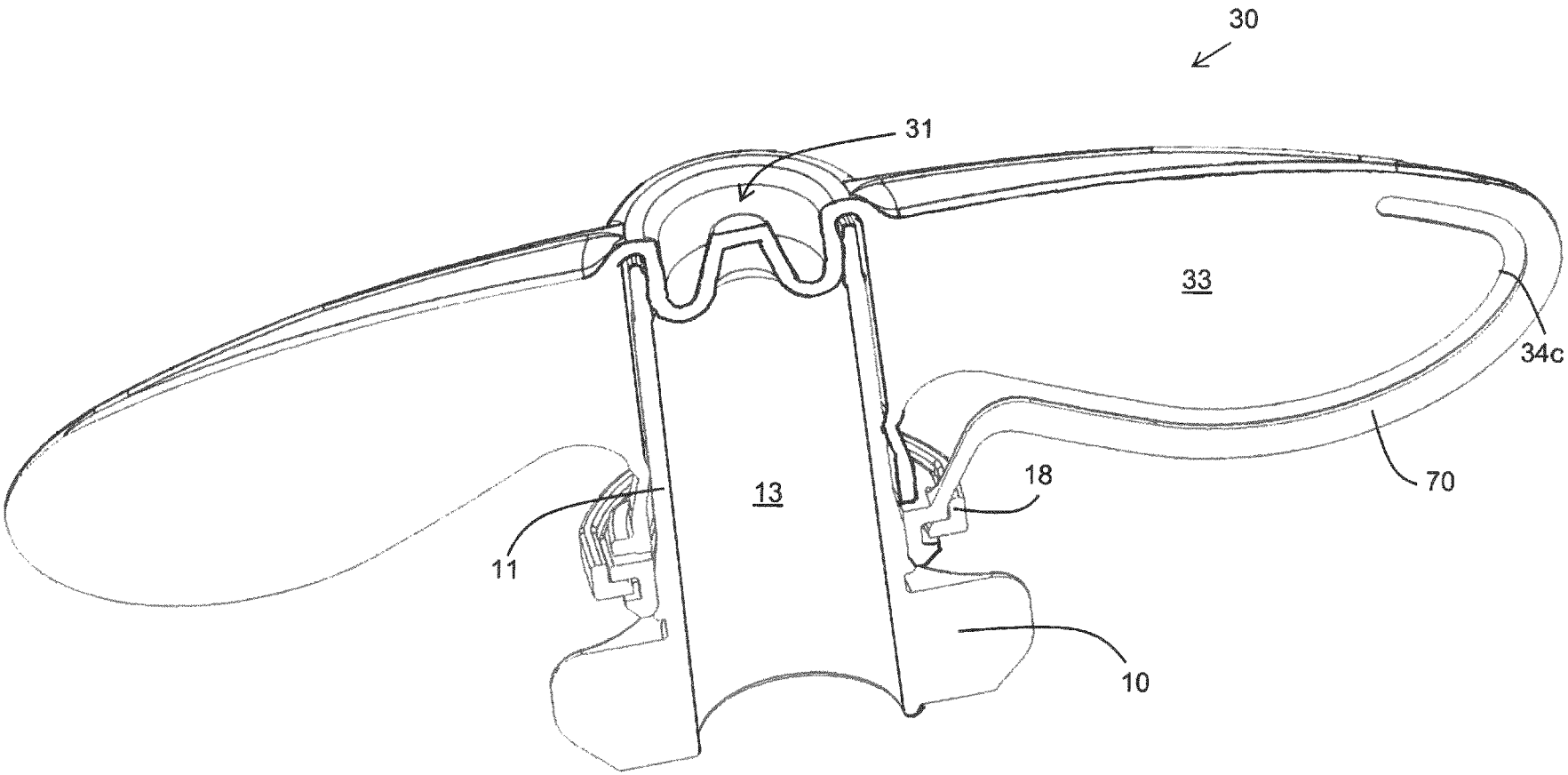
Figure 6:
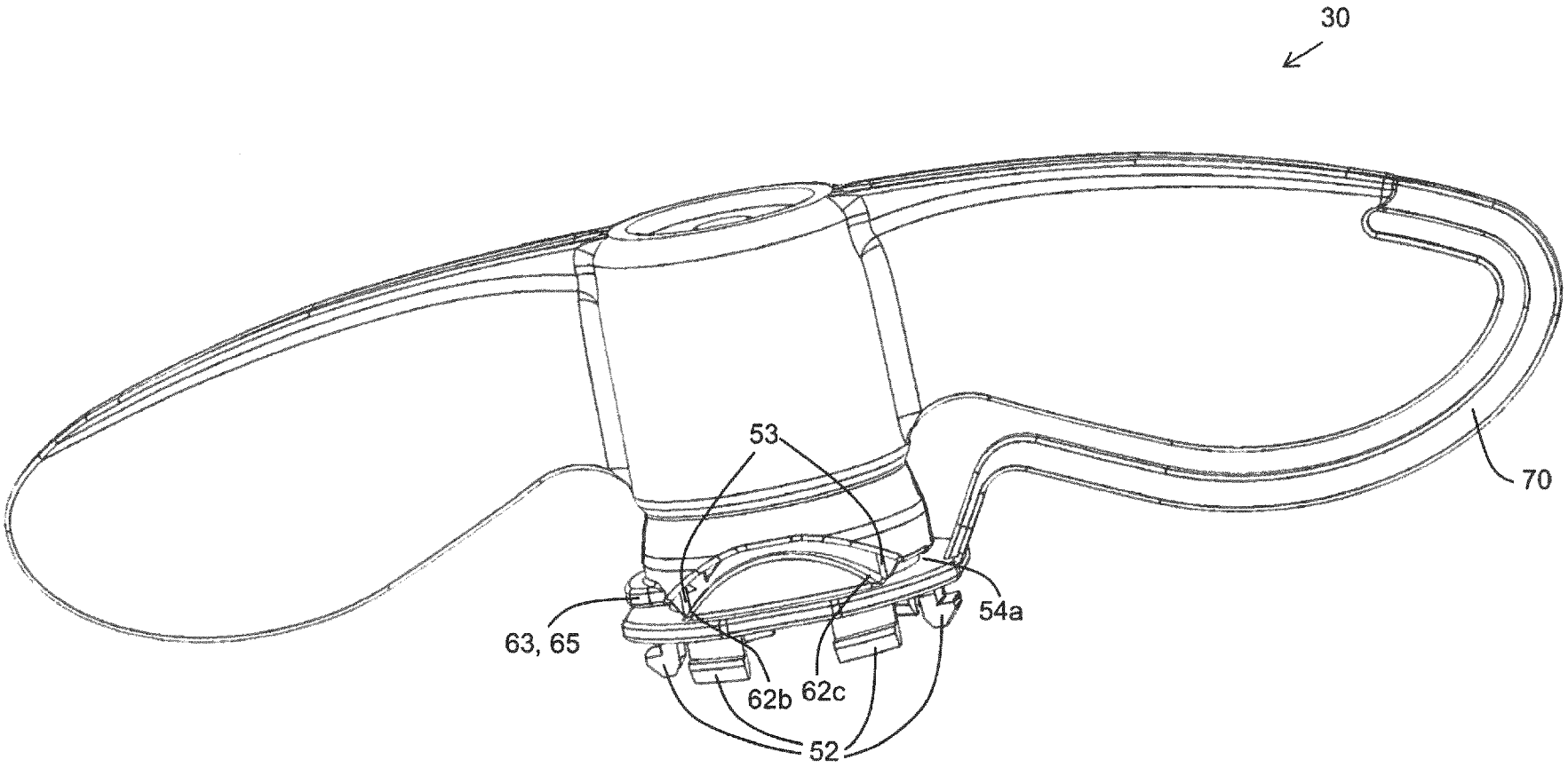
Figure 7:
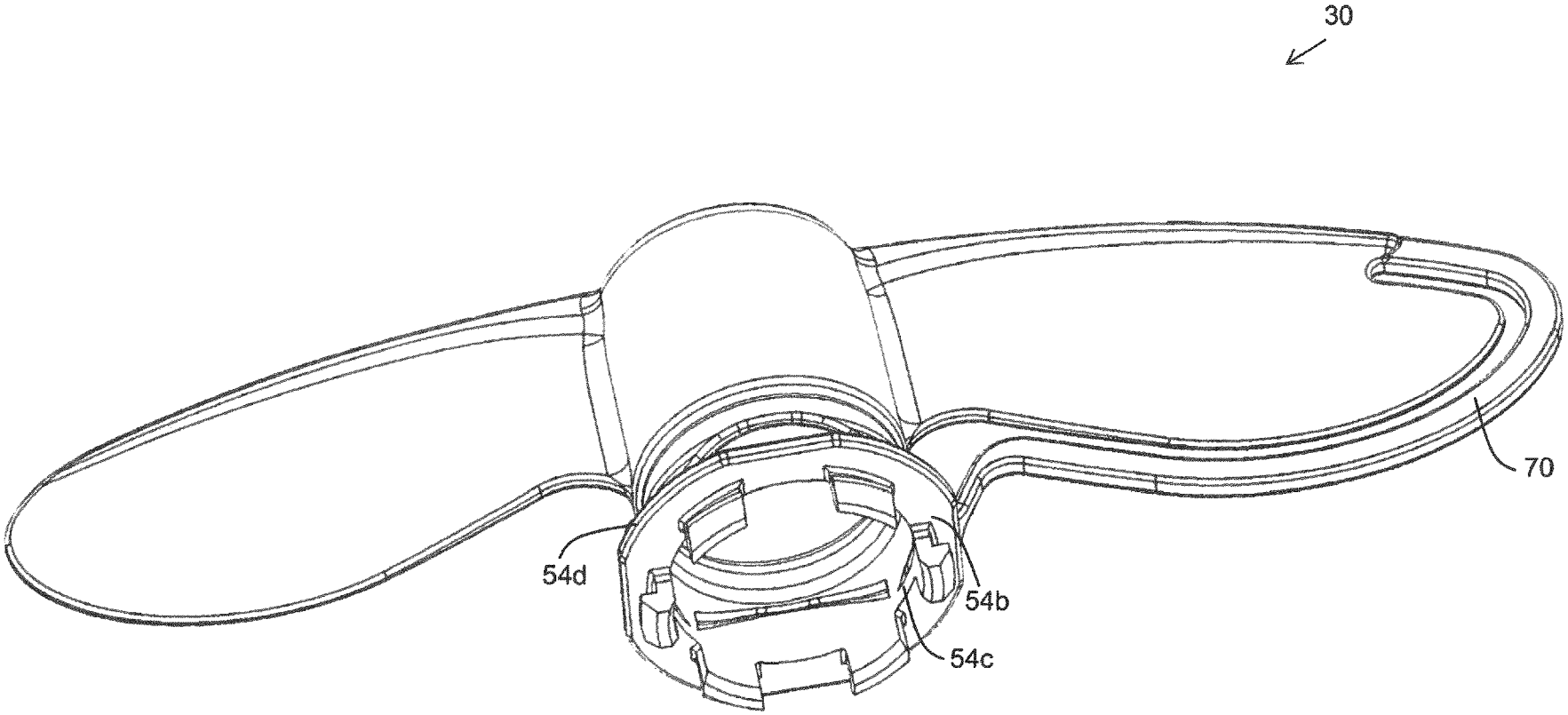
Figure 8:
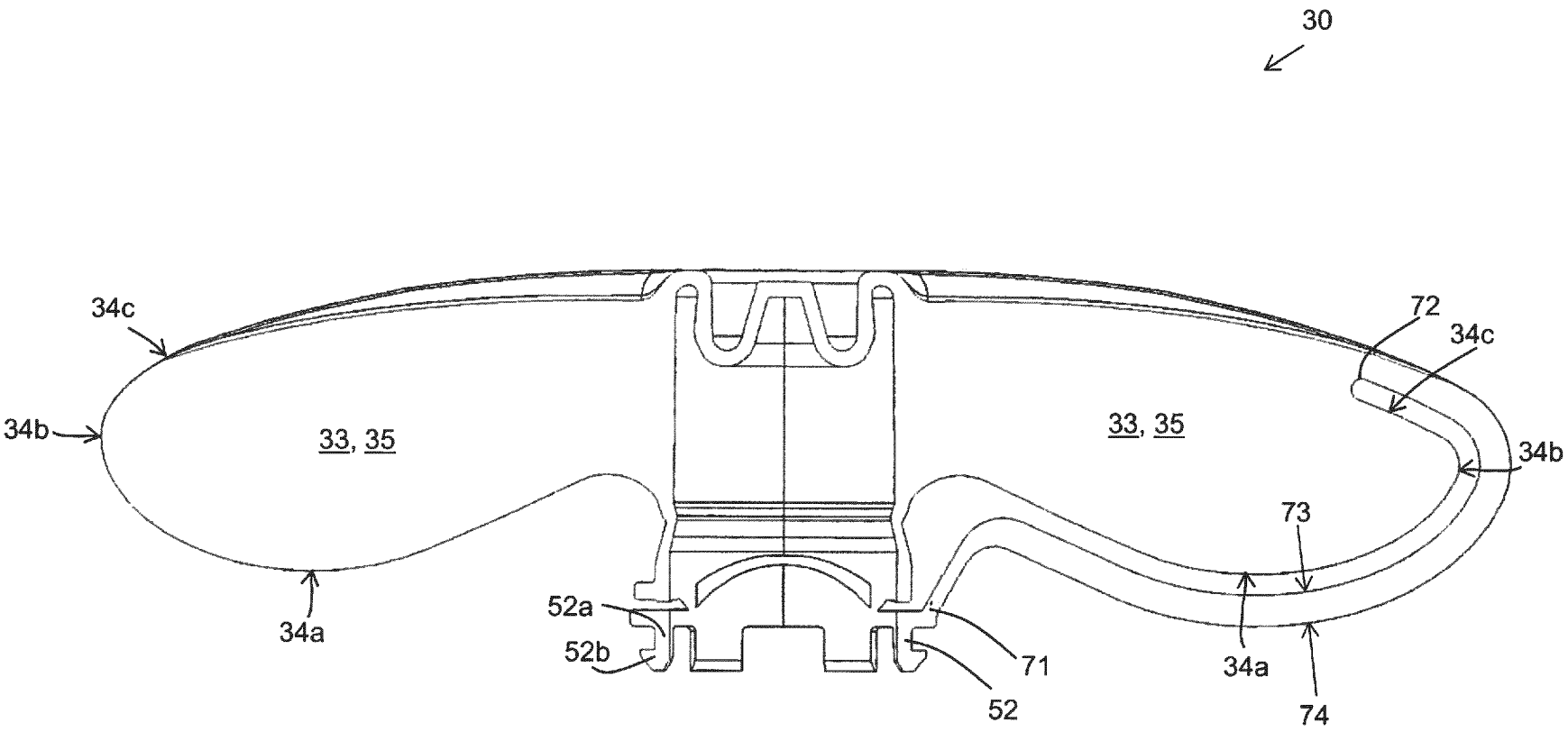
Figure 9:
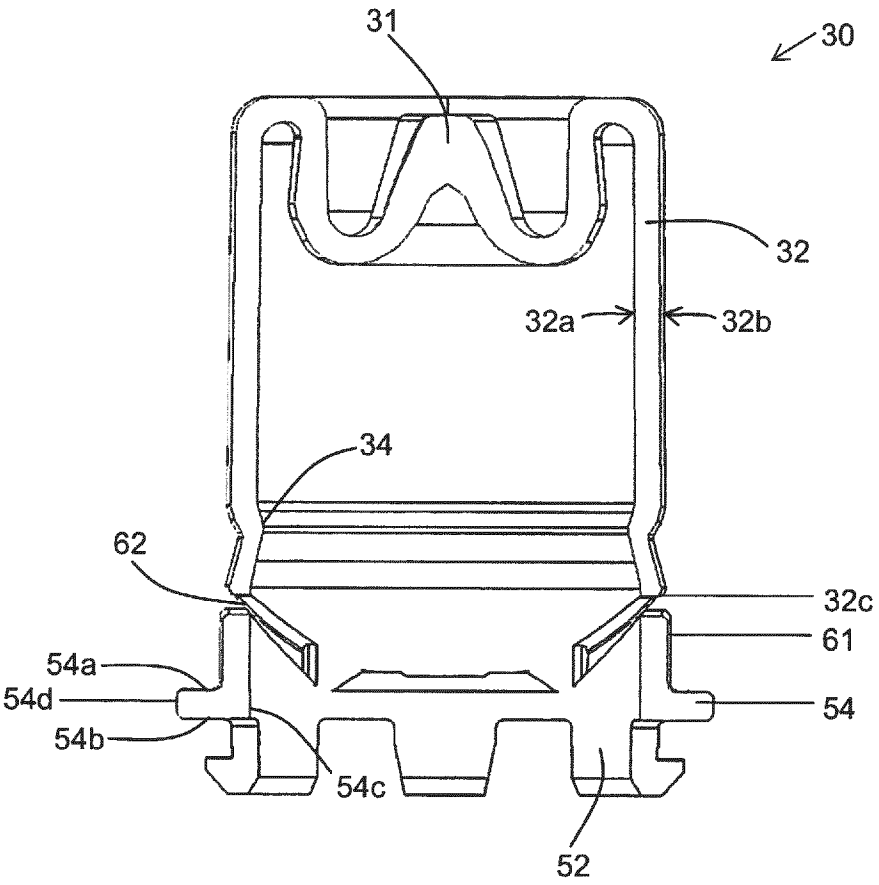
Figure 10:
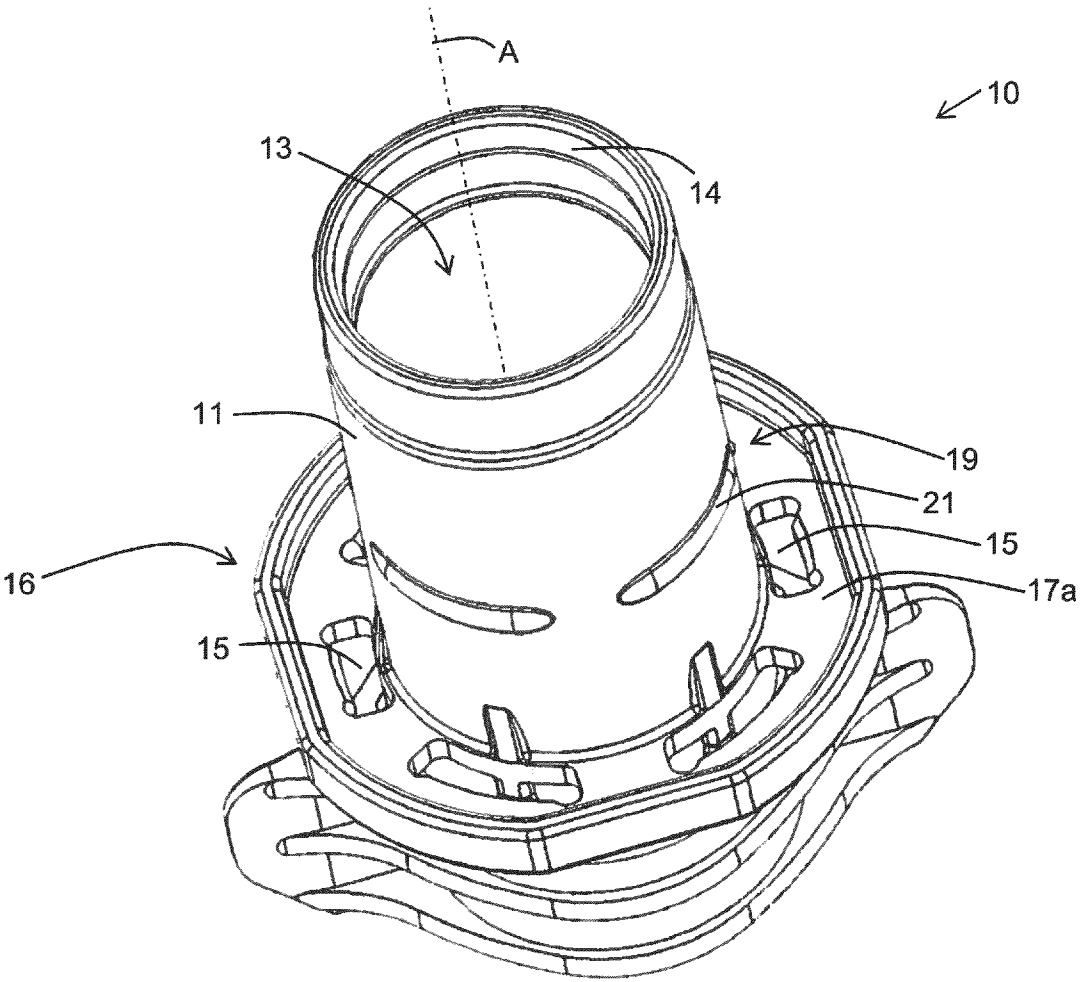
Figure 11:
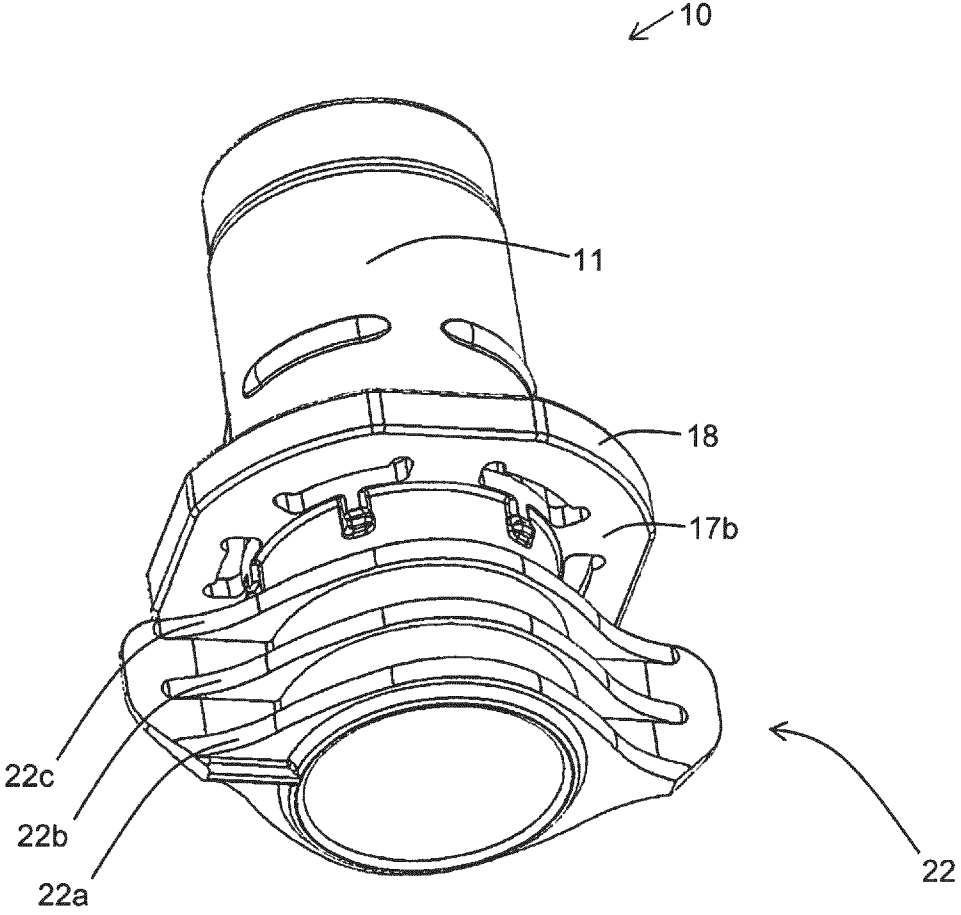
Figure 12:
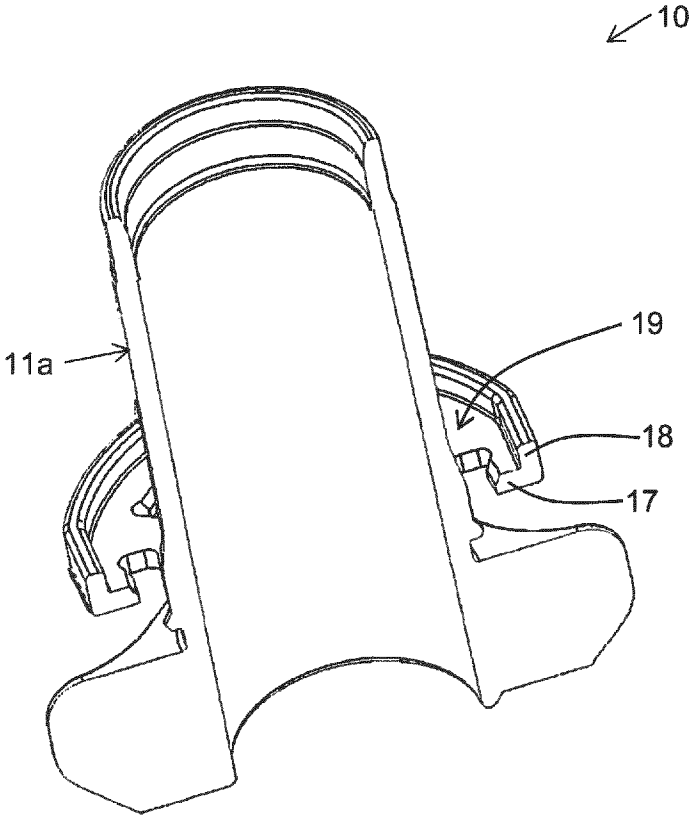
Figure 13:
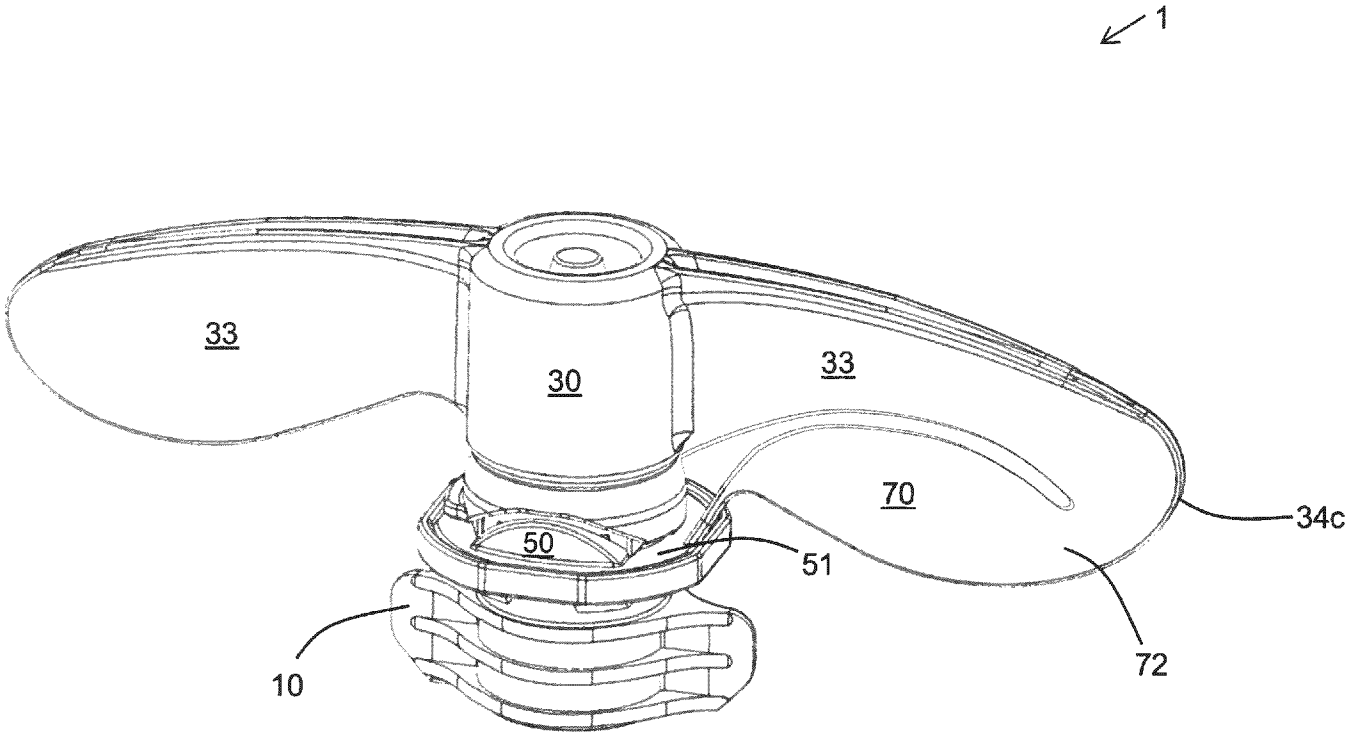
Figure 15:
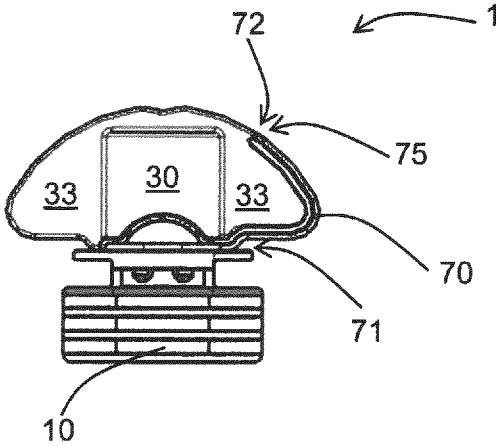
Figure 14:
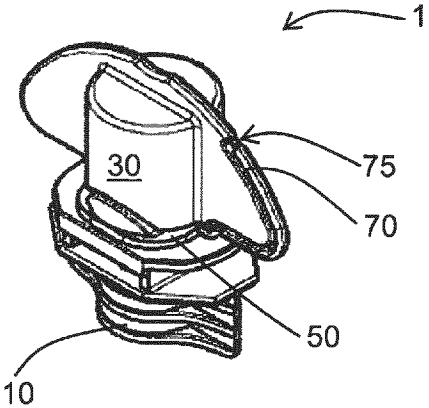
Figure 17:
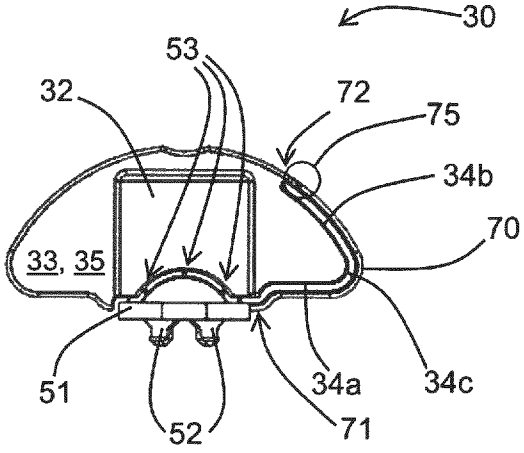
Figure 16:
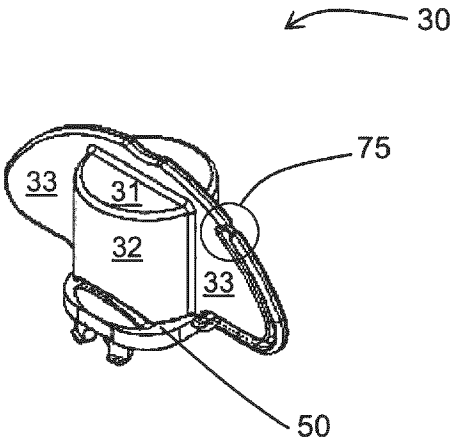
Figure 19:
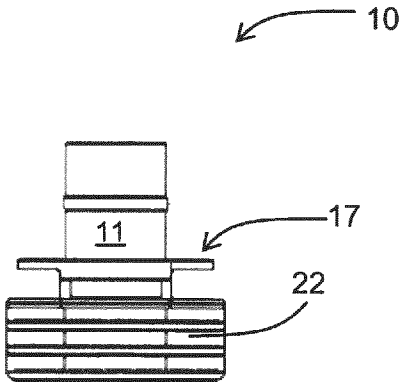
Figure 18:
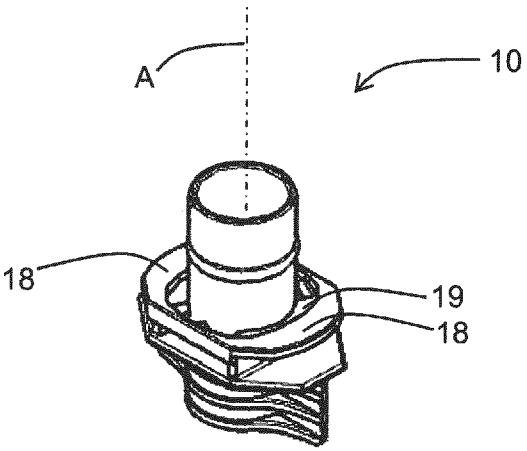
Figure 20:
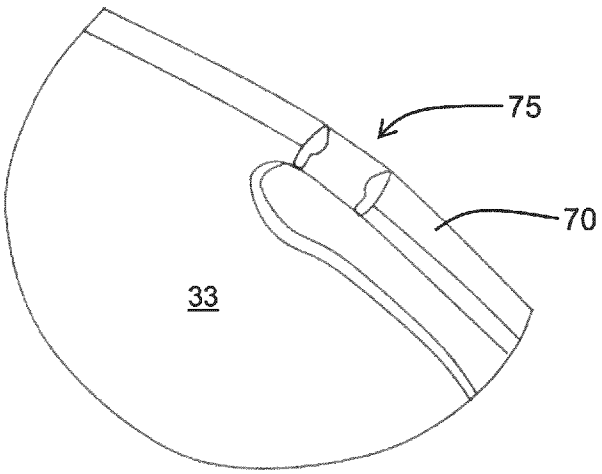
Figure 21:
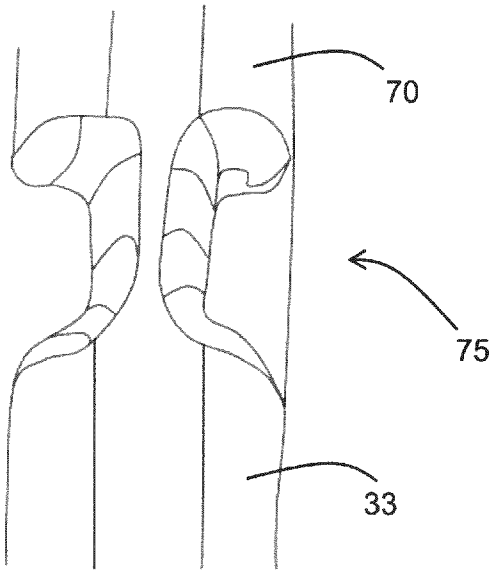
Figure 23:
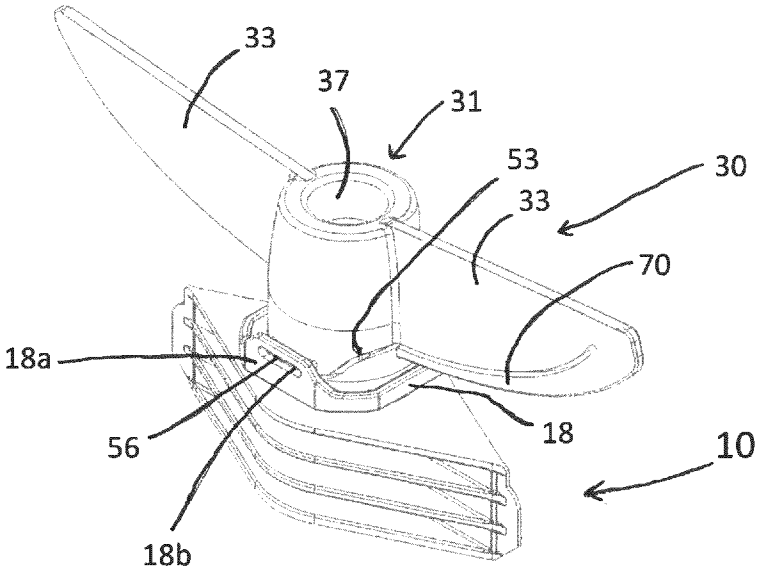
Figure 22:
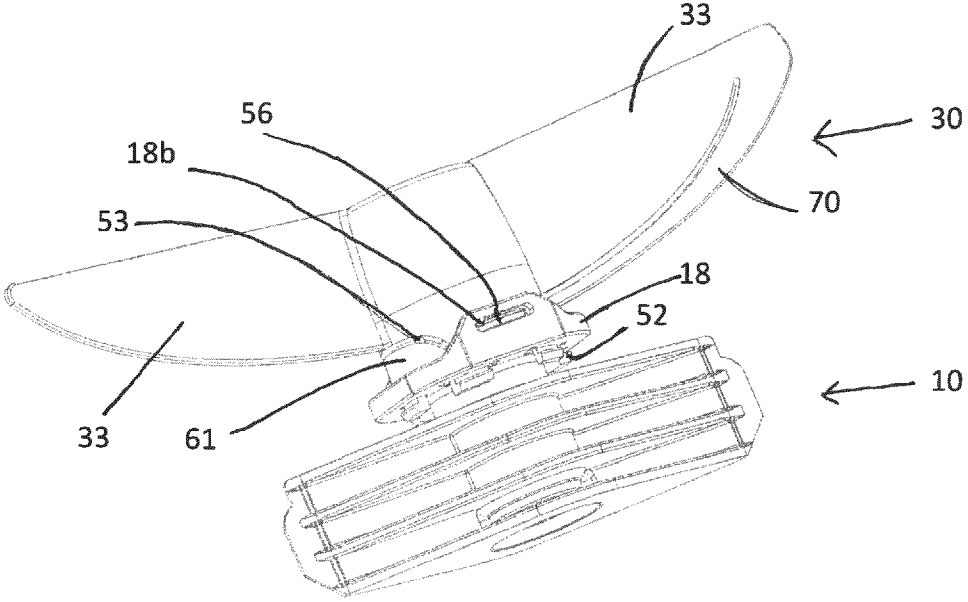
Figure 24:
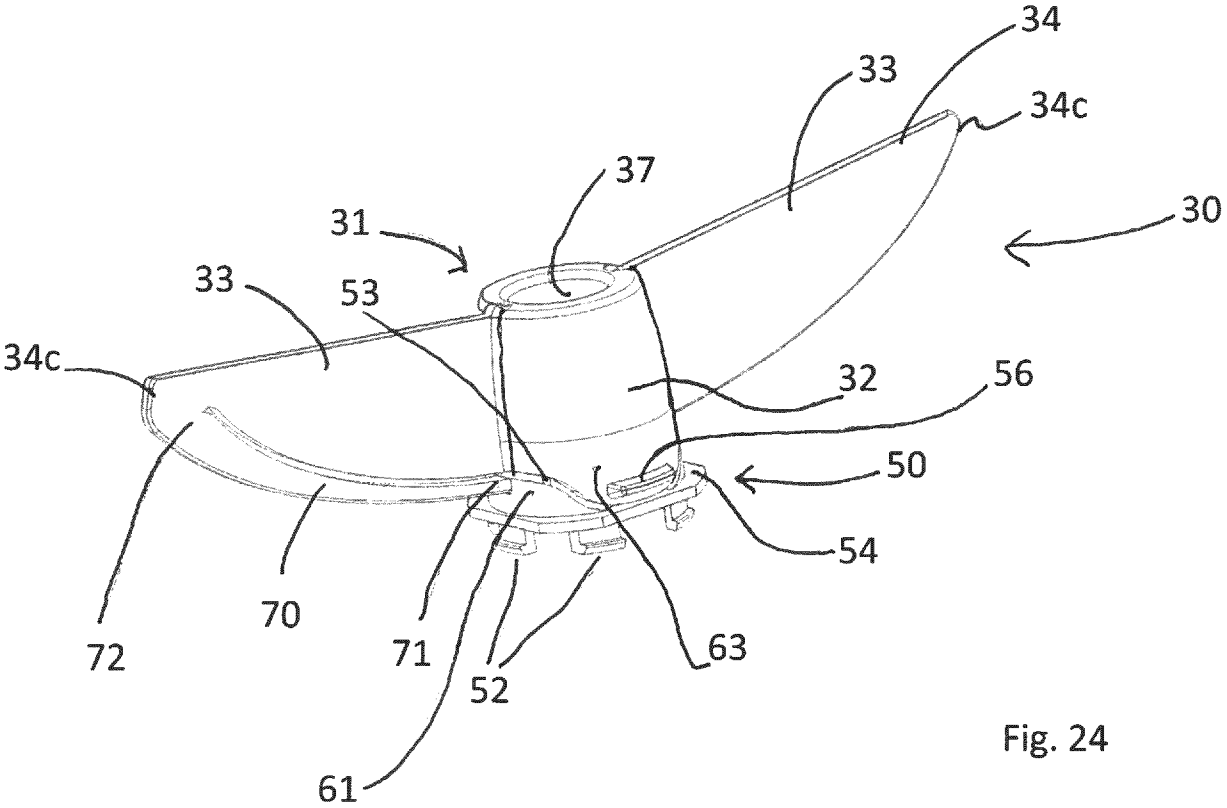
Figure 26:
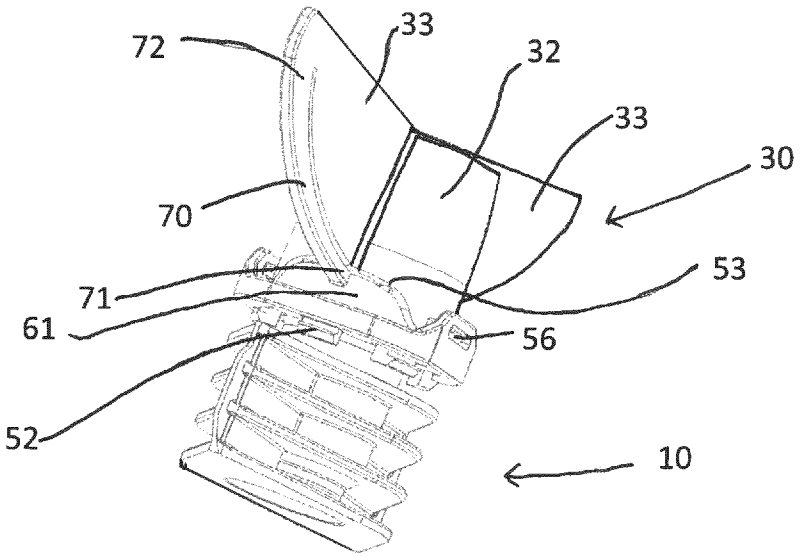
Figure 25:
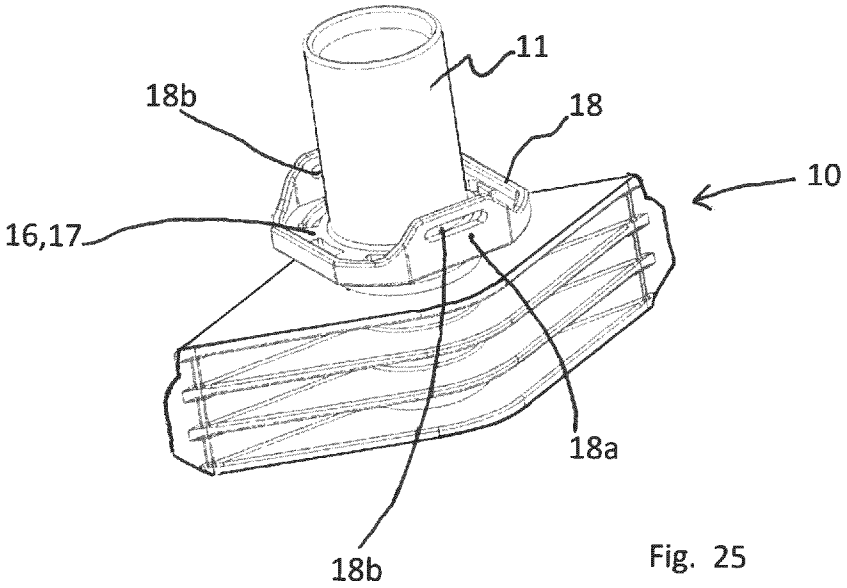
Figure 27:
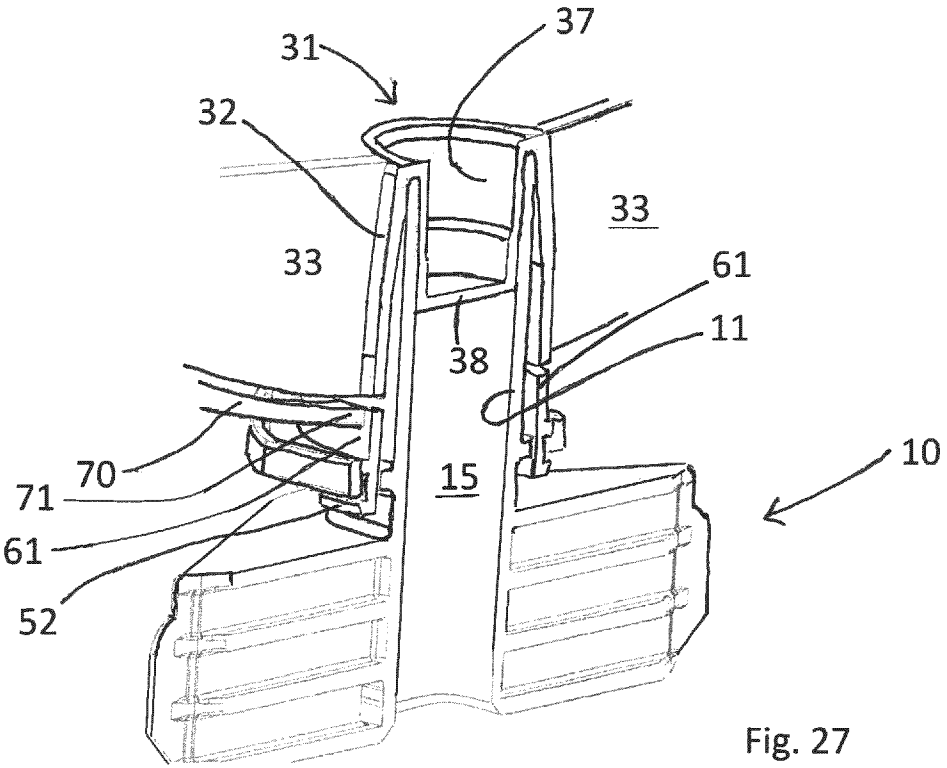
Figure 33:
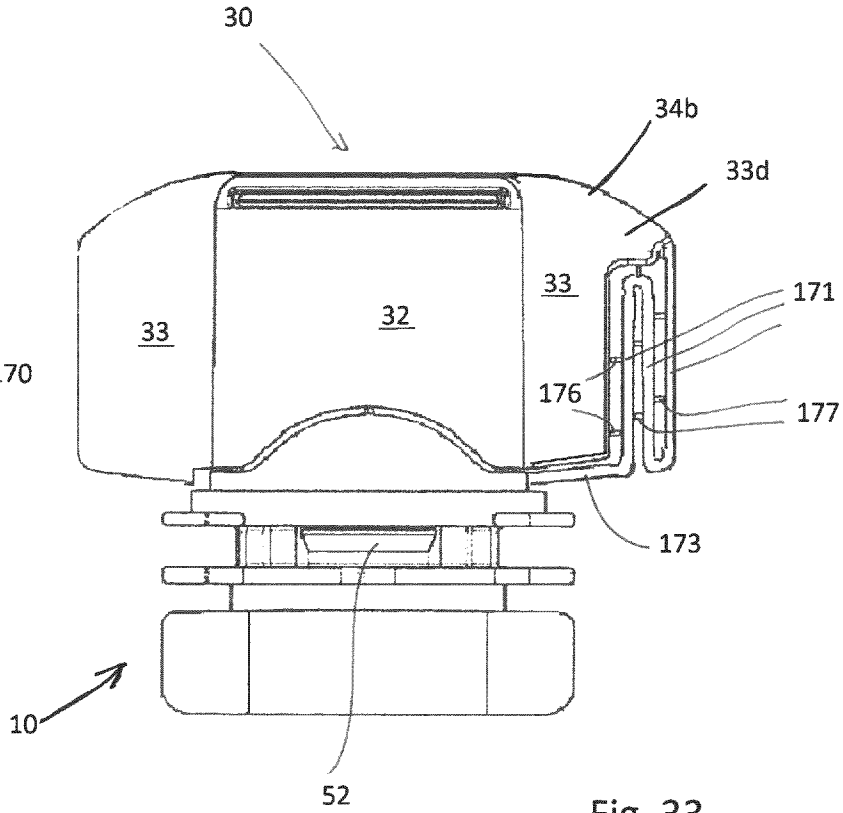
Figure 32:
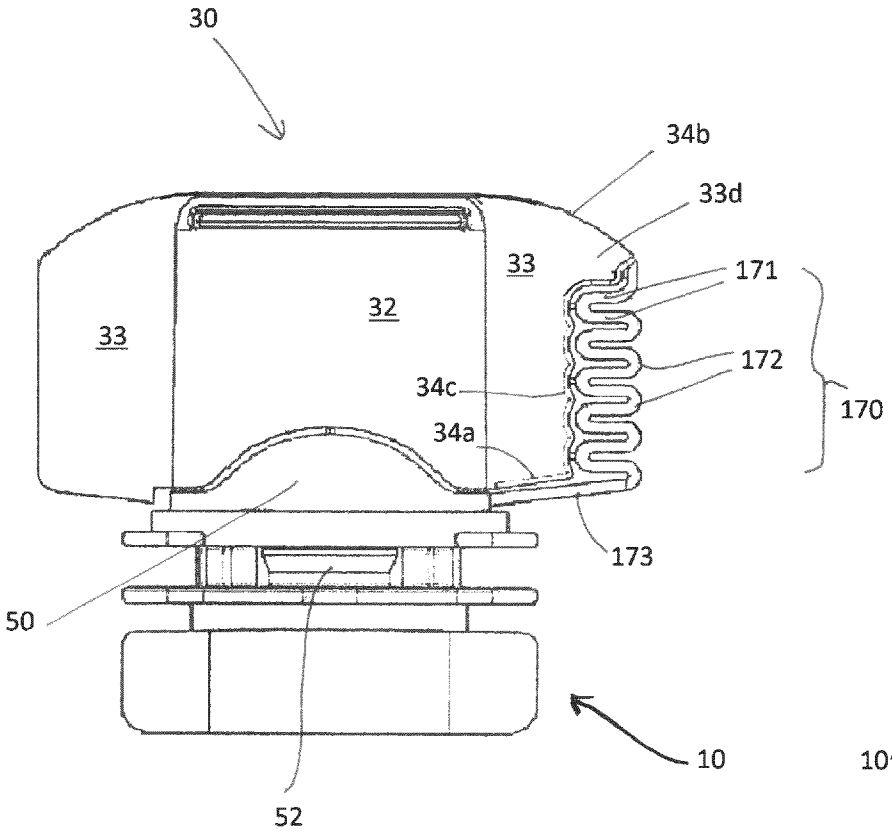
Figure 34:
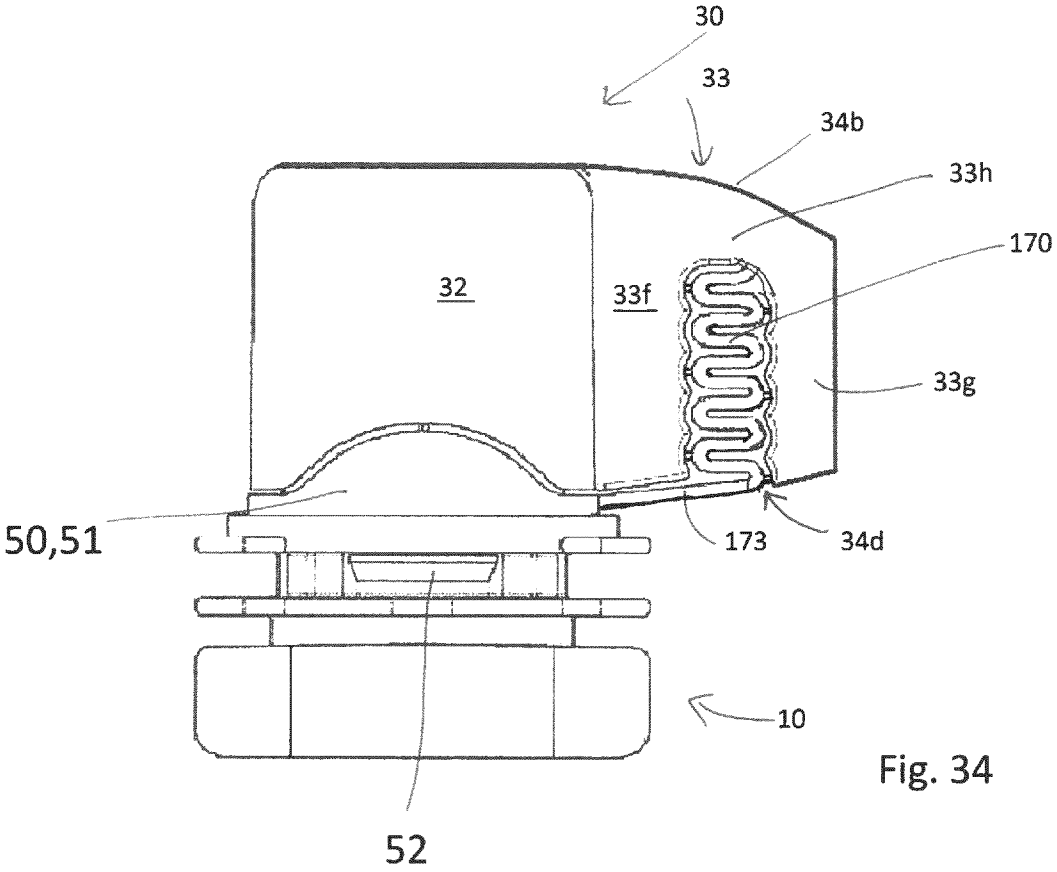
Figure 35:
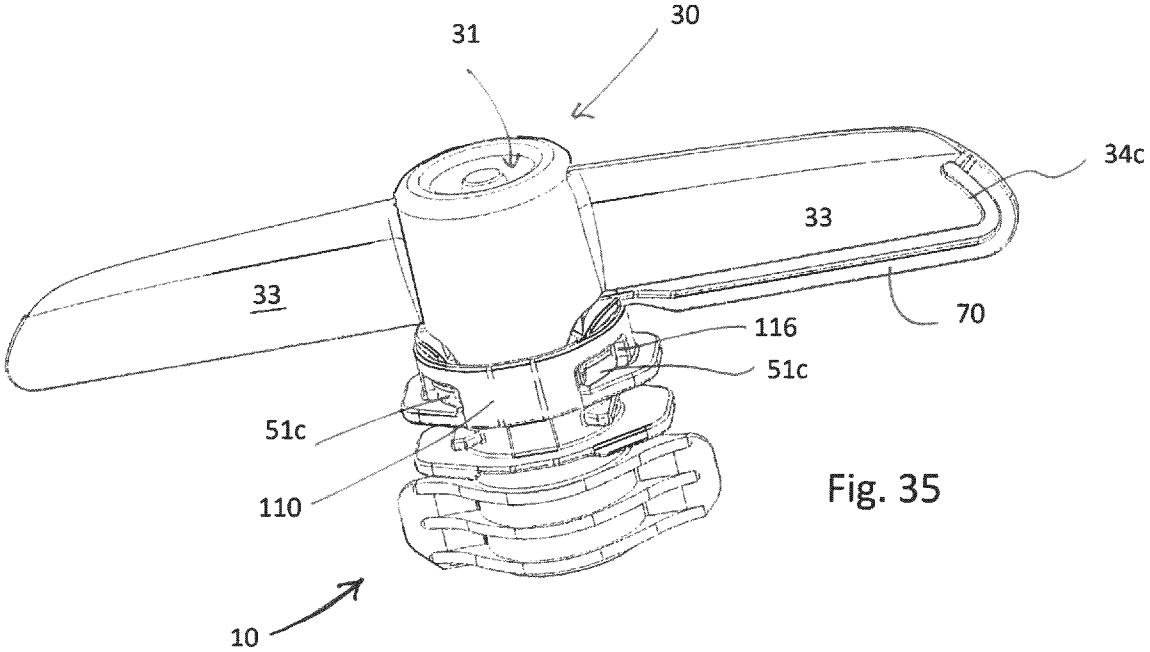
Figure 37:
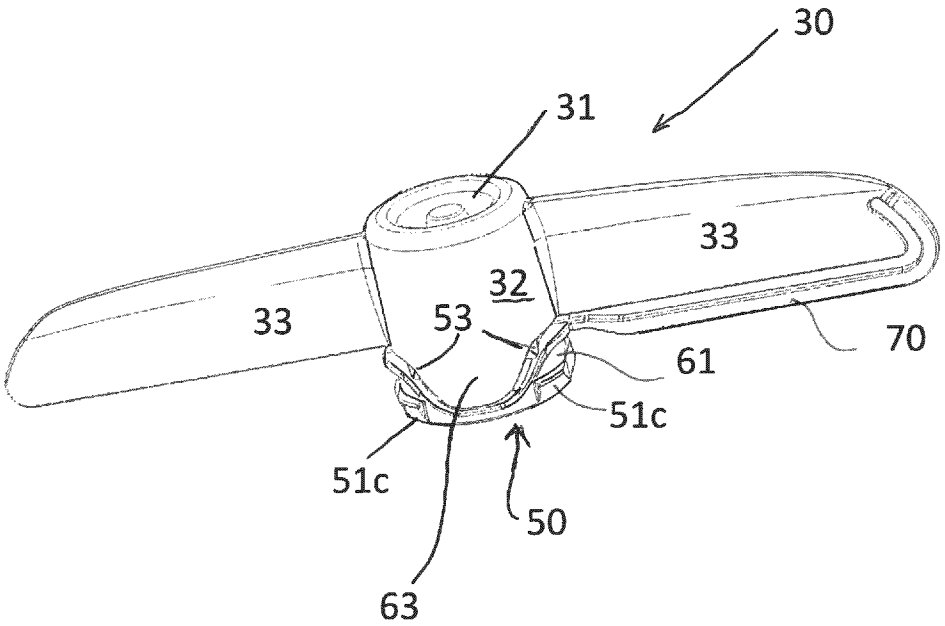
Figure 36:
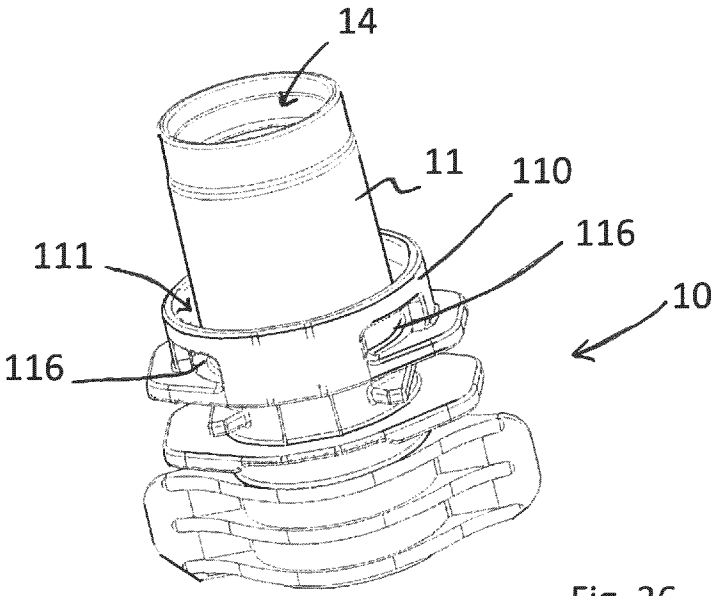
Figure 38:
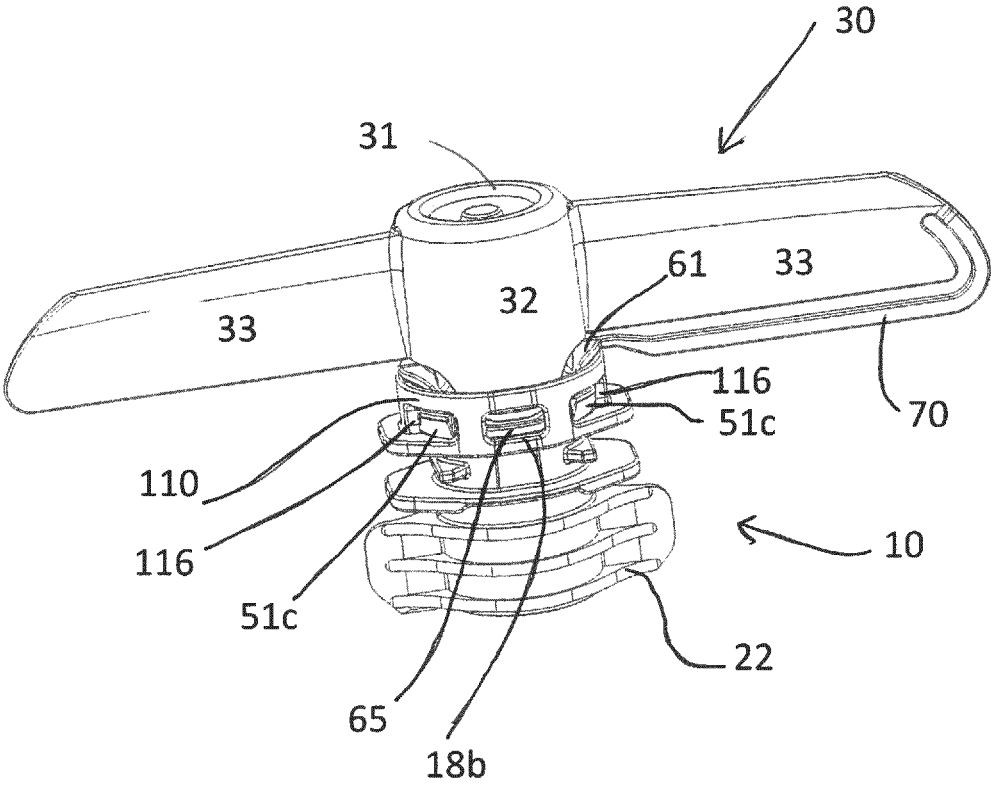
Figure 39:
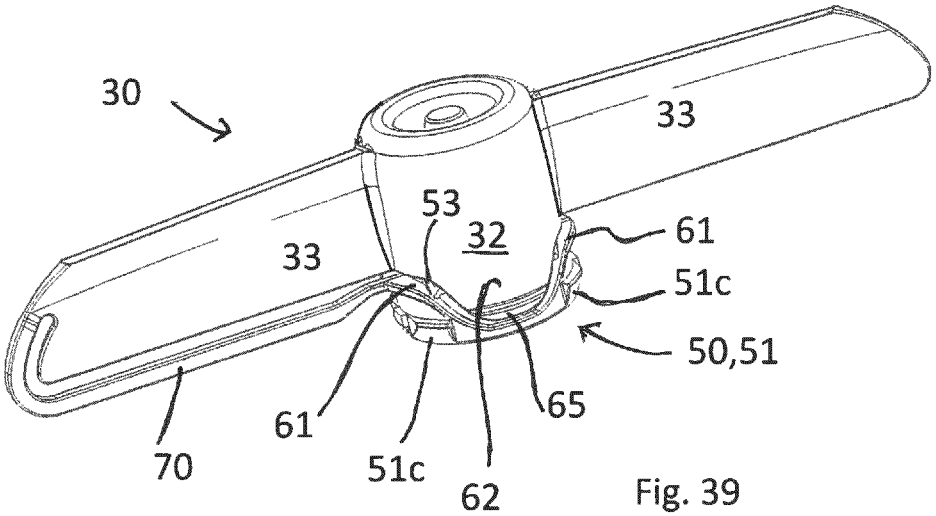
Figure 40:
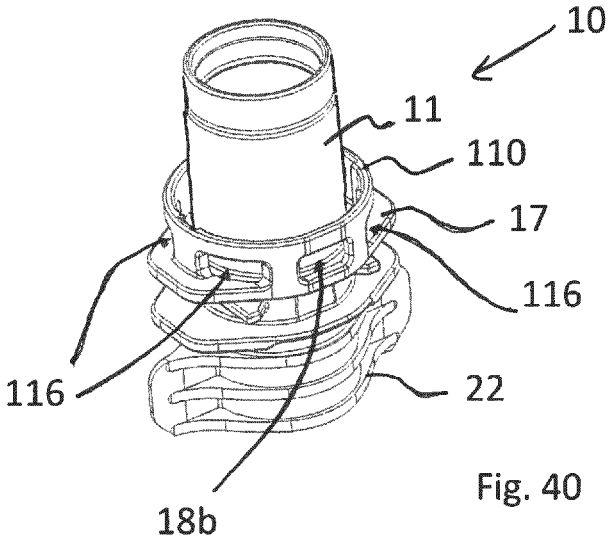
Figure 41:
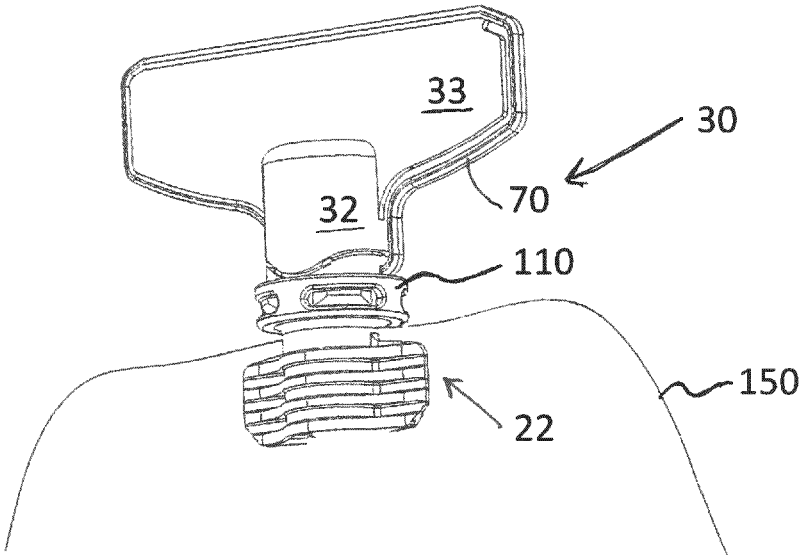
Figure 42:
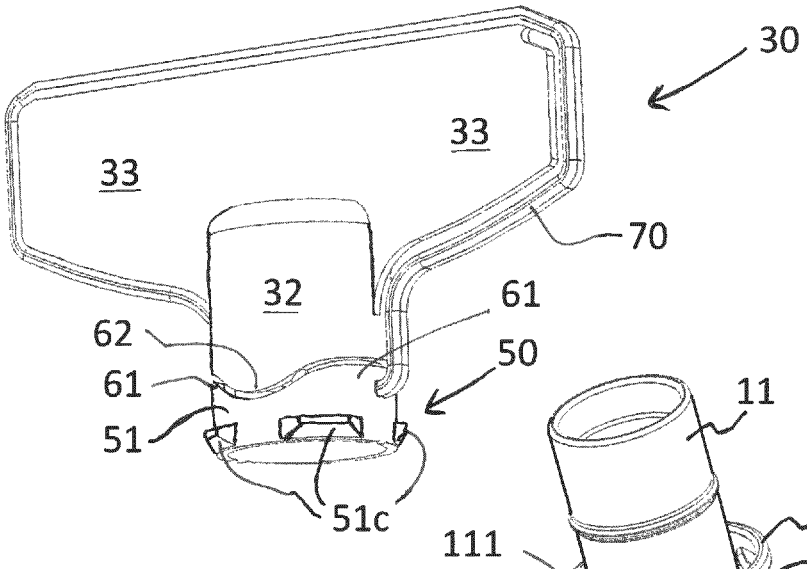
Figure 43:
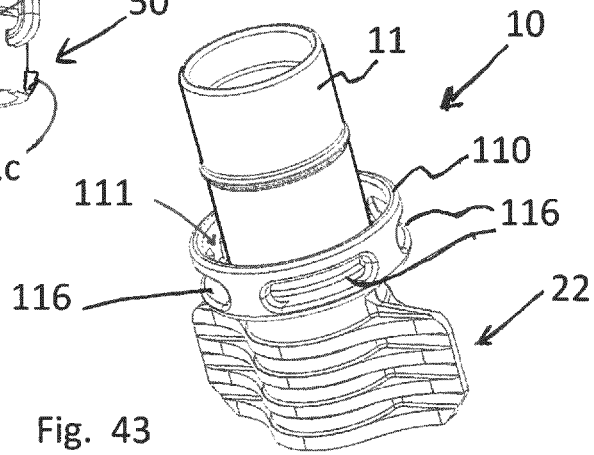
Figure 44:
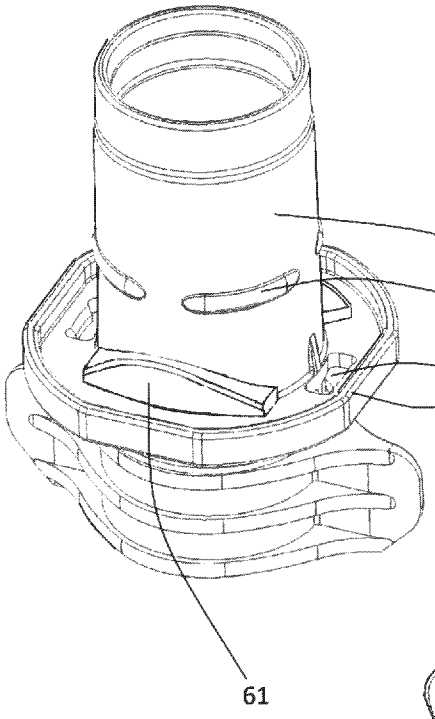
Figure 45:
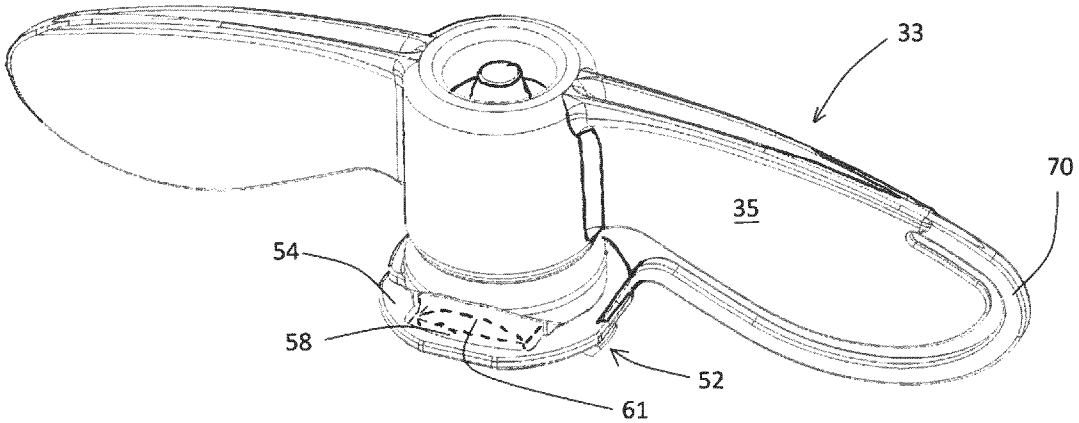
Figure 46:
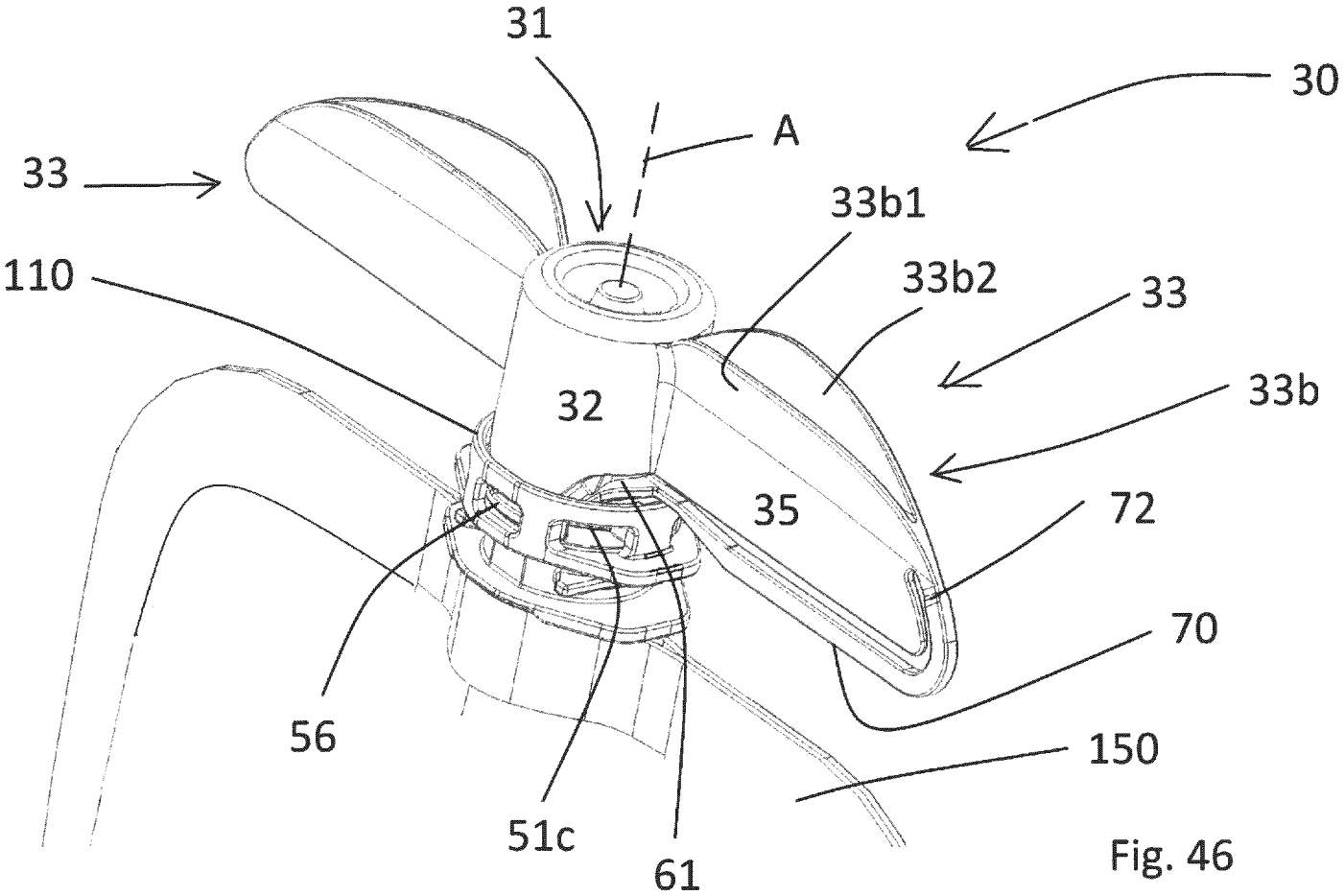
Figure 47:
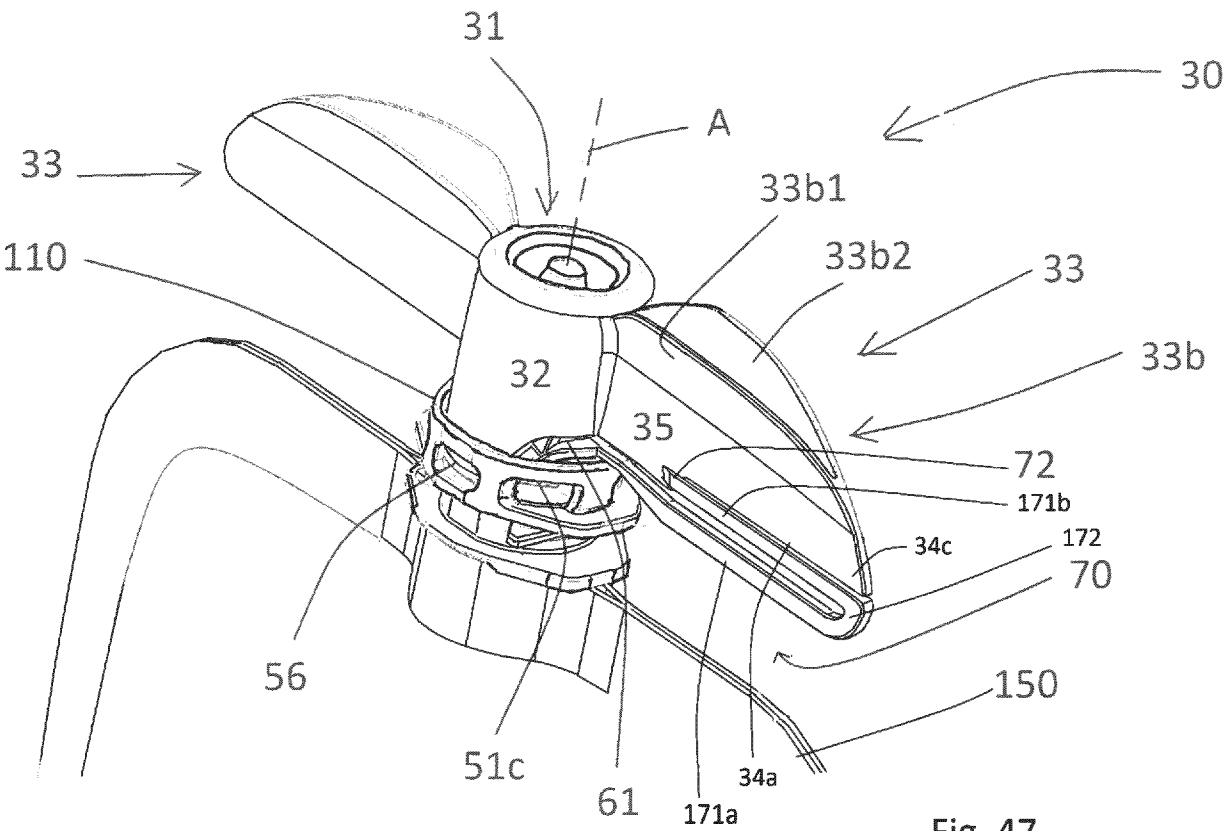
Figure 48:
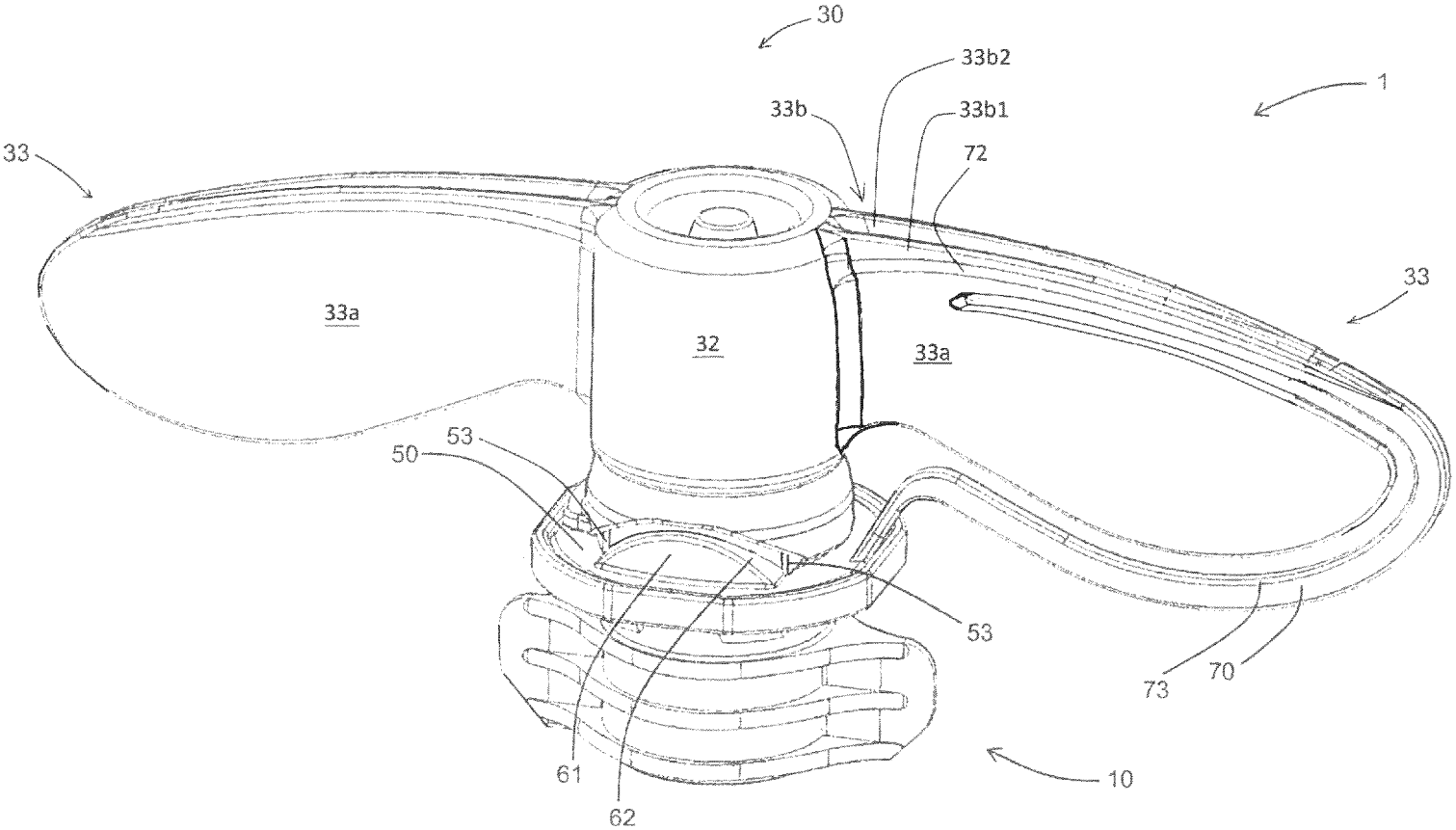

The invention and various aspects thereof will now be described with reference to the drawings. In the drawings:

FIG. 1 shows a first example of a closure assembly according to the invention in assembled state, FIG. 2 shows the closure assembly of FIG. 1, in a perspective view from below, FIG. 3 shows the closure assembly of FIG. 1, in side view, FIG. 4 shows a cross-section of the closure assembly of FIG. 1 in a vertical plane that is in common with a panel portion of the wing-shaped handle, FIG. 5 shows a cross-section of the closure assembly of FIG. 1, in a perspective view, FIG. 6 shows the cap of the closure assembly of FIG. 1, in a perspective view, FIG. 7 shows the cap of the closure assembly of FIG. 1, in a perspective view from below, FIG. 8 shows a cross-section of the cap of the closure assembly of FIG. 1 in a vertical plane that is in common with a panel portion of the wing-shaped handle, FIG. 9 shows a cross-section of the cap of the closure assembly of FIG. 1 in a vertical plane that is perpendicular to the vertical plane that is in common with a panel portion of the wing-shaped handle, FIG. 10 shows the article of the closure assembly of FIG. 1, in a perspective view from above, FIG. 11 shows the article of the closure assembly of FIG. 1 in a perspective view from below, FIG. 12 shows a cross-section of the article of the closure assembly of FIG. 1, FIG. 13 shows a second example of a closure assembly according to the invention in assembled state, in a perspective view, FIG. 14 shows a third example of a closure assembly according to the invention in assembled state, in a perspective view, FIG. 15 shows the closure assembly of FIG. 14, in side view, FIG. 16 shows the cap of the closure assembly of FIG. 14, in a perspective view, FIG. 17 shows the cap of the closure assembly of FIG. 14, in side view, FIG. 18 shows the article of the closure assembly of FIG. 14, in a perspective view, FIG. 19 shows the article of the closure assembly of FIG. 14, in side view, FIG. 20 shows a detail of the hinge section of the cap of FIG. 16, in side view, FIG. 21 shows a detail of the hinge section of the cap of FIG. 16, in top view, FIG. 22 shows a another example of a closure assembly according to the invention in assembled state, FIG. 23 shows the closure assembly of FIG. 22, in another perspective view, FIG. 24 shows the cap of the assembly of FIG. 22, FIG. 25 shows the article of the assembly of FIG. 22, FIG. 26 shows yet another perspective view of the assembly of FIG. 22, FIG. 27 shows a vertical cross-section, offset from the main axis of the assembly of FIG. 22, FIG. 28 shows in side view a cap of a further closure assembly according to the invention, FIG. 29 shows in side view the article to be combined with the cap of FIG. 28, FIG. 30 shows in side view the interference fit plug of the assembly with the cap of FIG. 28 and the article of FIG. 29, FIG. 31 shows in side view the closure assembly obtained with the cap of FIG. 28, the article of FIG. 29, and the plug of FIG. 30, FIG. 32 shows in side view an alternative closure assembly according to the invention, FIG. 33 shows in side view a further alternative closure assembly according to the invention, FIG. 34 shows in side view a further alternative closure assembly according to the invention, FIG. 35 shows yet another closure assembly according to the invention, FIG. 36 shows the article of the closure assembly of FIG. 35, FIG. 37 shows the cap of the closure assembly of FIG. 35, FIG. 38 shows yet another closure assembly according to the invention, FIG. 39 shows the article of the closure assembly of FIG. 38, FIG. 40 shows the cap of the closure assembly of FIG. 38, FIG. 41 shows a pouch provided with yet another closure assembly according to the invention, FIG. 42 shows the cap of the closure assembly of FIG. 41, FIG. 43 shows the article of the closure assembly of FIG. 41, FIG. 44 shows the article of yet another embodiment of a closure assembly according to the invention, FIG. 45 shows the cap of the closure assembly of which the article is shown in FIG. 44, FIG. 46 shows yet another closure assembly according to the invention, FIG. 47 shows yet another closure assembly according to the invention, FIG. 48 shows yet another closure assembly according to the invention.

With reference to FIGS. 1-12 a first example of a closure assembly according to the invention will be described in more detail.

FIG. 1 shows a closure assembly 1 in assembled stated. As explained, in an embodiment, this pre-assembled closure assembly can be fitted to a container, e.g. a collapsible pouch container.

The closure assembly 1 is composed of two components, namely on the one hand an article 10, here embodied as a spout 10, and on the other hand a cap 30 provided with an integrated tamper-evident ring member 50 and an integrated strap 70.

The spout 10 is made, e.g. injection moulded, of a plastic material and forms a tubular neck 11 around a product passage 13 in the spout. The neck has a main axis A, which is discussed herein as being vertical. The neck 11 forms a mouth 14 at a top end of the product passage 13. It will be appreciated that the term vertical, as well as top, bottom, upper, lower, etc. are merely used to identify relative orientation and location of components and details thereof in the closure assembly. In practical use the spout or other article may be arranged at the top of a container, e.g. pouch container, but also other arrangements, e.g. the neck facing sideways, being inclined, facing downwards, etc. are comprised within the invention.

The spout 10 further comprises a circumferential flange structure 16 which comprises an annular flange portion 17 that is integrally formed, e.g. injection molded, to the neck 11 and extends around the neck 11. The flange portion 17 has a top face 17*a*, a bottom face 17*b*, and a periphery 17*c*, here a circular outer contour periphery.

The flange structure 16 further comprises a peripheral protective rim portion 18 that is integral to and extends upwards from the flange portion 17 at the periphery 17*c* thereof, so that the top face 17*a* of the flange portion 17 and the protective rim portion 18 define an annular recess 19 around the neck 11.

The spout 10 represents one embodiment of a fitment that is configured to be secured to a container body, e.g. of a collapsible pouch container.

The spout 10 has a lower connector portion 22, here embodied as a seal boat, that is adapted to be secured, e.g. by heat-sealing, between opposed film walls of a collapsible pouch container. The neck 11 extends upwards from the top of the lower connector portion 22. In this example, the seal boat portion 22 is provided with horizontal welding ribs 22*a,b,c* in vertically spaced apart horizontal planes, the ribs serving to be welded to the film walls of the pouch container as is known in the art.

In another embodiment, the lower connector portion 22 may be embodied with a lower circumferential flange or plate portion that is adapted to be secured or secured onto a panel of a container, e.g. a panel of a carton or a wall of a collapsible pouch.

The cap 30 that is provided with the integrated tamper-evident ring member 50 and the integrated strap 70 is made, e.g. injection moulded, as one piece of a plastic material.

The cap 30 with ring member 50 and strap 70 is adapted to be secured on the neck 11 of the spout 10 and is adapted to be manually removed from the neck 11 of the article 10 by a user to open the product passage 13.

The cap 30 has a closed position and an open position, wherein in the closed position the cap 30 is positioned on the neck 11 thereby sealing the product passage 13. This position is shown in FIGS. 1-5. In the open position, the cap 30 is removed from the neck 11, thereby leaving the product passage 13 open.

The cap 30 has a top wall structure 31 and a downward depending skirt 32.

As illustrated in FIGS. 4 and 5 the top wall structure 31 may comprises a W-seal arrangement protruding into the neck 11. Herein the W-seal arrangement comprises a downward projecting bulbous and annular top wall section around a central raised top wall section. It will be appreciated that the top wall structure 31 could have other designs, e.g. like a substantially planar disc, or with a downwardly protruding hollow pin design that fits inside the neck to provide a seal at a position well below the mouth, etc.

The skirt 32, as shown in FIG. 9, has an interior side 32*a*, an exterior side 32*b*, and a lower edge 32*c* that is remote from the top wall structure 31.

The tamper-evident ring member 50 comprises an annular base portion 51 that is integrally formed to the lower edge 32*c* of the skirt 32 of the cap 30 and is connected to this lower edge via one or more breakable bridges 53.

In the depicted embodiment, the breakable bridges 53 are distinct small structures that break upon first time opening, distributed about the ring member 50. In another embodiment, a breakable bridge is embodied as a thin zone where the skirt adjoins the base portion, e.g. like a thin film zone, that breaks upon first time opening.

The cap 30 is adapted to seal the product passage 15 in the closed position of the cap on the neck 14.

The cap 30 is adapted to be manually removed from the neck 11 by a user to open the product passage 13. In this example, as preferred in the context of the invention, the cap 30 is a quarter-turn type opening snap-on type cap, so that rotating the cap over about a quarter turn causes sufficient lift to disengage a snap retention of the cap on the neck and also to break the breakable bridges 53 as will be discussed below.

The annular base portion 51 of tamper-evident ring member 50 comprises an annular ring member flange portion 54 that has a top face 54*a*, a bottom face 54*b*, an inner face 54*c* directed to the neck 11, and an outer face 54*d* as shown in FIG. 9.

Multiple hook members 52 are integrally formed to the bottom face 54*b* of the ring member flange portion 54. These hook members 52 are distributed in a circumferential direction of the ring member flange portion 54.

Each hook member 52 comprises a resilient leg 52*a* having an upper end integral with the ring member flange portion 54 and protruding downward from the ring member flange portion 54. Each hook member 52 further comprises a hook portion 52*b* at the lower free end of the leg 52*a*. In the depicted embodiment, as practically preferred, the hook portion 52*b* is directed outwards. As preferred, the flange portion 54 extends further outwards than the hook portion 52*b*.

The annular flange portion 17 on the neck 11 of the spout 10 is provided with multiple hook member passages 15, distributed in circumferential direction about the neck, which passages 15 each extend between the top face 17*a* and the bottom face 17*b* through this annular flange portion 17.

Each hook member passage 15 is adapted to receive a respective hook member 52 when the cap 30 with the integrated tamper-evident ring member 50 and integrated strap 70 is secured on the neck 11. Herein the hook portion 52*b* of each hook member 52 engages, e.g. snaps, underneath the bottom face 17*b* of the annular flange portion 17 on the neck 11 of the spout 10.

The periphery of the annular flange portion of the ring member 54, here of non-circular contour, is shaped to fit within the, here equally non-circular contoured, protective rim portion 18 as the annular ring member flange portion 54 is inserted in the annular recess 19 upon mounting of the cap 30 with the integrated tamper-evident ring member 50 and integrated strap 70 on the neck 11.

It will be appreciated that the adjoining contours of the annular flange portion 54 and of the rim portion 18 may also be of other non-circular designs, e.g. square, hexagonal, oval, etc.

The mating non-circular contours may be present in view of an anti-rotation locking effect, so that the ring member 50 is hindered from rotating about the neck. The same anti-rotation effect may also, or alternatively, be provided for by other measures, e.g. by the hook members and their corresponding passages, and/or by mating reliefs on the adjoining lower face of the flange portion 54*b* and upper face of the flange portion 17*a*. In an embodiment, the adjoining contours of the annular flange portion 54 and of the rim portion 18 may be circular.

The peripheral protective rim 18 is configured to obstruct a lateral access from the outside to the interface between the top face 17*a* of the flange portion 17 of the spout 10 and the bottom face 54*b* of the flange portion 54 of the ring member 50. For example one cannot access said interface by biting on the assembly, e.g. when used in combination with a child food or beverage container, or with cutlery, e.g. a knife, etc. in an attempt, e.g. unconscious, to dislodge the ring member 50, possibly along with the cap 30, from the spout 10.

The closure assembly 1 is embodied such that upon first time opening of the closure assembly by removal of the cap 30, here a quarter turn of the cap 30, by a user the one or more breakable bridges 53 break and the ring member 50 is retained in the recess 19 of the spout 10 by means of the hook members 52.

As shown here it is preferred that the protective rim portion 18 is devoid of openings therein. This strengthens the portion 18, and thus the entire circumferential flange structure, and further reduces the possibility for lateral access to the ring member 50.

The protective rim portion 18 has a height such that in the secured position of the cap provided with the integrated tamper-evident ring member an outer annular zone of the top face 54*a* of the flange portion 54 thereof does not protrude above the protective rim portion 18. Even more preferred, this outer annular zone of the top face is located lower than the top of the rim portion 25. Hereby access to the flange portion 54 is difficult.

As illustrated, e.g. in FIGS. 10, 11 and 12 the hook members passages 15 are located directly adjoining the neck 11, e.g. radially spaced from the rim portion 18.

The closure assembly 1 here, as preferred, comprises a snap-on type cap 30 providing in use of the closure assembly a snap-on functionality so that the securing motion causes the cap 30 to snap onto the neck 11.

Here, as preferred, the interior side 32*a* of the skirt 32 of the cap 30 and the exterior side 11*a* of the neck 11 of the article 10 have co-operating snap connector formations 21,34. A first snap ridge 21 is provided on the exterior side 11*a* of the neck 11, between the mouth 14 and the circumferential flange structure 16, and a second snap ridge 34 is provided on the interior side 32*a* of the skirt 32 in order to provide the snap-on functionality.

As preferred and as shown the first snap ridge 21, axially spaced from the circumferential flange structure 16, is formed by a series of snap ridge segments that are circumferentially spaced from one another.

The inside 32*a* of the skirt 32 of the cap 30 here forms a circumferentially continuous snap ridge 34. For example, the snap-on type cap 30 can be replaced on the neck 11 after first time opening, with the snap features 21, 34 properly retaining the cap 30 on the neck 11.

As shown, the snap ridge 34 may be formed by a local narrowing of the skirt 32.

As shown, e.g. in FIG. 9, below the snap ridge 34 the skirt 32 may widen in diameter in direction downwards from the snap ridge 34. This facilitates replacing the cap 30 back onto the neck 11, when it is desired to reclose the closure assembly.

In order to facilitate the opening of the closure assembly by the user, who is here expected to turn the cap 30 over a quarter turn for opening of the closure, the closure assembly comprises:

at least one first cam portion 61 defining a cam surface 62, which cam surface 62 is angled with respect to the main axis A, seen when the cap 30 with ring member 50 are secured on the neck 11, which first cam portion 61 is integrally formed on the flange portion 54 of the tamper-evident ring member 50, and at least one second cam portion 63 defining a cam follower surface 64 adapted to interact with the cam surface 62 of the first cam portion 61, which second cam portion 63 is integrally formed on the lower edge 32*c* of the skirt 32, wherein—upon first time opening of the closure assembly by rotation of the cap 30 relative to the spout 10 about the main axis A—the first and second cam portions 61, 63 interact in order to cause axial lifting of the cap 30 relative to the neck 11, so that the co-operating snap connector formations 21 and 34 disengage.

As illustrated, as preferred, cam follower surface 64 and cam surface 64 are spaced from one another by a narrow gap that is bridged by the one or more breakable bridges 53.

In the illustrated embodiment, each first cam portion 61 has an arched first cam surface 62 with a centre 62*a* raised above, or higher than, the flange portion 54 and with a first and second ends 62*b,c* where the arched first cam surface 62 adjoins the top face 54*a* of the flange portion 54. A breakable bridge 53 is present at each end 62*b,c* of the upwardly arched first cam surface 62.

Preferably, the bridges 53 in the pair of breakable bridges 53 associated with each of the first cam portions 61 of the ring member 50 are not arranged symmetrically such that, once the cap is removed and then placed back on the neck in a position 180° rotated relative to the initial molded position, the remains of each of the bridges 53 do not line up. They would do so of the arrangement of the bridges 53 was symmetrical. Due to this arrangement any tampering may be better visible. Of course, embodiments are possible with another arrangement and/or other number of breakable bridges between the lower edge of the skirt of the cap and the ring member 50.

In an embodiment, each second cam portion 63 comprises an outwardly extending tab 65 that is integrally formed at the lower end of the skirt 32 and is adapted to cooperate with the first cam surface 61. In an embodiment, the cap has two diametrically opposed tabs 65 configured to cooperate with first cam portions in the process of opening the closure.

In order to enhance grip on the cap and/or to enhance anti-choke properties of the cap 30, the cap has two diametrically opposed, substantially planar wing-shaped handles 33 that extend outwardly from the skirt 32 in an imaginary vertical plane through the main axis A of the neck 11.

It can be seen that at least one pair of hook members 52 and corresponding hook member passages 15 is located on diametrically opposite locations relative to the neck 11 and in the imaginary vertical plane through the panel portions 35 of the wing-shaped handles 33 of the cap 30.

It can be seen that at least one hook member 52, here as preferred two hook members 52, and corresponding hook member passages 15 are located on diametrically opposed locations relative to the imaginary vertical plane through the panel portions 35 of the cap 30.

In the illustrated embodiment, each wing-shaped handle 33 have, seen in side view thereon, an outer periphery 34 comprising a bottom side 34*a*, a top side 34*b* and a tip 34*c* remote from the skirt 32 where said bottom side 34*a* and top side 34*b* adjoin. This can be seen for example in FIG. 8.

In the illustrated embodiment, the tip 34*c* is a rounded tip, but it will be appreciated that the tip and by extension the wing-shaped handle may also be of other designs.

In order to avoid that the cap 30 becomes separated from the article 10, the cap 30 comprises an integrally formed strap 70. The strap 70 is integral at a first end 71 thereof to the annular base portion 51 of the tamper-evident ring 50 and integral at a second end 72 thereof to one of the wing-shaped handles 33. The strap 70 is adapted to remain connected to both the annular base portion 51 of the tamper-evident ring member 50 and the wing-shaped handle 33 upon removal of the cap 30 from the neck 11 by the user. Since, as explained above, the annular ring member flange portion 54 of the tamper-evident ring member 50 is retained on the article 10 upon opening of the closure assembly 1 and the strap 70 is integral to the tamper-evident ring member 50, the cap 30 will remain connected to the article 10 by means of the strap 70 upon opening of the closure assembly 1 by the user.

It can be seen that the strap 70, prior to first time removal of the cap 30 by the user, is located in a vertical plane that is in common with panel portions 35 of the wing-shaped handles 33.

The panel portions extend outward from the skirt and are mainly vertical, e.g. fully vertical or tilted somewhat to the vertical.

In the illustrated embodiment, the strap 70 extends outward from the annular base portion 51 of the tamper-evident ring member 50 towards the tip 34*c* of the wing shaped handle 33 along the bottom side 34*a* of the wing-shaped handle 33, further about the tip 34*c*, and along a portion of the top side 34*b* of the wing-shaped handle to the second end 72 of the strap 70.

The strap 70 comprises a strap inner contour side 73, facing towards the wing-shaped handle 33 prior to the first time removal of the cap 30, and a strap outer contour side 74, facing away from the wing-shaped handle 33 prior to the first time removal of the cap 30.

It is illustrated in FIGS. 1-12 that the cap 30 may have a design of the one or more wing-shaped handles as disclosed in WO2018/194454. At least one handle 33, preferably each handle 33, has a panel portion 35 and at least one reinforcing top protrusion 33*b* that is integral with the panel portion along at least a part of the top side 34*b* of the handle 33. This at least one top protrusion 33*b* reinforces the handle 33, e.g. allowing for the panel portion 33 to be relatively thin and thereby saving plastic material.

In embodiments, each panel portion 35 has a thickness of less than 2 millimetres, e.g. between 0.5 and 1 millimetres.

Each top protrusion 33*b* protrudes away from the face of the panel portion, that is for example vertical or near vertical, in a direction substantially in or opposed to the opening direction of the cap.

In the depicted embodiment, the handle 33 has two diverging top protrusions 33*b*1, 33*b*2 that extend inclined upward from the panel portion 35 at the top side 34*b* and which diverge from one another defining a Y-shaped vertical cross-section of the wing shaped handle 33 together with the panel portion 35. In alternative embodiments, each handle 33 could have one top protrusion, e.g. defining an inverted L-shaped cross-section together with the panel portion. Or, in yet another embodiment, each handle could have two oppositely directed top protrusions defining with the panel portion a T-shaped cross-section of the handle.

As shown, and as preferred, the second end 72 of the strap 70 adjoins the outer end of such a reinforcing top protrusion 33*b* that is integral with the panel portion along at least a part of the top side 34*b* of the handle 33.

Even when at least one reinforcing top protrusion 33*b* is present in the handle 33 that attaches to the strap 70, this handle 33 may still show flexing behaviour upon opening the cap 30, e.g. by turning the cap over a quarter turn. This flexing behaviour may effectively "lengthen" the strap 70 in order to allow for sufficient rotation of the cap for its opening.

In embodiments the wing-shaped handle or handles 33 only has/have a panel portion 35 with planar and parallel faces and no reinforcements of the panel portion are present. Depending on the thickness of the panel portion 35, e.g. between 0.5 and 1 millimetres, the handle 33 will then flex during opening of the cap, which may be beneficial as it effectively lengthens the strap 70 to allow for sufficient rotation of the cap 30.

With reference to FIG. 13 a second example of a closure assembly according to the invention will be described in more detail. The same reference numerals as in the first example are used to indicate the same components.

The closure assembly 1 comprises an article 10 and a cap 30 provided with an integrated tamper-evident ring member 50, an integrated strap 70 and a pair of wing-shaped handles 33.

In this example, the strap 70 extends outward from the annular base portion 51 towards, yet not to, the tip of 34*c* of the wing-shaped handle 33 to the second end 72 which is inward of the tip 34*c* of the wing-shaped handle 33. Herein the strap 70 extends underneath a panel portion 35 of the wing-shaped handle 33 and lies in the same plane as said panel portion 35.

With reference to FIGS. 14-21 a third example of a closure assembly according to the invention will be described in more detail. The same reference numerals as in the first example are used to indicate the same components.

The closure assembly 1 comprises an article 10 and a cap 30 provided with an integrated tamper-evident ring member 50, an integrated strap 70 and a pair of wing-shaped handles 33.

In this example, the strap 70 extends outward from the annular base portion 51 of the tamper-evident ring member 50 towards the tip 34*c* of the respective wing-shaped handle 33 along the bottom side 34*a* of the wing-shaped handle 33, further about the tip 34*c*, and along a portion of the top side 34*b* of the wing-shaped handle 33.

In the illustrated embodiment, the strap 70 comprises a hinge section 75, preferably a hinge section 75 wherein the cross-section, here the thickness perpendicular to the plane portion 35 of the respective wing-shaped handle 33, of the strap 70 is reduced in order to allow the strap 70 to easily bend at the hinge. In this example, the hinge allows for pivoting the cap 30 in and out of the plane of the wing-shaped handle. Preferably, the hinge section 75 is located at the second end 72 of the strap 70 where the strap 70 connects to the wing-shaped-handle 33.

With reference to FIGS. 22-27 a fourth example of a closure assembly according to the invention will now be discussed. The same reference numerals as in the first example are used to indicate the same components.

The depicted closure assembly comprises article 10 and cap 30. The cap 30 includes integrated tamper-evident ring member 50 and integrated strap 70. The tubular neck 11 forms a mouth 14 at a top end of the product passage.

The cap 30 is made, e.g. moulded, as one piece of a plastic material and distinct from the article 10. The cap 30 is secured on the neck 11 and is adapted to be manually removed from the neck of the article by a user to open the product passage.

The cap comprises a top wall structure 31 and a downward depending skirt 32 having an interior side, exterior side, and a lower edge remote from the top wall structure.

The annular top wall has an inner perimeter and an outer perimeter, wherein the downward depending skirt 32 is integral with the outer perimeter. A hollow pin portion 37 depends from the inner perimeter. The hollow pin portion has a circumferential face extending along a length thereof and a closed pin bottom 38. The hollow pin portion 38 is open at a top thereof. As depicted the circumferential face of the hollow pin portion 37 and the article 10 have at least one pair of cooperating sealing surfaces such that hollow pin portion, in the closed position cap, closes the product passage 15.

A tamper-evident ring member 50 is integrally formed to the lower edge of the skirt 32 of the cap. The tamper-evident ring member comprising a base portion, preferably as shown here an annular base portion 51. This base portion is connected via one or more breakable bridges 53 to the skirt 32. The base portion 51 is configured to remain connected to the article upon removal of the cap 30 from the neck 11 of the article by the user.

The cap 30 is a snap-on type cap, here a quarter turn lift cap 30, providing in use of the closure assembly a snap-on functionality so that the cap 30 can be replaced on the neck 11 after first time opening, e.g. if the user wants to close the assembly while some product remains in the container to which the assembly is fitted.

The article and the cap are provided with cooperating snap connector formations to provide the snap-on functionality.

It is illustrated that the skirt 32 of the cap 30 on the one hand and a circumferential flange structure 16, 17 of the article, e.g. a flange structure 16, 17 extend around the neck, have co-operating snap connector formations to provide the snap-on functionality of the cap.

It is illustrated that peripheral rim portion 18 extending around the perimeter of a circumferential flange structure 17 of the article on the one hand and the exterior side of the skirt 32 of the cap having co-operating snap connector formations.

It is illustrated here that the peripheral rim portion 18 has a recess or window 18*b* and the skirt 32 is provided with a latching tab 65 that is snapped into said recess or window 18*b* in the closed position of the cap 30, so upon removal of the cap the tab 65 becomes unsnapped and released from the window or recess.

It is illustrated here that a flange structure 17 of the article, e.g. a peripheral rim 18 thereof, is provided with at least one upwardly protruding latch wall portion 18*a* having a window 18*b* or recess therein and the exterior side of the skirt is provided with a latching tab 65 that is snapped into said window 18*b* or recess in the closed position of the cap 30.

It is illustrated here that the flange structure 17 of the article is provided with two latch wall portions 18*a* at diametrically opposed locations relative to the neck 11 of the article 10, e.g. each arranged at the perimeter of a circumferential flange that extends around the neck 11. The cap 30 is provided with two latch tabs 65, at diametrically opposed locations, which latch tabs 65 are each received in a corresponding recess or window 18*b* in a latch wall portion 18*a* to snap the cap onto the article. This snap arrangement remain functional after first time removal of the cap 30 from the article, e.g. allowing a user to place the cap 30 back onto the article.

The cap 30 comprises at least one wing-shaped handle 33, here as preferred a single pair of wing-shaped handles. These one or more wing-shaped handles each extend outwardly from the skirt 32 of the cap 30, for example (as here) in mutually opposite directions. The handles are configured to be engaged by a user for removal of the cap 30.

The wing-shaped handles 33 each have, seen in side view thereon, an outer periphery 34 comprising a bottom side, a top side, and a tip remote from the skirt 32. The bottom side and the top side adjoin at the tip 34*c*.

The integrally formed, e.g. moulded, strap 70 is integral at a first end 71 thereof to the annular base portion 51 of the tamper-evident ring member 50 and at a second end 72 thereof integral to one of the wing-shaped handles 33. The strap 70 is adapted to remain connected to both the annular base portion of the tamper-evident ring and the respective wing-shaped handle upon removal of the cap 30 from the neck 11 of the article by the user. The strap 70, prior to first time removal of the cap by the user, is located in a generally vertical plane that is in common with a panel portion of the respective wing-shaped handle 33.

The strap 70, prior to first time removal of the cap by the user, extends outward from the annular base portion 51 of the tamper-evident ring towards the tip 34*c* of the respective wing-shaped handle. As shown in FIGS. 30-35, in an embodiment, the second end of the strap 70 is inward of the tip of the wing-shaped handle 33. The annular base portion 51 of the tamper-evident ring comprises an annular ring member flange portion 54 that has a top face, a bottom face, an inner face, and an outer face.

Multiple hook members 52 are integrally formed to the bottom of the ring member flange portion 54, the hook members being distributed in a circumferential direction of the ring member flange portion, wherein each hook member comprises a leg having an upper end integral with the ring member flange portion and protruding downward from the ring member flange portion, wherein each hook member comprises a hook portion at a lower free end of the leg.

The article further comprises a circumferential flange structure 16 which comprises an annular flange portion 17 that is integrally formed to the neck and extends around the neck, which flange portion 17 has a top face, a bottom face, and a periphery.

The annular flange portion 17 is provided with multiple hook member passages 15 that each extend between the top face and the bottom face through said annular flange portion 17. Each hook member passage being adapted to receive a hook member 52 when the cap 30 is secured on the neck. Herein the hook portion of each hook member engages, e.g. snaps, underneath the bottom face of the annular flange portion on the neck of the article.

The closure assembly of FIGS. 22-27 is embodied such that upon first time opening of the closure assembly by removal of the cap 30 by a user the one or more breakable bridges 53 break and the annular ring member flange portion 17 is retained by means of the hook members 52.

The flange structure 16 further comprises a peripheral protective rim portion 18 that is integral to and extends upwards from the annular flange portion 17 at the periphery thereof, so that the top face of the annular flange portion and the protective rim define an annular recess around the neck.

The periphery of the annular ring member flange portion 54 is shaped to fit within the protective rim portion 18 as the annular ring member flange portion is at least partially inserted in said annular recess 19 upon mounting of the cap 30 with the integrated tamper-evident ring member 50 and strap 70 on the neck.

As explained, the peripheral protective rim portion 18 is adapted to obstruct lateral access from outside to the interface between the top face of the flange portion 17 of the article and the bottom face of the flange portion 54.

The closure assembly of the FIGS. 22-27 provides for said one hook member to have a dual functionality, which on the one hand comprises the role in retaining the base portion 52 of the tamper-evident ring member on the article as the cap 30 is removed and on the other hand comprises the role as anchor for the first end 71 of the strap 70.

It is shown in FIGS. 22-27 that at least one hook member 52 is arranged vertically below the first end 71 of the strap 70. This has the effect that a pulling force exerted on the strap 70 will be passed via a short force path to said hook member vertically below the first end of the strap, and thus to the article. Therefore, relative limited plastic material is required to absorb the pulling force on the strap.

It is further shown in FIGS. 22-27 that the closure assembly comprises:

at least one upwardly directed first cam portion 61 defining a cam surface, which first cam portion 61 is integrally formed on the base portion 52 of the tamper-evident ring member, and at least one downwardly directed second cam portion 63 defining a cam follower surface adapted to interact with the cam surface of the first cam portion, which second cam portion 63 is integrally formed on the lower edge of the skirt 32, wherein—upon first time opening of the closure assembly by rotation of the cap 30 relative to the article about the main axis—the first and second cam portions 61, 63 interact in order to cause axial lifting of the cap relative to the neck 11, e.g. so that the co-operating snap connector formations disengage.

It is illustrated in FIGS. 22-27 that the strap 70 is integral at the first end 71 thereof to the upwardly directed first cam portion 61 of the tamper-evident ring member and at a second end 72 thereof integral to another portion of the cap, here to the wing-shaped handle 33.

It is illustrated here that the flange structure 17 of the article is provided with two latch wall portions 18*a* at diametrically opposed locations relative to the neck 11 of the article 10, e.g. each arranged at the perimeter of a circumferential flange that extends around the neck 11. It is further illustrated here that the annular base portion 51 is provided with two upwardly directed first cam portions 61, that are diametrically arranged relative to the neck 11 and transverse to the two latch wall portions 18*a*.

The closure assembly as illustrated in FIGS. 22-27 provides for the one upwardly directed first cam portion 61 to have a dual functionality, which on the one hand comprises the role in the cam mechanism that causes axial lifting of the cap 30 upon opening of the cap and on the other hand comprises the role as anchoring portion for the first end of the strap. As the first cam portion needs to be relatively robust and sizable to perform the first mentioned role, the portion can also take on the second mentioned role and provide for a robust anchoring of the first end of the strap.

The closure assembly provides for convenient use as the cap can easily be removed by rotation over at most a quarter turn, with the cam mechanism causing the lift of the cap. This arrangement allows for a limited length of the strap 70, e.g. allowing for its combination with a wing-shaped handle as discussed herein.

In an embodiment at least one hook member 52 is arranged vertically below the upwardly directed first cam portion 61. It is shown that one hook member is located below a central region of the upwardly directed first cam portion 61 and that two further hook members 52 are located below a first and a second end of the upwardly directed first cam portion respectively.

The embodiment of FIGS. 22-27 illustrates that the article 10, e.g. a flange structure 16, 17 of the article, is provided with two latch members 18*a*, e.g. two latch wall portions, at diametrically opposed locations relative to the neck 11 of the article, e.g. each arranged at the perimeter of a circumferential flange 16 that extends around the neck, and that the cap 30 is provided with two mating latch members, e.g. two latch tabs 56, at diametrically opposed locations, which latch members 18*a* on the article and latch members 56 on the cap are configured to provide a releasable and reusable snap connection between the cap 30 and the article 10. As shown here the latch tabs 56 on the cap are each configured to be received or are received in a corresponding recess or window 18*b* in a latch wall portion 18*a* of the article allowing to snap the cap onto the article, e.g. in the axial securing motion of the cap 30 onto the neck 11.

It is shown in FIGS. 22-27 that the cap 30 has two downwardly protruding second cam portions 62, at diametrically opposed locations, wherein each mating latch member, here latch tabs 56, is provide externally on a respective downwardly protruding second cam portion 62. Herein the base portion 51 has two cooperating upwardly directed first cam portions 61. As preferred, the strap 70 is integral at the first end thereof to one of the first cam portions 61.

With reference to FIGS. 28-31 a fifth example of a closure assembly according to the invention will now be discussed. The same reference numerals as in the previous examples are used to indicate the same components.

The depicted closure assembly comprises article 10 and cap 30. Also, as an optional feature, the closure assembly described in relation to these FIGS. 28-31 comprises an interference fit plug 80, e.g. allowing to obtain a closure assembly as described in WO2017/052364 and to allow for methods disclosed in said prior art document.

Generally the plug 80 is configured to be releasably mounted over the top end of the neck in an interference fit and to hermetically seal the product passage. The plug has a molded plug body of plastic material. For example, as shown here, the plug has a top portion 81 and a downward depending outer annular wall 82 adapted to be fitted over a top section of the exterior of the neck. For example, as shown here, the plug has a downward depending inner annular wall 83, concentric with the outer annular wall. This inner annular wall is configured to be introduced into the neck 11 and to seal on the interior side of the neck.

The cap 30 includes integrated tamper-evident ring member 50 and integrated strap 70. The tubular neck 11 forms a mouth at a top end of the product passage.

The cap 30 is made, e.g. moulded, as one piece of a plastic material and distinct from the article 10. The cap 30 is secured on the neck 11 and is adapted to be manually removed from the neck of the article by a user to open the product passage.

The cap comprises a top wall structure 31 and a downward depending skirt 32 having an interior side, exterior side, and a lower edge remote from the top wall structure.

When, as shown here, the plug 80 is present in the closure assembly, it is envisaged that and the cap 30 and the plug 80 are provided with cooperating snap-fit formations, here embodied as slit(s) or groove(s) in the top end of the skirt and the retention rib 85 on the plug 80.

It is illustrated that the neck 11 of the article has a snap connector formation 21 to provide a snap-on functionality for the cap 30. This formation 21 is arranged on the neck below the zone where the plug 80 sealingly engages the exterior of the neck, as is a preferred embodiment of the plug 80.

The cap 30 and the plug 80 are embodied such that, with the plug 80 placed over the top end of the neck, the cap 30 can be lowered over the plug 80 in an manner causing the cap 80 to be snapped onto the neck 11 and causing the plug to couple to the cap. The cooperating snap fit formations coupling the plug to the cap are such that upon manually opening of the cap the plug 80 remains coupled to the cap 30 and is entrained with the cap so as to open the product passage, e.g. allowing dispensing of a flowable product from a filled pouch provided with the article.

A tamper-evident ring member 50 is integrally formed to the lower edge of the skirt 32 of the cap. The tamper-evident ring member comprising a base portion, preferably as shown here an annular base portion 51. This base portion is connected via one or more breakable bridges 53 to the skirt 32. The base portion 51 is configured to remain connected to the article upon removal of the cap 30 from the neck 11 of the article by the user.

The cap 30 is a snap-on type cap, here a quarter turn lift cap 30, providing in use of the closure assembly a snap-on functionality so that the cap 30 can be replaced on the neck 11 after first time opening, e.g. if the user wants to close the assembly while some product remains in the container to which the assembly is fitted.

Multiple hook members 52 are integrally formed to the bottom of ring member flange portion 54, the hook members being distributed in a circumferential direction of the ring member flange portion.

The article further comprises a circumferential flange structure 16 which comprises an annular flange portion 17. The annular flange portion 17 is provided with multiple hook member passages that each extend between the top face and the bottom face through said annular flange portion 17. Each hook member passage being adapted to receive a hook member 52 when the cap 30 is secured on the neck, here also over the plug 80 already placed on the top of the neck.

The cap 30 comprises at least one wing-shaped handle 33, here as preferred a single pair of wing-shaped handles. These one or more wing-shaped handles each extend outwardly from the skirt 32 of the cap 30, for example (as here) in mutually opposite directions. The handles are configured to be engaged by a user for removal of the cap 30.

The wing-shaped handles 33 each have, seen in side view thereon, an outer periphery 34 comprising a bottom side 34*a*, a top side 34*b*, and a tip 34*c* remote from the skirt 32.

The bottom side 34*a* and the top side 34*b* are vertically spaced apart from one another. The tip 34*c* extends over a height between a top end thereof adjoining the top side 34*a* and a lower end thereof adjoining the bottom side 34*b*.

In this exemplary embodiment, the top side 34*a* extends further outward than the vertically extending section of the tip 34*c*. The tip further comprises an outward section joining the top end of the vertically extending section to the outer end of the top side 34*a*, so as to form an overhanging portion 33*d* of the wing-shaped handle 33.

The integrally formed, e.g. moulded, strap 70 is integral at a first end 71 thereof to the annular base portion 51 of the tamper-evident ring member 50 and at a second end 72 thereof integral to the skirt of the cap. The strap 70 is adapted to remain connected to both the annular base portion 51 of the tamper-evident ring member and the skirt 32 of the cap 30 upon removal of the cap 30 from the neck 11 of the article by the user.

The strap 70, prior to first time removal of the cap by the user, is located in a generally vertical plane that is in common with a panel portion of the respective wing-shaped handle 33.

The strap 70, prior to first time removal of the cap 30 by the user, comprises an undulating strap section 170 having strap portions 171 in an undulating pattern. Successive strap portions are integral at an apex 172 of the undulating strap section 170. The undulating strap section 170 allows for an increased length of the strap compared to a design wherein the strap lacks an undulation portion and follows (at least a part of) the outer contour of the wing-shaped handle 33. For example, an undulating strap section 170 is provided in combination with a relatively short handle 33 seen in lateral direction, as in FIGS. 28-29. For example, the handle having a lateral extension of between 5 and 15 millimeters relative to the skirt of the cap.

It is shown here, that the strap portions 171 are arranged substantially horizontal. Here ten strap portions 171 make up the section, but another number of portions 171 could also be provided for, e.g. at least five portions 171.

By increasing the number of portions, e.g. to more than five, one can effectively reduce the length of each individual portion 171, e.g. to less than 10 millimeters, e.g. between 4 and 8 millimeters, and thereby avoid undue sagging or the like in the undulating section 170.

It is shown here, as preferred, that the undulating strap section 170 is adjoined to the wing-shaped handle 33 via one or more breakable bridges 176, e.g. a breakable bridge extending from an apex thereof to the wing-shaped handle 33. This also counters any undue sagging or the like in the undulating section 170.

In embodiments, as here, the horizontal extension of the undulating strap section 170 is less than the horizontal distance between the skirt and the vertically extending section of the tip 34*c*.

It is shown here, that the undulating strap section 170 is arranged below the overhanging portion 33*d* of the handle 33, outwardly adjacent the vertical section of the tip of the handle. This provides some protection of the section 170 against undue interference, e.g. when handling the cap during assembly of the closure assembly.

It is shown here, that a lowermost strap portion 173 extends from the base portion 51 outward, along the bottom side 34*b* of the wing-shaped handle and then even further outward. The undulating strap section 170 adjoins the lowermost strap portion 173 at its outer end and extends in an undulating pattern along the vertically extending section of the tip 34*c*, and the strap 70 then continues about the overhanging portion 33*d* of the handle, here via an uppermost strap portion 174 to the skirt. This arrangement allows for an optimum length of the strap 70 with a fairly small dimensioned handle 33.

FIG. 32 shows an alternative to the cap 30 discussed with reference to FIGS. 28-31. Here the undulating section 170 of the strap 70 connects to the wing-shaped handle 33, at the overhanging portion 33*d* thereof.

FIG. 33 shows yet another alternative to the cap 30 discussed with reference to FIGS. 28-31, and/or FIG. 32. Herein the undulating portion 170 of the strap 70 is embodied so that the portions 171 thereof extend vertically instead of horizontally.

FIG. 33 shows that each portion 171 of the section 170 extends generally parallel to a vertical section of the wing tip 34*c* and over a major portion of the height thereof, so as to maximize the length of each portion 171. As can be seen, potentially less portions 171 are provided for than with a horizontal arrangement.

FIG. 33 shows that one or more breakable bridges 176 connect the undulating section 170 to the handle 33. Further one or more breakable bridges 177 extend between parallel portions 171, so as to avoid undue sagging and the like. Upon opening the closure assembly these bridges 176, 177 easily break.

FIG. 34 shows yet another alternative to the cap 30 discussed with reference to FIGS. 28-31, and/or FIG. 32. Herein, the undulating portion 170 of the strap 70 is located within an open ended slot 34*d* defined by the contour of the wing-shaped handle 33. As preferred, the second end of the strap 70 connects to the handle 33 at the top end of the open slot 34*d*.

As preferred, the open ended slot 34*d* is open towards the bottom of the handle 33. More preferably, as shown, the open ended slot 34*d* is located between an inner handle portion 33*f* directly integral with the skirt of the cap 30 and an outer handle portion 33*g* connected to the inner handle portion 33*f* via an overhead portion 33*h* of the handle 33.

It is shown that the cap 30 only has one wing-shaped handle 33. If desired, the cap may have more than one handle 33, e.g. two oppositely extending handles, one being provided with a strap 70.

As explained before, one or more breakable bridges may be provided between the strap 70 and the handle 33 and/or between strap portions of the undulating section.

With reference to FIGS. 35-37 now yet another embodiment of a closure assembly comprising an article and a cap according to the invention will be discussed. The same reference numerals as in the previous examples are used to indicate the same components.

As best seen in FIG. 36, the article 10 has the tubular neck 11 around the product passage and forming a mouth at a top end of the product passage. The article 10 further comprises a circumferential wall 110 which is positioned around a bottom region of the neck 11 and spaced from the neck 11 thereby forming an inner space 111 which is open from above and adapted to receive the tamper-evident ring member 50 of the cap 30 therein. The circumferential wall 110 comprises at least one window, preferably multiple windows 116, which each extend through the wall 110 from a wall outer face to a wall inner face.

The tamper-evident ring member 50, here the annular base portion 51 thereof, is provided with at least one snap portion 51*c*, e.g. one snap portion for each window 116. The at least one snap portion is adapted to snap in a window 116 of the circumferential wall 110 when the annular base portion of the tamper-evident ring member is at least partially inserted into the inner space 111. This snap-connection is such that the base portion 51 remains connected to the article 10 upon removal of the cap 30 from the neck 11 of the article by the user.

The strap 70 is integral at a first end thereof to the base portion 51 of the tamper-evident ring member and at a second end thereof integral to another portion of the cap, e.g. to the skirt or to a wing-shaped handle 33 of the cap when present. The strap is adapted to remain connected to both the base portion of the tamper-evident ring member and said other portion of the cap upon removal of the cap from the neck of the article by the user.

As shown, the strap 70 has a lowermost portion that extends away from the first end of the strap that is integral with base portion 51 and that passes over the top edge of the circumferential wall 110. As preferred, in the configuration with a circumferential wall 110, the first end of the strap 70 connects to the upwardly directed first cam portion 61, which portion 61 protrudes above the wall 110.

With reference to FIGS. 38,39, and 40 yet another embodiment of a closure assembly comprising an article and a cap, said cap including an integrated tamper-evident ring member and, as preferred, an integrated strap, will be discussed. The same reference numerals as in the previous examples are used to indicate the same components.

The article 10 forms a tubular neck around a product passage with a mouth at a top end.

The cap 30 including the integrated tamper-evident ring member 50 and the integrated strap 70 is made, e.g. moulded, as one piece of a plastic material and distinct from the article.

FIG. 38 shows that the cap is secured on the neck of the article. The cap is manually removable.

The cap 30 comprises a top wall structure and a downward depending skirt 32 having an a lower edge remote from the top wall structure. The tamper-evident ring member is integrally formed to the lower edge of the skirt and comprises an annular base portion 51, which base portion is connected via one or more breakable bridges 53 to the skirt. The base portion is configured to remain connected to the article 10 upon removal of the cap 30 from the neck of the article by the user.

The article has a circumferential wall 110 which is positioned around a bottom region of the neck and spaced from the neck, thereby forming an inner space 111 which is open from above and adapted to receive the annular base portion 51 of the tamper-evident ring member of the cap therein. It is illustrated that the circumferential wall 110 is erected on a circumferential flange 17 that extends around the neck 11.

The annular base portion 51 is provided with at least one snap portion 51*c*, and the circumferential wall 110 is provided with a complementary snap formation, here with a window 116 through the circumferential wall from a wall outer face to a wall inner face, such that the snap portion 51*c* snaps onto or into the complementary snap formation, e.g. into the window, when the cap is placed on the neck and the annular base portion is at least partially inserted into the inner space, which snap connection is such that the base portion remains connected to the article upon removal of the cap from the neck by the user.

It is illustrated that the circumferential wall 110 and the skirt 32 of the cap 30 are provided with cooperating latching formations which are configured to form a snap connection when the cap 30 is placed on the neck 11 and to become unsnapped upon removal of the cap. These latching formations remain functional after first time removal of the cap from the article, e.g. allowing a user to place the cap back onto the article.

It is illustrated that the circumferential wall 110 has at least one latching window 18*b* and the skirt 32 is provided with at least one latching tab 65 that is snapped into said window 18*b* in the closed position of the cap, so upon removal of the cap the latching tab 65 becomes unsnapped from window 18*b* and released from the window 18*b*. It is preferred, as shown, that the circumferential wall 110 has one single pair of diametrically opposed latching windows 18*b* and that the skirt has one single pair of diametrically opposed latching tabs 65.

It is illustrated that the annular base portion 51 is provided with at least one snap portion 51*c*, e.g. multiple distributed around the annular base portion, e.g. four, and that the circumferential wall 110 is provided with a window 116 through the circumferential wall from a wall outer face to a wall inner face for each snap portion 51*c* of the annular base portion 51.

It is illustrated that the circumferential wall 110 is provided with two diametrically opposed latching windows 18*b* and the skirt has a pair of diametrically opposed latching tabs 65. In combination therewith the annular base portion 51 is provided with at least one snap portion, e.g. multiple distributed around the annular base portion, e.g. four portions 51*c*, and the circumferential wall is provided with a window 110 through the circumferential wall from a wall outer face to a wall inner face for each snap portion of the annular base portion in addition to the latching windows.

It is illustrated that the annular base portion has at least one first cam portion 61 that is integrally formed at a top face of annular base portion. The lower end of the skirt 32 of the cap is provided with at least one second cam portion 62, which defines a cam follower surface adapted to interact with a cam surface of the first cam portion 61, so that upon first time opening of the closure assembly by rotation of the cap about a main axis of the neck, the first and second cam portions interact in order to cause axial lifting of the cap relative to the neck. It is illustrated, as preferred, that latching portion 65 of the cap is arranged on the second cam portion 62, wherein this second cam portion protrudes downwardly from the skirt.

It is illustrated, that a top region of the annular base portion, here of a first cam portion 61 thereof, protrudes upwardly above the circumferential wall 110.

It is illustrated, that strap 70 adjoins at a first end thereof this upwardly protruding top region. The strap 70 adjoins at a second end thereof another portion of the cap 30, here the wing-shaped handle 33 thereof. The strap 70 is adapted to remain connected upon removal of the cap from the neck of the article by the user.

It is illustrated that the annular base portion has a pair of first cam portions 61 that are arranged in a vertical plane through the wing-shaped handles 33, wherein the first end of the strap is integral with a protruding region of one of the first cam portions 61 at a location above the circumferential wall 110 and lies in a vertical plane common with said handles 33.

In the FIG. 41 the outline of a top portion of a collapsible pouch 150 is shown as well as shows a closure assembly according to the invention. The article and cap of this closure assembly are further shown in FIGS. 42 and 43.

The article 10 is embodied as a spout having a lower connector portion, e.g. a seal boat portion, that is secured in a seam of the pouch between opposed film walls of a collapsible pouch container 200, e.g. by heat sealing.

The article 10 has the tubular neck 11 and a circumferential wall 110 which is positioned around a bottom region of the neck 11 and spaced from the neck 11 thereby forming an inner space 111 which is open from above and adapted to receive the tamper-evident ring member 50 of the cap 30 therein. The circumferential wall 110 comprises multiple windows 116 distributed around the circumference. These windows 116 each extend through the wall 110 from a wall outer face to a wall inner face.

The tamper-evident ring member 50, here the annular base portion 51 thereof, is provided with at a snap portion 51*c* for each window 116, here four portions 51*c* and four windows 116 as an example. The snap portion snaps into a window 116 when the cap is placed on the neck and in said process the annular base portion is at least partially inserted into the inner space 111. This snap-connection is such that the base portion 51 remains connected to the article 10 upon removal of the cap 30 from the neck 11 by the user.

In more detail, the snap portions 51*c* are arranged in proximity of the lower end of the base portion, which is tubular and has a planar lower end and an upper end defining ramp surfaces.

It is illustrated that the base portion 51 has a pair of first cam portions 61 that are integrally formed at a top face of base portion, at diametrically opposed locations. The lower end of the skirt 32 of the cap is provided with a pair of second cam portions 62, also at diametrically opposed locations. Each second cam portion 62 defines a cam follower surface adapted to interact with a cam surface of the first cam portion. Upon first time opening of the closure assembly by rotation of the cap 30 about the main axis of the neck 11, the first and second cam portions interact in order to cause axial lifting of the cap 30 relative to the neck.

It is illustrated that the first cam portions protrude with a top region thereof above the circumferential wall 110, when the snap portions 51*c* are snapped into their windows 116. The cap 30 has a strap 70 that adjoins at a first end thereof this upwardly protruding top region of the first cam portion 61.

The cap 30 has in addition to the skirt 31 and the top wall, a handle structure that forms one pair of wing-shaped handles 33, extending outwardly from the skirt 32 of the cap 30 in mutually opposite directions and configured to be engaged by a user for removal of the cap.

It is illustrated that the handle structure of the cap 30 is embodied with a vertically oriented panel that forms both handles 33 as well as a panel portion vertically above the skirt 32, so that the top edge of the panel is located higher than the top end of the skirt 32.

It is illustrated that the bottom side of the wing-shaped handles 33 adjoins the skirt 32 at a position that is located at a distance above the lower end of the skirt. The strap 70, which lies in the same vertical plane as the handle, has a vertical portion that extends from the first end of the strap vertically upwards to said location and along the exterior of the lower portion of the skirt 32. This vertical strap portion then adjoins a bend in the strap so that a successive strap portion extends outwards along the bottom side of the handle 33 towards the tip 43*c* of the handle. It is illustrated here that the strap 70 passes about the tip 34*c*, including the vertical edge section thereof, and has a second end along the top side of the handle, here in proximity of the tip.

The pair of first cam portions 61 are arranged in the vertical plane through the handle and the strap, with the first end of the strap being integral with a protruding region of one of the first cam portion at a location above the circumferential wall.

FIGS. 44 and 45 primarily serve to illustrated the tenth aspect of the invention, although one or more other aspects of the invention are also included in the depicted embodiment.

FIG. 44 shows article 10, wherein portions and details shown in other embodiments are denoted with the same reference numerals.

Compared to the first embodiment described herein with reference to FIGS. 1-12, the principle difference lies in the design of the cam mechanism.

The first cam portion 61 now is integral part of the article 10, so not part of the cap 30.

As preferred, two first cam portions 61 are arranged diametrically opposite from one another relative to the neck 11. In more detail, each cam portion 61 is integral with both the neck and annular flange portion 17, so arranged where these two parts adjoin one another. Generally, the cam portion protrudes upward from the top of the flange portion 17.

As can be seen in FIG. 45, the base portion 51 of the cap 30 is now devoid of any cam portion. Instead the base portion 51 is now construed with a recess 58 in which the cam portion 61 is received when the cap is mounted on the article with the cam portion 61 protruding above the base portion 51 so as to cooperate with the second cam portion 62 of the skirt of the cap.

It is illustrated, as preferred, that the second cam portion 62 is located at the lower edge of the skirt. In another embodiment, the second cam portion could be located at the interior side of the skirt, so that the skirt effectively obscures the cooperating cam portions from view when the cap is closed.

It is illustrated, as preferred, that the first and second cam portions are arranged in a zone of the neck and the interior of the skirt, respectively, that lies below the associated snap formation 21, 34. This, as shown, allows for a smooth embodiment of the neck 11 between the snap formation 21 and the mouth, e.g. in view of drinking wherein the user places the top portion of the neck 11 between the lips of the user.

Like in the embodiment of FIGS. 1-12, upon first time opening of the closure assembly by rotation of the cap 30 relative to the article about the main axis A, e.g. by at most a quarter turn,—the first and second cam portions interact in order to cause axial lifting of the cap relative to the neck, e.g. so that the co-operating snap connector formations disengage.

It is illustrated in FIG. 45 that, the cap comprises one or more wing-shaped handles 33, here just one pair of wing-shaped handles. These handles extend outwardly from the skirt of the cap in mutually opposite directions. The handles each have, seen in side view thereon, an outer periphery comprising a bottom side, a top side, and a tip remote from the skirt. The strap 70 is integral at a first end thereof to the base portion 51 of the tamper-evident ring member and at a second end thereof integral to a wing-shaped handle 33. Prior to first time removal of the cap by the user, the strap 70 is located in a plane, e.g. in a vertical plane, that is in common with a panel portion of the respective wing-shaped handle 33.

FIG. 46 shows yet another closure assembly according to the invention. For example, this closure assembly comprises the measures according to the eleventh aspect of the invention.

The same measures are, for example, represented in the embodiment of FIGS. 1-12.

An eleventh aspect of the invention relates to a closure assembly comprising an article and a cap, said cap including an integrated tamper-evident ring member and an integrated strap, wherein:

The pouch 150 is provided with the article embodied as a spout, e.g. as shown in FIG. 40.

The cap 30 of FIG. 46 is quite similar to the cap 30 shown in FIGS. 38, 39.

The cap 30 comprises at least one handle configured to be engaged by a user for removal of the cap, here one pair of diametrically opposed handles 33.

Each handle 33 has a panel portion 35 that extends outwardly from the skirt of the cap, here in top or plan view radially outward relative to main axis A of the spout.

The panel portion 35 has opposing main panel faces, that are each being bounded, seen in side view onto the cap 30, by a bottom side, a top side, and a tip of the panel portion.

Each handle 33 further has at least one reinforcing top protrusion **33*b*, here two protrusions 33*b*1, 33*b*2, that is integral with the top side of the panel portion 33*a*. Each top protrusion 33*b*1, 33*b*2 protrudes away from respective main face of the panel portion 33*a* so as to reinforce the panel, e.g. increase the resistance to bending when rotating the cap 30** for opening the closure assembly.

In more detail, each handle 33 has two diverging top protrusions that extend inclined upward from the panel portion 35 at the top side and which diverge from one another defining a Y-shaped vertical cross-section of the wing shaped handle 33 together with the panel portion 35. In even more detail, seen in view vertical cross-section, the two diverging top protrusions are curved away from one another to provide extra strength and grip of the user.

The strap 70 is integral at a first end thereof to the base portion of the tamper-evident ring member and extends from the first end along the bottom side of the panel portion **33*a*, about the tip of the panel portion to a second end 72 of the strap. The second end 72 of the strap adjoins the outer end of the reinforcing top protrusion 33*b***.

In this design thin walled panel portion 35 is effectively reinforced by the top protrusion **33*b* to provide sufficient strength, e.g. for opening of the closure assembly. The second end 72 of the strap adjoins an outer end of this top protrusion. For example, when opening the cap, any load of strap onto the handle is then readily absorbed, at least in part, by the top protrusion 33*b*** allowing for a thin panel portion and thus reduction of the amount of plastic for the cap.

The top protrusions **33*b* link up with the top wall structure 31 of the cap, which provides enhanced strength. In the depicted design, the top protrusions 33*b* are shaped to extend higher than the top wall structure 31**.

It is shown that the top protrusions **33*b* each extend outward relative to the main axis A over at least half the outward extension of the handle 33 relative to the main axis, e.g. between 60 and 90% of the outward extension of the handle 33**.

It is shown that the second end 72 of the strap 70 connecting to the outer end of the reinforcing top protrusion **33*b* is located remote from the skirt 32 of the cap at a location that is at least 10 millimetres outward from the skirt, e.g. for embodiments wherein the neck 11 has an outer diameter of between 8 and 13 millimetres. This, e.g. allows for the user to place a finger, e.g. a thumb, onto the handle 33 at a location adjacent the skirt 32, wherein this finger does not interfere with the flexing of the strap 70 when rotating the cap 30 for first time opening and where the top protrusion creates enhanced robustness of the handle. This embodiment is, for example, of relevance for a quarter turn cap, e.g. a quarter turn snap-on type cap, e.g. as discussed herein with reference to FIGS. 38-40. This embodiment allows for a limited length of the strap 70**. In practical embodiments, the length of the strap is between 30 and 50 millimetres, e.g. sufficient to allow moving the cap over the top end or mouth end of the neck for removal and replacement of the cap.

In the depicted embodiment, the panel portion 35 is vertical, so its main planar extension is parallel to the main axis A. In another embodiment, e.g. in conjunction with an inverted L-shaped vertical cross-section of the handle, the panel portion 35 can also be tilted relative to the main axis, e.g. lightly tilted.

The panel portion 35 as shown is a planar panel portion, so lacking any undulations, warping, etc.

The panel portion 35, as preferred has a thickness of at most 2 millimetres, measured between the opposing main faces. For example, the thickness of a panel portion 35 is between 0.5 and 1 millimetres. For example, the thickness is the greatest at the top side of the panel portion and gradual reduces towards the bottom side of the panel portion. For example, the thickness is about 1 millimetre at the top side and about 0.5 millimetre at the bottom side.

It is shown, as in other illustrated embodiments, that the reinforcing top protrusion **33*b* is the only reinforcement of the panel portion 35**, so a reinforcement along the bottom side or tip is absent.

As is explained with, for example, reference to FIGS. 38-40, the exemplary cap of FIG. 46 is a quarter turn lift cap, more particular a quarter turn opening snap-on type cap.

For example, as shown here, each handle 33 extends at least 25 millimetres outward from the axis A of the tubular neck, e.g. for embodiments wherein the neck has an outer diameter of between 8 and 13 millimetres as shown here. For example, the tip outermost point lies between 25 and 40 millimetres outward from the axis A of the tubular neck, e.g. the total width of the cap 30 having two opposed wing-shaped handles 33 being between 50 and 80 millimetres. In practical embodiments, the length of the strap 70 is between 30 and 50 millimetres, e.g. sufficient to allow moving the cap 30 over the top end or mouth end of the neck 11 for removal and replacement of the cap.

In practical embodiments, each handle has a height between 10 and 20 millimetres, e.g. for embodiments wherein the neck has an outer diameter of between 8 and 13 millimetres.

FIG. 47 shows a further embodiment of an inventive closure assembly, having a number of features as already discussed herein with reference to FIG. 46.

The strap 70 here extends, prior to first time removal of the cap 30 by the user, in its entirety underneath the panel portion 35 of the wing-shaped handle 33 of the cap 30, as preferred in a common vertical or near vertical plane with the panel portion.

The strap 70 here has an undulating or single loop type design. A first strap portion 171*a* extends from the first end 71 of the strap 70 outwards to an apex 172 of the strap 70, which is preferably located as far outwards as the tip of the wing shaped handle 33. At the apex, effectively a 180 degree bent portion of the strap 70, a second strap portion 171*b* connects to the apex and extend inward above the first strap portion 171*a*. The second strap portion 171*b* extends, as preferred, parallel to the lower located first strap portion 171*b*. The second strap portion 171*b* ends at the second end 72 of the strap 70, which is integral with the bottom side 34*c* of the outer periphery of the wing-shaped handle 33. So, the depicted strap 70 of FIG. 47 does not extend about the tip 34*c* of the wing shaped handle, e.g. as shown in FIG. 46. The second end 72 is spaced from the skirt 32 of the cap 30, e.g. the end 72 being within 10-20 millimetres from the axis A for a cap 30 fitting on a neck of an outer diameter between 8 and 13 millimetres. As preferred, the tip 34 is at least 25 millimetres from the axis A. As preferred, the bent portion 72 of the looped strap 70 is located beneath the tip 34*c*.

It is illustrated that the wing shaped handle 33 is provided with an arrangement of one or more top protrusions 33*b*1, 33*b*2 reinforcing the panel portion 35 along the top side thereof.

FIG. 48 shows a closure assembly embodied as a variant of the closure assembly discussed with reference to FIGS. 1-12. The second end of the strap 72 is now located much closer to the skirt 32 of the cap 30, effectively lengthening the portion of strap 70 above the top side of the panel 33*a* portion of the wing shaped handle 33.

FIG. 48 also illustrates that this upper portion of the strap 70, which strap 70 extends about the tip of the wing panel 33*a*, is integrated with the top reinforcement 33*b* of the wing panel 33*a*. This reinforcement 33*b*, as preferred, adjoins the top wall structure of the cap 30

The invention claimed is:

1. A closure assembly comprising an article and a cap, said cap including an integrated tamper-evident ring member and an integrated strap, wherein:

the article forms a tubular neck around a product passage in said article, said neck forming a mouth at a top end of said product passage, the cap including the integrated tamper-evident ring member and the integrated strap is made as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein in the closed position the cap is positioned on the neck and thereby seals the product passage, wherein in the open position the cap is removed from the neck, thereby leaving the product passage open, wherein the cap comprises a top wall structure and a downward depending skirt having an interior side, exterior side, and a lower edge remote from the top wall structure, wherein the tamper-evident ring member is integrally formed to the lower edge of the skirt of the cap, said tamper-evident ring member comprising a base portion, which base portion is connected via one or more breakable bridges to the skirt, wherein the base portion is configured to remain connected to the article upon removal of the cap from the neck of the article by the user, wherein the cap comprises a pair of wing-shaped handles, said pair of wing-shaped handles extending outwardly from the skirt of the cap in mutually opposite directions and being configured to be engaged by a user for removal of the cap, wherein the wing-shaped handles each have, seen in a side view thereon, an outer periphery comprising a bottom side, a top side, and a tip remote from the skirt, where said bottom side and top side adjoin at the tip, wherein the strap is integral at a first end thereof to the base portion of the tamper-evident ring member and at a second end thereof integral to one of the wing-shaped handles, wherein the strap is adapted to remain connected to both the base portion of the tamper-evident ring member and the respective wing-shaped handle upon removal of the cap from the neck of the article by the user, wherein the strap extends outward from the base portion of the tamper-evident ring member towards the tip of the respective wing-shaped handle along the bottom side of the wing-shaped handle, further about the tip of the wing-shaped handle, and along a portion of the top side of the wing-shaped handle to the second end of the strap, the second end of the strap being located at a distance outward of the skirt.

2. The closure assembly according to claim 1, wherein the strap, prior to a first time removal of the cap by the user, is located in a vertical plane, that is in common with a panel portion of the respective wing-shaped handle.

3. The closure assembly according to claim 1, wherein the integrated strap of the cap comprises a strap inner contour side, facing towards the respective wing-shaped handle prior to the first time removal of the cap, and a strap outer contour side, facing away from the respective wing-shaped handle.

4. The closure assembly according to claim 1, wherein the base portion of the tamper-evident ring member comprises one or more integrally formed hook members, and wherein the article comprises one or more hook member passages, each hook member passage being adapted to receive one of said hook members when the cap is secured on the neck.

5. The closure assembly according to claim 1, wherein the tip of the wing-shaped handles is a rounded tip seen in a side view thereon.

6. The closure assembly according to claim 1, wherein the strap comprises at least one hinge section wherein a cross-section of the strap is locally reduced allowing the strap to bend at the hinge section.

7. The closure assembly according to claim 6, wherein the hinge section is located at the second end of the strap where the strap connects to the respective wing-shaped handle.

8. The closure assembly according to claim 1, wherein the cap comprises one or more breakable tamper-evident bridges located between the strap and the respective wing-shaped handle, said one or more breakable tamper-evident bridges breaking upon first time removal of the cap by a user.

9. The closure assembly according to claim 1, wherein the cap is a quarter turn lift cap.

10. The closure assembly according to claim 1, wherein the closure assembly comprises:

at least one first cam portion defining a cam surface, which cam surface is angled with respect to a main axis of said tubular neck, which first cam portion is integrally formed on one of the lower edge of the skirt and a portion of the tamper-evident ring member, and at least one second cam portion defining a cam follower surface adapted to interact with the cam surface of the first cam portion, which second cam portion is integrally formed on the other one of the lower edge of the skirt and said portion of the tamper-evident ring member, wherein, upon first time opening of the closure assembly by rotation of the cap relative to the article about the main axis, the first and second cam portions interact in order to cause axial lifting of the cap relative to the neck.

11. The closure assembly according to claim 10, wherein a pair of first cam portions is integrally formed at a top face of a ring member flange portion of the tamper-evident ring member, at diametrically opposed locations, and wherein a pair of second cam portions is integrally formed at the lower end of the skirt, at diametrically opposed locations.

12. The closure assembly according to claim 11, wherein the first cam portion has an upwardly arched first cam surface with a centre raised above the ring member flange portion and with first and second ends where the arched first cam surface adjoins the top face of the ring member flange portion.

13. The closure assembly according to claim 10, wherein the second cam portion comprises an outwardly extending tab integrally formed at the lower end of the skirt and adapted to cooperate with the first cam surface.

14. The closure assembly according to claim 10, wherein the pair of wing-shaped handles extend in an imaginary vertical plane through the main axis of the neck, and wherein the cam portions of the pair of first cam portions are located on diametrically opposed locations relative to said imaginary vertical plane.

15. The closure assembly according to claim 1, wherein the article is a fitment that is configured to be secured to a container body.

16. The closure assembly according to claim 1, wherein the article is a spout which comprises a lower connector portion to be secured between opposed film walls of a collapsible pouch container.

17. A container provided with a closure assembly according to claim 1.

18. The closure assembly according to claim 1, wherein the cap is a snap-on type cap providing in use of the closure assembly a snap-on functionality so that the cap can be replaced on the neck after first time opening, wherein the article and the cap are provided with cooperating snap connector formations to provide the snap-on functionality.

19. The closure assembly according to claim 1, wherein each wing-shaped handle extends at least 25 millimetres outward from a main axis of the tubular neck, and wherein the neck has an outer diameter of between 8 and 13 millimetres.

20. A closure assembly comprising an article and a cap, said cap including an integrated tamper-evident ring member and an integrated strap, wherein:

the article forms a tubular neck around a product passage in said article, said neck forming a mouth at a top end of said product passage, the cap including the integrated tamper-evident ring member and the integrated strap is made as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein in the closed position the cap is positioned on the neck and thereby seals the product passage, wherein in the open position the cap is removed from the neck, thereby leaving the product passage open, wherein the cap comprises a top wall structure and a downward depending skirt having an interior side, exterior side, and a lower edge remote from the top wall structure, wherein the tamper-evident ring member is integrally formed to the lower edge of the skirt of the cap, said tamper-evident ring member comprising a base portion, which base portion is connected via one or more breakable bridges to the skirt, wherein the base portion is configured to remain connected to the article upon removal of the cap from the neck of the article by the user, wherein the cap comprises a pair of wing-shaped handles, said pair of wing-shaped handles extending outwardly from the skirt of the cap in mutually opposite directions and being configured to be engaged by a user for removal of the cap, wherein the wing-shaped handles each have, seen in a side view thereon, an outer periphery comprising a bottom side, a top side, and a tip remote from the skirt, where said bottom side and top side adjoin at the tip, wherein the strap is integral at a first end thereof to the base portion of the tamper-evident ring member and at a second end thereof integral to one of the wing-shaped handles, wherein the strap is adapted to remain connected to both the base portion of the tamper-evident ring member and the respective wing-shaped handle upon removal of the cap from the neck of the article by the user, wherein the base portion of the tamper-evident ring member comprises an annular ring member flange portion that has a top face, a bottom face, an inner face, and an outer face, wherein multiple hook members are integrally formed to the bottom face of the ring member flange portion, the hook members being distributed in a circumferential direction of the ring member flange portion, wherein each hook member comprises a leg having an upper end integral with the ring member flange portion and protruding downward from the ring member flange portion, wherein each hook member comprises a hook portion at a lower free end of the leg, wherein the article further comprises a circumferential flange structure which comprises an annular flange portion that is integrally formed to the neck and extends around the neck, which flange portion has a top face, a bottom face, and a periphery, wherein the annular flange portion on the neck of the article is provided with multiple hook member passages that each extend between the top face and the bottom face through said annular flange portion, each hook member passage being adapted to receive one of said hook members when the cap with the integrated tamper-evident ring member is secured on the neck, wherein the hook portion of each hook member engages underneath the bottom face of the annular flange portion on the neck of the article, and wherein the closure assembly is embodied such that upon a first time opening of the closure assembly by removal of the cap by a user the one or more breakable bridges break and the annular ring member flange portion is retained by means of the hook members.

21. The closure assembly according to claim 20, wherein the flange structure further comprises a peripheral protective rim portion that is integral to and extends upwards from the annular flange portion at the periphery thereof, so that the top face of the annular flange portion and the protective rim define an annular recess around the neck, wherein the periphery of the annular ring member flange portion is shaped to fit within the protective rim portion as the annular ring member flange portion is at least partially inserted in said annular recess upon mounting of the cap with the integrated tamper-evident ring member on the neck, wherein the peripheral protective rim portion is adapted to obstruct lateral access from outside to the interface between the top face of the flange portion of the article and the bottom face of the flange portion of the ring, and wherein the closure assembly is embodied such that upon a first time opening of the closure assembly by removal of the cap by a user the one or more breakable bridges break and the annular ring member flange portion is retained in the recess of the article by means of the hook members.

22. The closure assembly according to claim 20, wherein the cap comprises one or more breakable tamper-evident bridges located between the strap and the respective wing-shaped handle, said one or more breakable tamper-evident bridges breaking upon first time removal of the cap by a user.

23. The closure assembly according to claim 20, wherein the cap is a quarter turn lift cap.

24. The closure assembly according to claim 20, wherein the closure assembly comprises:

at least one first cam portion defining a cam surface, which cam surface is angled with respect to a main axis of said tubular neck, which first cam portion is integrally formed on one of the lower edge of the skirt and a portion of the tamper-evident ring member, and at least one second cam portion defining a cam follower surface adapted to interact with the cam surface of the first cam portion, which second cam portion is integrally formed on the other one of the lower edge of the skirt and said portion of the tamper-evident ring member (50), wherein, upon first time opening of the closure assembly by rotation of the cap (30) relative to the article about the main axis, the first and second cam portions interact in order to cause axial lifting of the cap relative to the neck.

25. The closure assembly according to claim 24, wherein a pair of first cam portions is integrally formed at a top face of a ring member flange portion of the tamper-evident ring member, at diametrically opposed locations, and wherein a pair of second cam portions is integrally formed at the lower end of the skirt, at diametrically opposed locations.

26. The closure assembly according to claim 25, wherein the first cam portion has an upwardly arched first cam surface with a centre raised above the ring member flange portion and with first and second ends where the arched first cam surface adjoins the top face of the ring member flange portion.

27. The closure assembly according to claim 24, wherein the second cam portion comprises an outwardly extending tab integrally formed at the lower end of the skirt and adapted to cooperate with the first cam surface.

28. The closure assembly according to claim 24, wherein the pair of wing-shaped handles extend in an imaginary vertical plane through the main axis of the neck, and wherein the cam portions of the pair of first cam portions are located on diametrically opposed locations relative to said imaginary vertical plane.

29. The closure assembly according to claim 20, wherein the article is a fitment that is configured to be secured to a container body.

30. The closure assembly according to claim 20, wherein the article is a spout which comprises a lower connector portion to be secured between opposed film walls of a collapsible pouch container.

31. A container provided with a closure assembly according to claim 20.

32. The closure assembly according to claim 20, wherein the cap is a snap-on type cap providing in use of the closure assembly a snap-on functionality so that the cap can be replaced on the neck after first time opening, wherein the article and the cap are provided with cooperating snap connector formations to provide the snap-on functionality.

33. The closure assembly according to claim 20, wherein each wing-shaped handle extends at least 25 millimetres outward from a main axis of the tubular neck, and wherein the neck has an outer diameter of between 8 and 13 millimetres.

* * * * *